US010546457B2

(12) United States Patent
Snow et al.

(10) Patent No.: US 10,546,457 B2
(45) Date of Patent: Jan. 28, 2020

(54) GAMING TABLES AND METHODS FOR ADMINISTERING ROULETTE BONUS WAGERS USING A ROULETTE BALL LAUNCHING SYSTEM

(71) Applicant: Bally Gaming, Inc., Las Vegas, NV (US)

(72) Inventors: Roger M. Snow, Las Vegas, NV (US); Haven A. Mercer, Excelsior, MN (US); Troy D. Nelson, Big Lake, MN (US); James P. Helgesen, Eden Prairie, MN (US); Paul K. Scheper, Bloomington, MN (US); Jamal Hani Kotifani, Eden Prairie, MN (US); Georg Fekete, Korneuburg (AT)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/276,642

(22) Filed: Sep. 26, 2016

(65) Prior Publication Data

US 2017/0092037 A1 Mar. 30, 2017

Related U.S. Application Data

(63) Continuation-in-part of application No. 14/865,592, filed on Sep. 25, 2015, now Pat. No. 10,105,591.
(Continued)

(51) Int. Cl.

| | |
|---|---|
| ***A63F 9/04*** | (2006.01) |
| ***G07F 17/32*** | (2006.01) |
| ***G07F 17/34*** | (2006.01) |

(52) U.S. Cl.
CPC ..... *G07F 17/322* (2013.01); *G07F 17/323* (2013.01); *G07F 17/3244* (2013.01); *G07F 17/3267* (2013.01); *G07F 17/34* (2013.01)

(58) Field of Classification Search
CPC ... A63F 5/00; A63F 5/02; G07F 17/32; G07F 17/34; G07F 17/322; G07F 17/323; G07F 17/3244; G07F 17/3267
(Continued)

(56) References Cited

U.S. PATENT DOCUMENTS

| | | | |
|---|---|---|---|
| 1,527,876 | A | 2/1925 | Janik |
| 1,537,236 | A | 5/1925 | Jarvis |

(Continued)

FOREIGN PATENT DOCUMENTS

| | | | |
|---|---|---|---|
| CN | 1745864 | A | 3/2006 |
| EP | 0160157 | A2 | 11/1985 |

(Continued)

*Primary Examiner* — Joseph B Baldori
(74) *Attorney, Agent, or Firm* — TraskBritt

(57) ABSTRACT

Methods of administering games of roulette may involve accepting a wager may from a player and using a ball launching system to launch at least one roulette ball into a track of a roulette wheel. A number and associated color may be randomly generated from within a range of numbers and associated colors. The triggering event may be identified by determining whether the randomly generated number is identical to a randomly generated number from an immediately preceding round. Upon identifying a triggering event, one or more additional special games of roulette may be played and a payout may be paid to the player according to a paytable associated with the outcome of the special game play. The amount of the wager may be collected for the house when the triggering event is not identified.

22 Claims, 25 Drawing Sheets

Related U.S. Application Data

(60) Provisional application No. 62/232,939, filed on Sep. 25, 2015.

(58) Field of Classification Search
USPC ..... 273/142 A, 138.3
See application file for complete search history.

(56) References Cited

U.S. PATENT DOCUMENTS 2,104,740 A 1/1938 Evans
2,490,802 A 12/1949 Hanff
3,084,680 A 4/1963 Goldfarb et al.
3,142,292 A 7/1964 Suchland
3,364,787 A 1/1968 Miller
3,511,225 A 5/1970 Yokoi
3,610,223 A 10/1971 Green
3,853,324 A 12/1974 Reiner et al.
3,870,307 A 3/1975 Meyer et al.
4,010,953 A 3/1977 Russo
4,262,648 A 4/1981 Wegener et al.
4,337,945 A 7/1982 Levy
4,471,746 A 9/1984 Ando
4,643,425 A 2/1987 Herzenberger
4,735,416 A 4/1988 McNally
4,754,980 A 7/1988 Torgow
4,869,505 A 9/1989 Manabe
5,042,810 A 8/1991 Williams
5,048,832 A 9/1991 Kaminkow
5,261,851 A 11/1993 Siebert, Jr.
5,326,103 A 7/1994 Lund et al.
5,415,150 A 5/1995 Dallas
5,501,457 A 3/1996 Ogihara
5,588,650 A 12/1996 Eman et al.
5,636,838 A 6/1997 Caro
5,687,967 A 11/1997 Klaus
5,718,431 A 2/1998 Ornstein
5,743,798 A 4/1998 Adams et al.
5,743,800 A 4/1998 Huard et al.
5,836,583 A 11/1998 Towers
5,857,451 A 1/1999 Ciluffo et al.
5,975,527 A 11/1999 Winchester
5,980,399 A 11/1999 Campbell et al.
6,019,095 A 2/2000 Sommer et al.
6,059,659 A * 5/2000 Busch ..... A63F 5/00 273/142 B
6,083,105 A 7/2000 Ronin et al.
6,089,215 A 7/2000 Morris et al.
6,099,417 A 8/2000 Brown et al.
6,159,112 A 12/2000 Ciluffo et al.
6,379,257 B1 4/2002 Skleba et al.
6,520,854 B1 2/2003 McNally
6,616,530 B2 9/2003 Pearce et al.
6,659,866 B2 12/2003 Frost et al.
6,755,741 B1 6/2004 Rafaeli
7,383,832 B2 6/2008 Soberg
7,661,676 B2 2/2010 Smith et al.
7,669,853 B2 3/2010 Jones
7,674,172 B2 3/2010 Miltenberger et al.
7,806,788 B1 10/2010 Neuman
7,815,187 B2 10/2010 Yokota
7,841,597 B2 11/2010 Cammegh
7,901,285 B2 3/2011 Tran et al.
7,926,810 B2 4/2011 Fisher et al.
7,934,980 B2 5/2011 Blaha et al.
7,988,548 B2 8/2011 Okada
8,028,993 B2 10/2011 Witty
8,152,170 B2 4/2012 Yokota et al.
D663,785 S 7/2012 Walsh et al.
8,272,958 B2 9/2012 Smith et al.
8,282,100 B2 10/2012 Kido
8,286,619 B2 10/2012 Mihaljevic
8,381,709 B2 2/2013 Woessner et al.
8,439,360 B2 5/2013 Kido
8,511,682 B2 8/2013 Yokota
8,517,382 B1 8/2013 Pagliuca
8,899,586 B2 12/2014 Shelburn et al.
9,067,119 B1 6/2015 Vaught et al.
9,259,631 B2 2/2016 Gowan et al.
9,266,014 B2 2/2016 Dayal et al.
9,452,340 B2 9/2016 Vaught et al.
2003/0060263 A1 3/2003 Pearce et al.
2005/0020347 A1 1/2005 Moshal
2005/0164759 A1 7/2005 Smith et al.
2005/0164762 A1 7/2005 Smith et al.
2005/0192076 A1 9/2005 Lowery
2008/0139079 A1 6/2008 Siebert
2008/0242184 A1 10/2008 Divnick
2010/0120487 A1* 5/2010 Walker ..... G07F 17/3211 463/17
2011/0214652 A1 9/2011 Woessner et al.
2013/0053117 A1 2/2013 Snow
2013/0059638 A1* 3/2013 Nicely ..... G07F 17/322 463/17
2013/0184059 A1 7/2013 Costello et al.
2013/0184079 A1 7/2013 Costello et al.
2013/0214486 A1 8/2013 Shelburn et al.
2014/0094244 A1 4/2014 Baron et al.
2014/0345585 A1 11/2014 Allen et al.
2014/0370980 A1 12/2014 Czyzewski et al.
2015/0157927 A1 6/2015 Shelburn et al.
2016/0250536 A1 9/2016 Hart
2017/0087446 A1 3/2017 Mercer et al.

FOREIGN PATENT DOCUMENTS

ES 1077627 U 8/2012
ES 1087979 U 8/2013
FR 2775910 A1 9/1999
JP 2015029801 A 2/2015
TW 201023954 A 7/2010
WO 2008153505 A2 12/2008
WO 2010141736 A1 12/2010
WO 2014188025 A 11/2014
WO 2014189936 A1 11/2014

* cited by examiner

GAMING TABLES AND METHODS FOR ADMINISTERING ROULETTE BONUS WAGERS USING A ROULETTE BALL LAUNCHING SYSTEM

CROSS-REFERENCE TO RELATED APPLICATIONS

This application is a continuation-in-part of U.S. patent application Ser. No. 14/865,592, filed Sep. 25, 2015, now U.S. Pat. No. 10,105,591, issued Oct. 23, 2018, the disclosure of which is incorporated herein in its entirety by this reference. In addition, this application claims the benefit of U.S. Provisional Patent Application Ser. No. 62/232,939, filed Sep. 25, 2015, the disclosure of which is incorporated herein in its entirety by this reference. The subject matter of this application is also related to the subject matter of U.S. patent application Ser. No. 15/073,498, filed Mar. 17, 2016, now U.S. Pat. No. 10,118,087, issued Nov. 6, 2018, and to the subject matter of U.S. patent application Ser. No. 15/099,174, filed Apr. 14, 2016, now U.S. Pat. No. 10,076,701, issued Sep. 18, 2018.

TECHNICAL FIELD

This disclosure relates generally to methods of administering wagering games for casinos and other gaming establishments, and related systems and apparatuses. More specifically, disclosed embodiments relate to methods of administering roulette games in which a wager may be accepted, and a payout on the wager may be paid when a triggering event including the same, consecutive winning outcome repeated in two successive rounds of play occurs, an amount of the payout being determined by comparing a paytable to the result of one or more additional special roulette games initiated by the triggering event. Disclosed embodiments also relate to devices and apparatuses for administering the methods.

BACKGROUND

Roulette is a popular wagering game played in casinos and other gaming establishments. Avid players are generally open to, and sometimes specifically seek out, new and more interesting ways to play roulette, particularly when the reward for a winning outcome at the end of a round of play, or the odds of achieving a winning outcome, may be enhanced. For example, U.S. Pat. No. 5,743,798, issued Apr. 28, 1998, to Adams et al., discloses a progressive side bet for roulette that a player wins when the player bets on the same winning number four times in a row, an amount of the winnings being a fixed amount that grows with successive rounds; a progressive pot, less a rake; or a randomly selected amount. Similarly, U.S. Pat. No. 5,042,810, issued Aug. 27, 1991, to Williams, discloses a progressive side bet for roulette that a player wins when the same winning number occurs three and four games in a row, an amount of the winnings being an amount accumulated in a progressive pot. U.S. Pat. No. 5,743,800, issued Apr. 28, 1998, to Huard et al., discloses a progressive side bet applicable to roulette that a player wins when a randomly selected number is the winning number or when the player is simply randomly selected from a number of players or player positions, which may further involve randomly selecting the amount of the prize as a fixed amount or as a percentage of a progressive pot. U.S. Pat. No. 5,718,431, issued Feb. 17, 1998, to Ornstein, discloses a streak side wager for roulette that a player wins when the player achieves a preselected number of consecutive wins on the same conventional roulette wager (e.g., odds, evens, red, black, split, box, specific number, etc.). U.S. Patent App. Pub. No. 2005/0020347, published Jan. 27, 2005, to Moshal, discloses a progressive side wager for roulette that a player wins when the outcome of a round and the outcome of the immediately preceding round are identical, an amount of the winnings being a fixed multiple of the amount of the wager or an entire amount of a progressive pot. U.S. Patent App. Pub. No. 2005/0192076, published Sep. 1, 2005, to Lowery, discloses a side bet for roulette that a player wins a fixed amount when a preselected outcome occurs in two consecutive rounds.

In addition, casino operators are always seeking new, eye-catching roulette systems and improvements that can leverage their existing facilities to better advantage. Generally, the popularity of gaming machines and systems that present roulette games to players is dependent on the likelihood (or perceived likelihood) of winning money at the machine or table and the intrinsic entertainment value of the system relative to other available gaming options. Where the available gaming options include a number of competing systems and the expectation of winning at each gaming system is roughly the same (or believed to be the same), players are likely to be attracted to the most entertaining and exciting systems. Shrewd operators consequently strive to employ the most entertaining and exciting games, features, and enhancements available because such offerings attract frequent play and hence increase profitability to the operator. Therefore, there is a continuous need for gaming machine manufacturers to continuously develop new games and improved gaming enhancements that will attract frequent play through enhanced entertainment value to the player.

BRIEF SUMMARY

In some embodiments, methods of administering games of roulette may involve accepting a wager from a player. A random outcome generation apparatus may be used to randomly generate a number and associated color from within a range of numbers and associated colors. A triggering event may be identified by determining whether the randomly generated number is identical to a randomly generated number from an immediately preceding round. Upon the occurrence of the triggering event, one or more special roulette games may be played. A payout based on the amount of the wager and modified according to a paytable associated with the outcome of the one or more special roulette games may be paid to the player. The amount of the wager may be collected for the house when the randomly generated number is different from the randomly generated number from the immediately preceding round.

In other embodiments, methods of administering games of roulette may involve accepting a first wager from a player. A second wager may also be accepted from the player. A random outcome generation apparatus may be used to randomly generate a number and associated color within a range of numbers and associated colors. A triggering event may be identified by determining whether the randomly generated number is identical to a randomly generated number from an immediately preceding round. Upon the occurrence of the triggering event, one or more special roulette games may be played. The second wager may be resolved by comparing the outcome of the one or more special roulette games with an associated paytable. The amount of the wager may be collected for the house when the randomly generated number is different from the randomly generated number from the immediately preceding round. The first wager may be resolved by comparing a characteristic of the randomly generated number and associated color with a characteristic associated with the first wager.

In the methods, a ball launching device or system may be utilized with the random outcome generation apparatus. According to one embodiment of the present disclosure, a ball launching device includes a driver configured to impart rotary motion and a rotor connected for rotation to the driver. The ball launching device further includes a ball cup assembly mounted to the rotor. The ball cup assembly includes a first cup wall spaced apart from a second cup wall, and the rotor and the ball cup assembly are positioned inside a roulette wheel bowl proximal to a circumferential ball track in the wheel bowl. The driver rotates the rotor to a launch angle with a roulette ball captured between the first and second cup walls, and, when the rotor is at a designated launch angle, a launch actuator causes at least one of the first and second cup walls to move away from the other cup wall to release the roulette ball from the ball cup assembly into the ball track.

In another embodiment, a ball launching system usable with the methods is a system configured to launch a roulette ball into a roulette wheel ball track. The ball launching system comprises a support stand, a driver configured to impart rotary motion, a launch actuator, a ball loader, and a rotor mounted on the support stand for rotation by the driver about a rotor axis. The support stand positions the rotor inside a perimeter of the ball track. A ball cup assembly is fixed to the rotor distal the rotor axis, and the ball cup assembly includes a first cup wall and second cup wall spaced oppositely apart from each other. The ball cup assembly has a retain mode during which the roulette ball is captured between at least the first and second cup walls. The ball cup assembly also has a release mode during which at least one of the first and second cup walls moves to release the roulette ball. The ball loader of the ball launching system delivers a roulette ball to the ball cup assembly when the rotor is positioned at a loading angle. With the ball cup assembly in the retain mode capturing the roulette ball, the driver rotates the rotor to a launch angle, and the launch actuator causes the ball cup assembly to switch to the launch mode to release the roulette ball into the ball track.

According to yet another embodiment of the disclosure, a method of conducting a roulette game with a ball launching system is disclosed. The ball launching system is mounted proximal to a roulette wheel and includes a rotor rotating substantially parallel to a plane of a roulette wheel ball track and a ball cup fixed to the rotor. The method includes spinning the roulette wheel and receiving a player input at a signal button to activate the ball launching system. In response to receiving a signal from the signal button, the method further includes rotating, via a driver configured to impart rotary motion, the rotor to a designated launch angle. In response to the rotor being at the launch angle, the method further includes triggering a launch of a roulette ball captured between a first and second cup wall of the ball cup by causing at least one of the first and second cup wall to move away from the other cup wall and release the ball into the roulette wheel ball track.

In other embodiments, gaming tables for administering games of roulette may include a playing surface including at least one player interface for at least one player position, an operator interface, and at least one processor. The at least one processor may be programmed to: accept a wager from a player; randomly generate a number and associated color within a range of numbers and associated colors; identify a triggering event by determining whether the randomly generated number is identical to a randomly generated number from an immediately preceding round; upon identifying the triggering event, randomly generate one or more additional numbers and associated colors within a range of numbers and associated colors to determine an outcome of one or more special roulette games; authorize payment of a payout to the player, an amount of the payout being equal to an amount determined by the wager and modified according to a paytable associated with possible outcomes of one or more special roulette games; and authorize collection of the amount of the wager for the house when the randomly generated number is different from the randomly generated number from the immediately preceding round.

In still other embodiments, methods of administering games of roulette over networks may involve receiving at a user interaction server authorization from a player to allocate funds to a wager. The game server may randomly generate a number and associated color within a range of numbers and associated colors. A triggering event may be determined at the game server by determining at the game server whether the randomly generated number is identical to a randomly generated number from an immediately preceding round. Upon identifying the triggering event, the game server may randomly generate additional number(s) and associated color(s) within a range of numbers and associated colors to produce outcomes of one or more special roulette games and authorize payment of a payout to the player. An amount of the payout may be equal to an amount of the wager modified according to a paytable associated with possible outcomes of the one or more special roulette games. The game server may authorize collection of the amount of the wager for the house when the randomly generated number is different from the randomly generated number from the immediately preceding round.

In other embodiments, methods of administering play-for-fun games of roulette over networks may include sending from a user interaction server a quantity of valueless wagering elements usable within a predetermined time period to a player. Authorization from a player may be received at the user interaction server to allocate at least one valueless wagering element to a wager. The game server may randomly generate a number and associated color within a range of numbers and associated colors. A triggering event may be identified by determining at the game server whether the randomly generated number is identical to a randomly generated number from an immediately preceding round. Upon identifying the triggering event, the game server may randomly generate additional number(s) and associated color(s) within a range of numbers and associated colors to produce outcomes of one or more special roulette games. The game server may authorize issuance of additional valueless wagering elements to the player according to a paytable associated with the outcomes of the one or more special roulette games. The game server may authorize deduction of the quantity of valueless wagering elements allocated to the wager when the randomly generated number is different from the randomly generated number from the immediately preceding round.

In yet other embodiments, methods of administering roulette games over networks may involve receiving at a user interaction server authorization from a player to receive a roulette wager and to receive a separate side bet wager on the occurrence of two consecutive identical game outcomes. A user interaction server may accept an election to make a roulette wager on a selection of a number and color combination within a range of number and color combinations from the player. The user interaction server may also receive a wager on the occurrence of a next number and color combination being identical to the last consecutive game outcome. The game server may identify a triggering event when the randomly generated number is identical to the randomly generated number from the immediately preceding round and authorize payment of a payout to the player. Upon identifying a triggering event, the game server may further randomly generate one or more numbers and associated colors within a range of numbers and associated colors to generate an outcome of one or more special roulette games. An amount of the payout may be equal to an amount of the side bet wager modified according to a paytable associated with the outcome of the one or more special roulette games. The roulette wager may be resolved by comparing the number selected by the player to the randomly generated number and authorizing at the game server payment of a payout to the player.

Further embodiments may include one, some, or all of the following: The acts of the dealer, croupier, or other operator may be carried out by a visual representation of a dealer, croupier, or other operator, the visual representation being generated and/or displayed by a computer. The visual representation may be a virtual person (e.g., an animation), or may be a transmission (e.g., a video) of an actual person. The visual representation may be part of an online gaming experience of the disclosed game. The acts described in this disclosure associated with a dealer or a croupier, including randomly generating a number and associated color (e.g., by introducing a ball onto a spinning roulette wheel or by activating an electronic random number generator), accepting or paying bets, or any other actions, may be represented in any way when used in an online environment. For example, the randomly generated numbers and associated colors generated with a dealer action or a croupier action, described as being produced or otherwise initiated by a dealer or a croupier, may appear as highlighted spaces on a virtual roulette wheel, as transmitted pictures of playing cards representing results achievable using a conventional physical roulette wheel, or as plain or colored text. This may include a display of a virtual roulette wheel where each space on the roulette wheel, with its associated number and color, is displayed to an online player in a manner consistent with the game play disclosed herein, but may or may not include a visual representation of a dealer or a croupier with the roulette wheel. Likewise, betting activity may be displayed in any manner to a player, including, but not limited to, virtual chips, betting pools, numbers, or other indicia of a bet amount.

The online experience may involve players playing remotely (e.g., in a different physical location) from the dealer or the croupier, remotely from the location of a game server, or remotely from both, interacting through a networked connection that may include, but is not limited to, the Internet. The online game play may involve players who are also physically remote from each other. Remote connections may use networks involving several types of network links including, but not limited to, the Internet. Networked connections allowing physically remote players to play a game using a game server or system may be part of an implementation of a virtual or online gaming environment.

Live, electronic, or online implementations of the methods described in this disclosure may be configured for administration as either "play-for-pay" embodiments or "play-for-fun" embodiments. In play-for-pay embodiments, wagers having real-world monetary value are received and payouts having real-world monetary value may be distributed. Play-for-pay embodiments include "house-banked" embodiments and "player-banked" embodiments. In house-banked embodiments, payouts are paid by, and losses are retained by, the game administrator (e.g., a casino or other gaming establishment). Play-for-fun embodiments (e.g., "free play-for-fun" configurations and "social play-for-fun" configurations) involve receiving wagers having no real-world monetary value and distribute payouts having no real-world monetary value.

The actions described in this disclosure as the acts of a player, including betting and any other actions, may be carried out over a network where the indicated actions are received as input to a device. The input-receiving device is typically physically remote from the game server or game host and is connected over a long-distance network, but may also be implemented over a wired or wireless LAN in one building, or even in one room, for example. In one embodiment, game play generated at the server or host location may be displayed on the same device as the receiving device. In some embodiments, game play may be conveyed to remote players in devices separate from the devices receiving input from a player, such as public screens or publicly broadcast data about a game coupled with individual or private input devices. The reception of an input at a device may be accomplished through any technology adapted for such a purpose including, but not limited to, keypads, keyboards, touchpads, touchscreens, buttons, mice, optical location devices, eye movement/location detectors, sound input devices, etc. When discussing a device, it is understood the device may comprise multiple components and be complex, including hardware components combined with firmware and/or software, and may itself be a subcomponent of a larger system.

Yet other embodiments may comprise apparatuses and systems for administering wagering games according to embodiments of the disclosure. These and additional embodiments will be apparent to those of ordinary skill in the art in view of the detailed description of various embodiments, which is made with reference to the drawings, a brief description of which is provided below.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
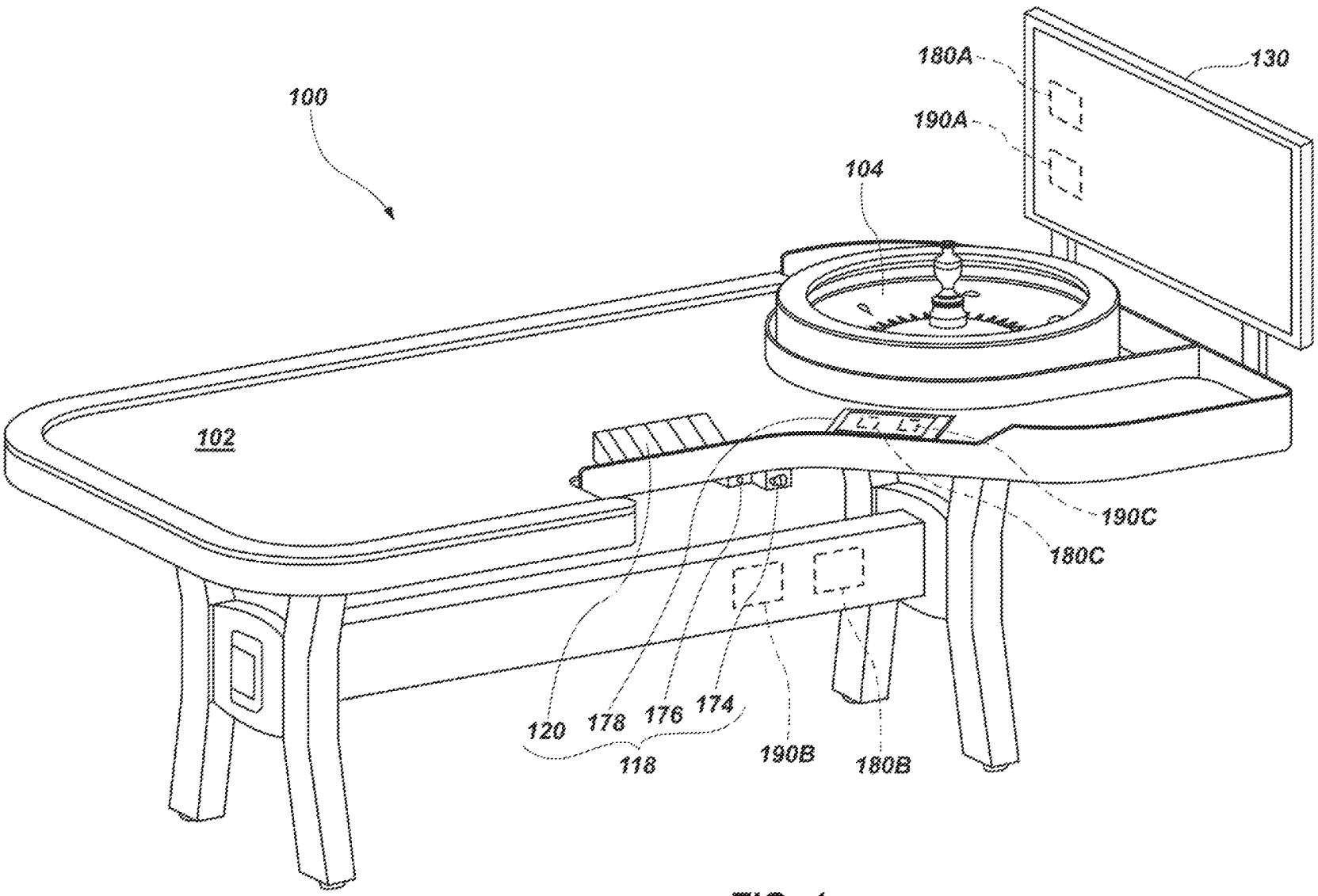
FIG. 1 is a perspective view of an exemplary roulette table that may be utilized to administer a roulette game in accordance with the present disclosure.

The illustrations presented herein are not meant to be actual views of any particular act and/or element in a method of administering a wagering game, apparatus or system for use in administering a wagering game, or component thereof, but are merely idealized representations employed to describe illustrative embodiments. Thus, the drawings are not necessarily to scale. Additionally, elements common between figures may retain the same or similar numerical designations. Elements with the same number, but including a different alphabet character as a suffix should be considered as multiple instantiations of substantially similar elements and may be referred generically without an alphabet character suffix. For example, elements 100*a*, 100*b*, and 100*c*, may be a device that is instantiated three times and generically referred to herein as element 100.

The terms "gaming," "gambling," or the like, refer to activities, games, sessions, rounds, hands, rolls, operations, and other events related to wagering games such as web-based games, casino games, card games, dice games, and other games the outcome of which is at least partially based on one or more random events ("chance" or "chances"), and on wagers that which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked" and "player-banked," configurations, each of which is described in more detail below) or in wagering games that involve no real-world monetary risks for the player (e.g., the "play-for-fun" and "social play-for-fun" configurations, which are described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local gaming table 100, 300, 582, 1700, or 1800 (see FIGS. 1, 3, 5, 17, and 18), or electronic authorizations of a transfer of money or digital (e.g., virtual) representations of money (e.g., digital representations of bills or coins, digital representations of chips, numerical quantities of money, numerical quantities of points, or numerical quantities of credits) at a local or remote electronic gaming device 100, 300, 420, 582, 1600, 1700, 1800, 1920, or 2040 (see FIGS. 1, 3 through 5, and 16 through 20). As used herein, the term "wagering element" means and includes objects and symbols used to signify the acceptance of a wager. For example, physical wagering elements include physical money (e.g., bills and coins) and physical wagering tokens (e.g., casino chips), which may or may not be redeemable for monetary value and may or may not include electronic identifiers (e.g., RFID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value).

As used herein, the terms "dealer" and "croupier" may be used interchangeably.

For the purposes of this description, it will be understood that when actions related to accepting wagers, making payouts, generating roulette outcomes, generating random events, selecting random event outcomes, accepting selection of roulette outcomes, or other actions associated with a player, a dealer, or a croupier are described herein, and such description includes a player, a dealer, or a croupier taking the action, some results of the action may be computer generated and may be displayed on a live or virtual table or electronic display, and, if applicable, the reception or detection of such an action in an electronic form where player, dealer, and croupier choices, selections, or other actions are received at an electronic interface. Also included is the representation of the corresponding physical roulette wheel on a display or displays, and, if applicable to the action described, an electronic reception of an indication that the roulette outcome has been received, selected, or otherwise interacted with at a location associated with a player, or, associated with a virtual player. This further includes the results of a virtual dealer and virtual players, where the actions described are actually generated by a computer (typically associated with an online game or computer-controlled electronic gaming platform). By way of a further example, if generating a random roulette outcome is described herein, the description includes (but is not limited to) the following: the introduction of an indicator (e.g., a ball) into a spinning roulette wheel and the indicator coming to rest on a number and its associated color; the generation and transmission of an electronic indication or representation of a number and its associated color from a game play source or server to an electronic receiver, where the receiver may be at a table (using virtual representations of a roulette wheel) including players and/or virtual players and/or a dealer or virtual dealer, at a public display in a casino, at a remote location (e.g., using online or Internet game play), or at other locations. Also included is the representation of a roulette layout, including betting areas, on a display or displays, and, if applicable to the action described, an electronic reception of an indication that a player has made a wager on a particular roulette outcome.

Various platforms are contemplated that are suitable for implementation of embodiments of wagering games according to this disclosure. For example, embodiments of wagering games may be implemented as live table games with an in-person dealer or croupier, partially or fully automated table games, and partially or fully automated, network-administered games (e.g., Internet games) wherein game results may be produced utilizing a live video feed of a dealer or croupier administering a game from a remote studio.

For example, in one embodiment, the players may be remotely located from a live croupier, and a live croupier and a roulette table may be displayed to players on their monitors via a video feed. The players' video feeds may be transmitted to the croupier and may also be shared among the players at the table. In a sample embodiment, a central station may include a plurality of betting-type game devices and an electronic camera for each game device. A plurality of player stations, remotely located with respect to the central station, may each include a monitor for displaying a selected game device at the central station, and input means for selecting a game device and for placing a bet by a player at the player's station relating to an action involving an element of chance to occur at the selected game device. Further details on gambling systems and methods for remotely-located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference.

FIG. 1 is a perspective side view of an embodiment of a roulette table 100 configured for implementation of embodiments of wagering games in accordance with the present disclosure. The table 100 may include a playing surface 102, which may be, for example, a felt layout or an electronic display. The table 100 may further include a physical roulette wheel 104 proximate to, and in some embodiments supported by, the playing surface 102. The physical roulette wheel 104 may be utilized as a random outcome generation apparatus in administering embodiments of the methods of the present disclosure.

The table 100 may include a video display 130 configured to display game information, such as, for example, the information described subsequently in connection with FIG. 2, and any other information considered useful to the players, including acceptance of wagers, game outcomes, wager outcomes, payout multipliers, historical game outcome data, and other information, in real-time.

In some embodiments, the playing surface 102 may include an electronic bet sensor to electronically recognize the placement of a specific type of chip (e.g., bonus wager or conventional roulette wager) of a fixed denomination. In some embodiments, the electronic bet sensor may also be configured to determine the denomination of the chip. In still other embodiments, the electronic bet sensor may be able to detect one or more denominations of a plurality of stacked chips included in the wager. In some embodiments, the wager can be any size within house limits.

The table 100 may include features for at least partially automating administration of a wagering game using the table 100. For example, the table 100 may include a croupier interface 118, which may enable an in-person administrator (e.g., a croupier) to initiate automated administration of certain actions and to personally perform other actions associated with administering a wagering game. The croupier interface 118 may include, for example, a croupier chip tray 120, which may be configured to support house chips, to which lost wagers may be added, and from which payouts may be paid. The croupier interface 118 may include a player authenticator 174 (e.g., a magnetic strip reader for cards carrying player information encoded on a magnetic strip), which may be configured to verify the identity of a player and grant access to a player account for the purpose of paying payouts, granting complimentary items and services (i.e., "comps") to players, redeeming chips for monetary value and vice versa, or performing other actions requiring a player's verified identity. The croupier interface 118 may include game initiation and control devices, such as, for example, buttons 176 and touchscreens 178, which may be configured to initiate random game events (e.g., random payout multiplier selection), verify authorization for large payout awards, enter wagering or outcome information for the purpose of game tracking, activating and deactivating automated portions of game administration (e.g., turning the table 100 and associated components on and off), and performing other actions to initiate and control the automatic administration of the wagering game.

The table 100 may include at least one processor 180, which may be associated, for example, with the video display 130 (e.g., processor 180A), with the table 100 itself (e.g., processor 180B), or with the touchscreen 178 (e.g., processor 180C) of the croupier interface 118. The one or more processors 180 may access game rules and game assets (e.g., videos, images, and text) stored in at least one non-transitory memory 190, which may similarly be associated, for example, with the video display 130 (e.g., memory 190A), with the table 100 itself (e.g., memory 190B), or with the touchscreen 178 (e.g., memory 190C) of the croupier interface 118. For example, the one or more processors 180 may randomly select a payout multiplier, interpret a random game outcome, declare winning wager conditions, and control display of information on the video display 130.

At least some of the actions performed in connection with administering a wagering game using the table 100 may be accomplished by an in-person administrator (e.g., a croupier). For example, wagers may be accepted by a croupier permitting a player to place a chip in a designated area on the playing surface 102, roulette outcomes may be randomly generated by the dealer introducing an indicator (e.g., a ball) into the spinning physical roulette wheel 104 (e.g., using a ball launching system 600 (FIGS. 6 through 12)) and permitting it to come to rest on a space defined by the physical roulette wheel 104, and payouts may be paid by the croupier giving chips from the croupier chip tray 120 to a player, for example, by placing them on the playing surface 102 proximate the player. In accordance with one or more embodiments, a ball launching device (e.g., the ball launching system 600 (FIGS. 6 through 12)) may be used to introduce one or more balls into the spinning physical roulette wheel 104, as further described below. Other actions performed in connection with administering a wagering game using the table 100 may be accomplished automatically by one or more processors 180, which may occur in response to croupier input or may occur automatically in response to other game events. For example, one or more processors 180 may automatically interpret a random game outcome (e.g., using sensors in the physical roulette wheel 104 or using imaging sensors configured to capture information from the physical roulette wheel 104), and may apply game rules and display all winning game conditions associated with the random game outcomes on the video display 130.

Figure 2:
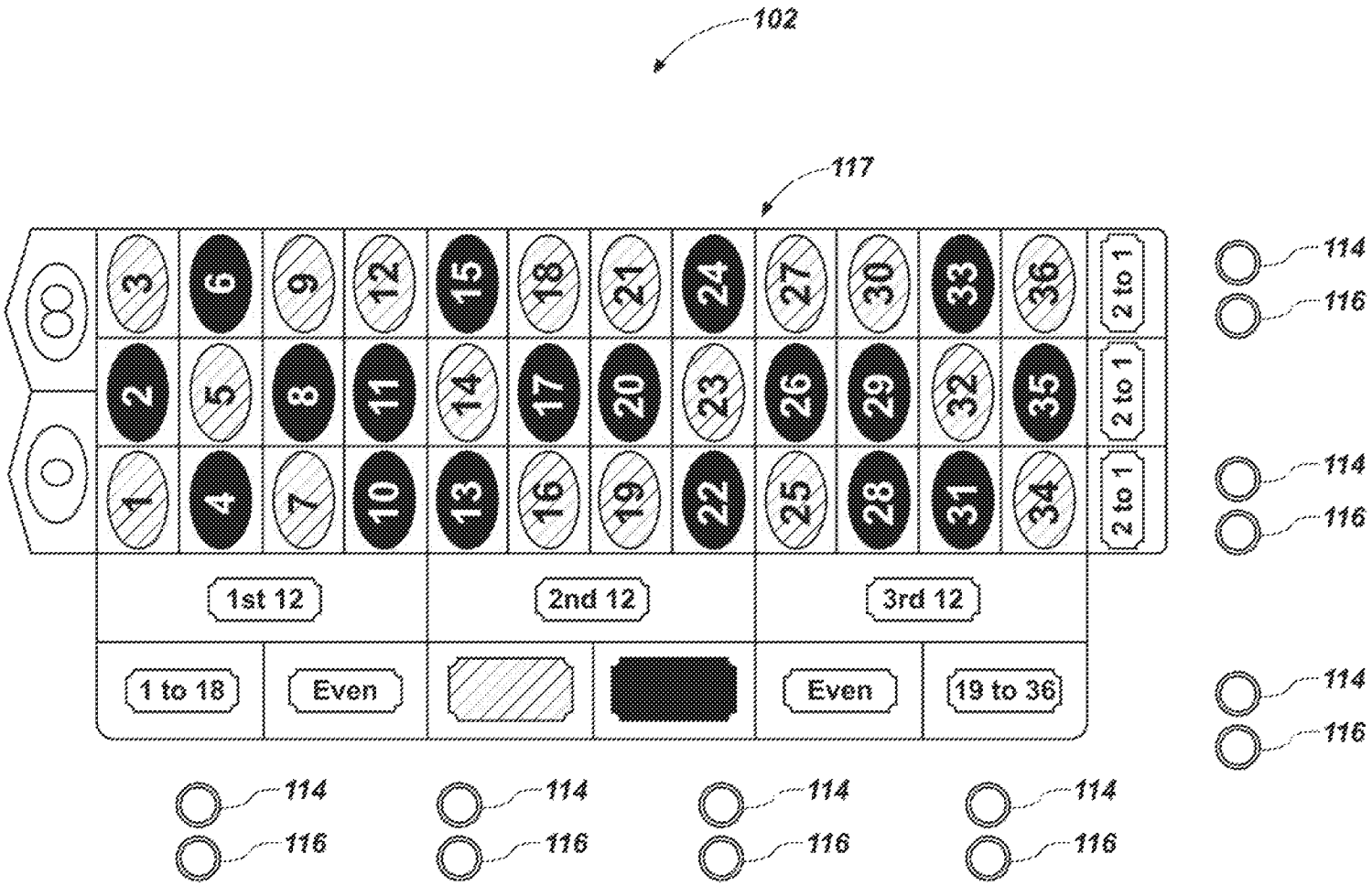
FIG. 2 is a diagram of an exemplary playing surface for implementation of a method of administering a roulette game, according to an embodiment of the present disclosure.

FIG. 2 is a diagram of an exemplary playing surface (e.g., the playing surface 102) for implementing wagering games within the scope of this disclosure. Such an implementation may be, for example, a felt layout on a physical gaming table or an electronic representation on an electronic display. The playing surface 102 may also include roulette wager areas 114, 116 at multiple player positions from which wagering elements associated with conventional roulette wagering may be retrieved.

The playing surface 102 may further include a wagering area 117, in which conventional roulette wagers, and any other wagers may be accepted. The wagering area 117 may be the same as or similar to wagering areas described in U.S. patent application Ser. No. 13/631,598, filed Sep. 28, 2012, for "SYSTEMS, METHODS, AND DEVICES FOR DISPLAYING HISTORICAL ROULETTE INFORMATION." Briefly, the wagering area 117 may be configured for acceptance of bonus, odds, evens, red, black, split, box, specific number and color, and other roulette bets, wherein the receipt of a wagering element within a specific area, on a border between areas, or at an intersection among areas may reflect receipt of a predicted roulette outcome or a predicted characteristic of a roulette outcome. In some embodiments, the playing surface 102 may include an area for electronically showing the outcome of randomly generated roulette outcomes or a roulette wheel into which a ball may be introduced to randomly generate a roulette outcome.

Figure 3:
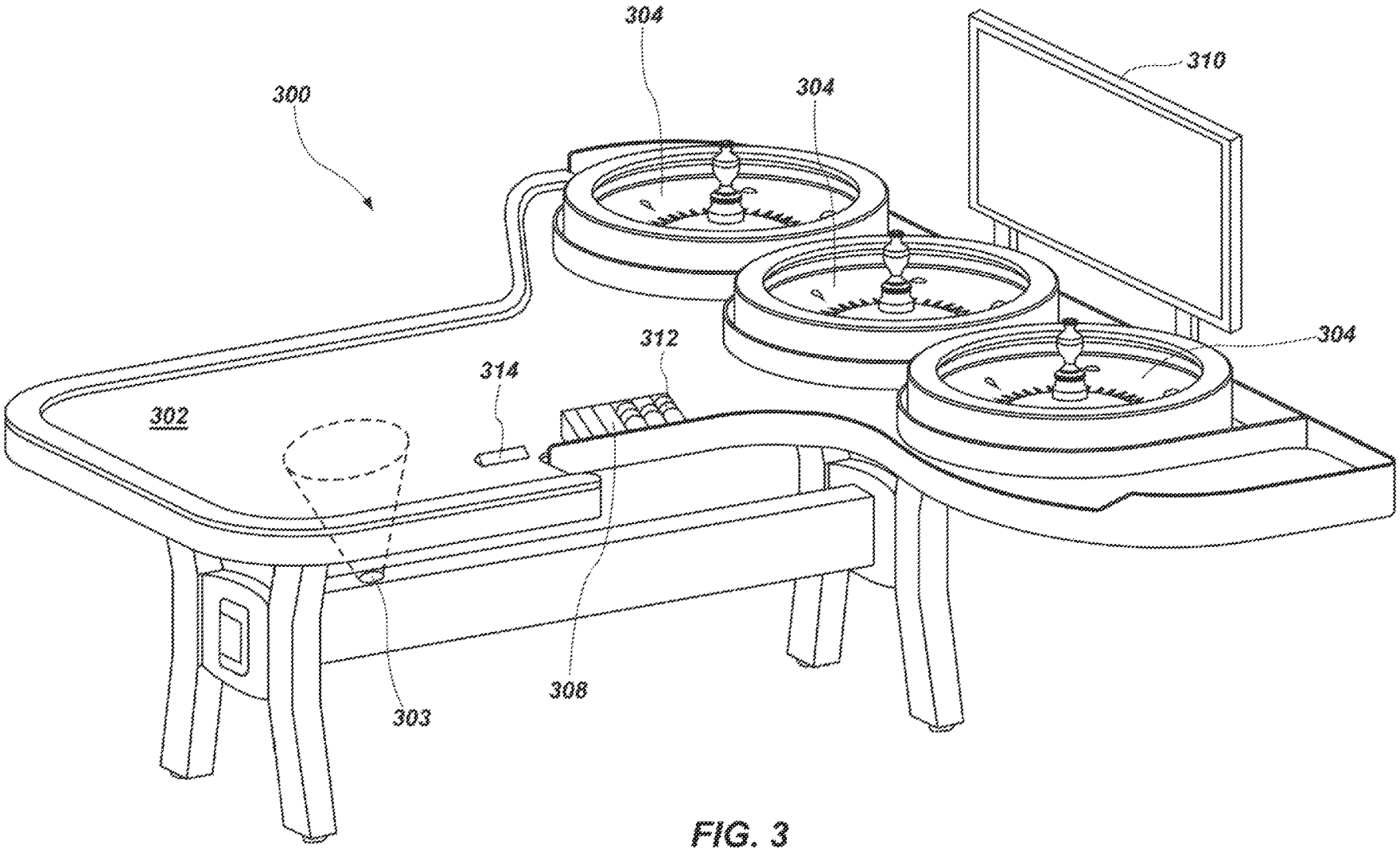
FIG. 3 is a perspective view of an exemplary multi-wheel roulette table that may be utilized to administer a roulette game in accordance with the present disclosure.
Figure 14:
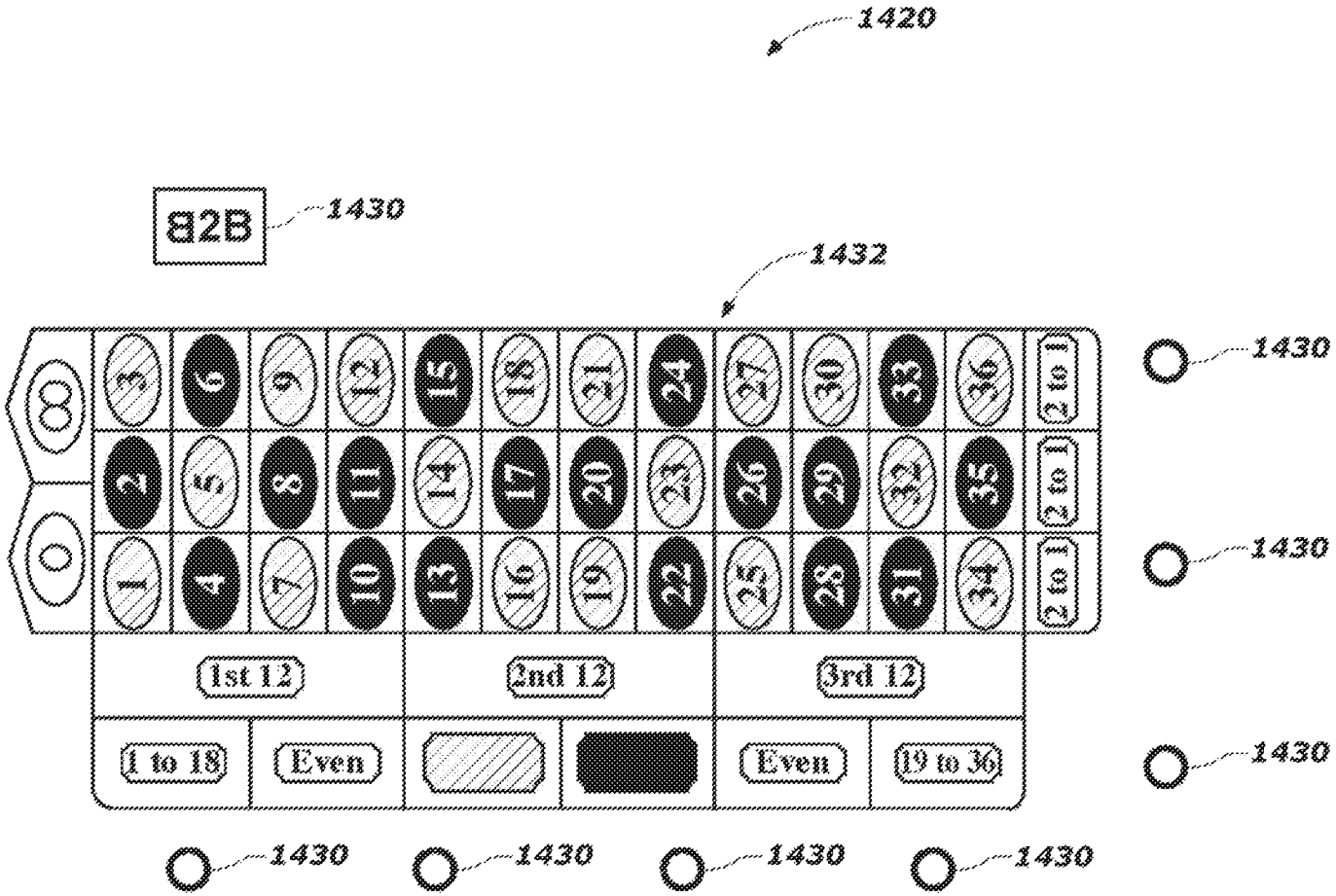
FIG. 14 is a diagram of a playing surface for implementation of a method of administering a wagering game, according to an embodiment of the present disclosure.

FIG. 3 is a perspective view of an embodiment of a gaming table 300 for implementing wagering games in accordance with this disclosure. The gaming table 300 may be a physical article of furniture around which participants in the wagering game may stand or sit and on which the physical objects used for administering and otherwise participating in the wagering game may be supported, positioned, moved, transferred, and otherwise manipulated. For example, the gaming table 300 may include a gaming surface 302 on which the physical objects used in administering the wagering game may be located. The gaming surface 302 may be, for example, a felt fabric covering a hard surface of the table 300, and a design, conventionally referred to as a "layout," specific to the game being administered may be physically printed on the gaming surface 302. As another example, the gaming surface 302 may be a surface of a transparent or translucent material (e.g., glass or plexiglass) onto which a projector 303, which may be located, for example, above or below the gaming surface 302, may illuminate a layout specific to the wagering game being administered. In such an example, the specific layout projected onto the gaming surface 302 may be changeable, enabling the gaming table 300 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 302 may include, for example, designated areas for player positions; areas in which wagering elements of specific types may be stored; areas in which wagers may be accepted; areas in which wagers may be grouped into pots; and areas in which rules, paytables, and other instructions related to the wagering game may be displayed. As a specific, nonlimiting example, the gaming surface 302 may be configured as shown in FIG. 2 or FIG. 14.

In some embodiments, the gaming table 300 may include a display 310 separate from the gaming surface 302. The display 310 may be configured to face players, prospective players, and spectators and may display, for example, rules, paytables, real-time game status, such as wagers accepted and cards dealt, historical game information, such as amounts won, amounts wagered, percentage of hands won, and notable hands achieved, and other instructions and information related to the wagering game. The display 310 may be a physically fixed display, such as a poster, in some embodiments. In other embodiments, the display 310 may change automatically in response to a stimulus (e.g., may be an electronic video monitor).

The gaming table 300 may include particular machines and apparatuses configured to facilitate the administration of the wagering game. For example, the gaming table 300 may include one or more physical roulette wheels 304. More specifically, the gaming table 300 may include three separate roulette wheels 304, which may generate independently randomized roulette outcomes. The roulette wheels 304 may be utilized as random outcome generation apparatus in administering embodiments of the methods of the present disclosure. The roulette wheels 304 may include, for example, a spinning, recessed surface and a series of numbered and colored pockets into which an outcome identifier (e.g., a ball) may come to rest. The outcome identifiers may be manually introduced into the roulette wheels 304 by a croupier or may be automatically introduced into the roulette wheels 304 by identifier introduction mechanisms. The roulette wheels 304 may simply be supported on the gaming surface 302 in some embodiments. In other embodiments, the roulette wheels 304 may be mounted into the gaming surface 302 such that the roulette wheels 304 are not manually removable from the gaming surface 302 without the use of tools.

The gaming table 300 may include one or more chip racks 308 configured to facilitate accepting wagers, transferring lost wagers to the house, and exchanging monetary value for wagering elements 312 (e.g., chips). For example, the chip rack 308 may include a series of token support rows, each of which may support tokens of a different type (e.g., color and denomination). In some embodiments, the chip rack 308 may be configured to automatically present a selected number of chips using a chip-cutting-and-delivery mechanism. Additional details of an illustrative chip rack 308 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 300 may include a drop box 314 for money that is accepted in exchange for wagering elements 312. The drop box 314 may be, for example, a secure container (e.g., a safe or lockbox) having a one-way opening into which money may be inserted and a secure, lockable opening from which money may be retrieved. Such drop boxes 314 are known in the art, and may be incorporated directly into the gaming table 300 and may, in some embodiments, have a removable container for the retrieval of money in a separate, secure location.

When administering a wagering game in accordance with embodiments of this disclosure, a croupier may receive money (e.g., cash) from a player in exchange for wagering elements 312. The croupier may deposit the money in the drop box 314 and transfer physical wagering elements 312 to the player. The croupier may accept one or more initial wagers (e.g., antes and other wagers) from the player, which may be reflected by the croupier permitting the player to place one or more wagering elements 312 or other wagering tokens (e.g., cash) within designated areas on the gaming surface 302 associated with the various wagers of the wagering game. Once all wagers have been accepted, outcome identifiers may be introduced into the roulette wheels 304 and permitted to come to rest on three individually randomized roulette outcomes.

Finally, the croupier may resolve the wagers, award payouts to the players, which may be accomplished by giving wagering elements 312 from the chip rack 308 to the players, resetting progressive wagers, which may be accomplished by transferring wagering elements designated for placing the progressive wagers to players or transferring them to the chip rack 308, and transferring losing, nonprogressive wagers to the house, which may be accomplished by moving wagering elements 312 from the gaming surface 302 to the chip rack 308.

Figure 4:
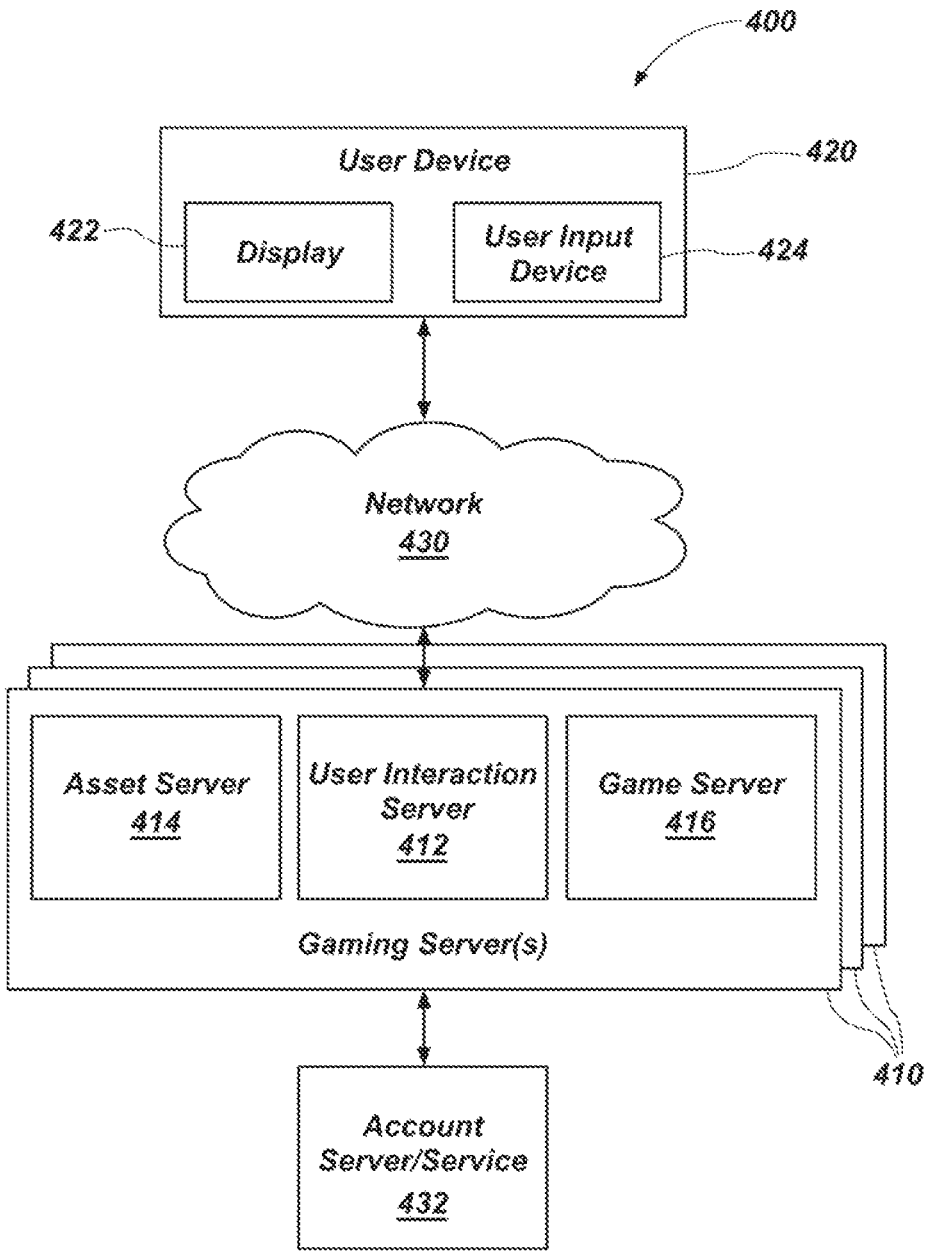
FIG. 4 is a schematic block diagram of a gaming system for implementing embodiments of roulette games in accordance with the present disclosure.

In some embodiments, wagering games in accordance with this disclosure may be administered using a gaming system employing a client-server architecture (e.g., over the Internet, a local area network, etc.). FIG. 4 is a schematic block diagram of an illustrative gaming system 400 for implementing wagering games according to this disclosure. The gaming system 400 may enable end users to remotely access game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. § 2701 et seq. ("Indian Gaming Regulatory Act"). Such games may include banked and/or non-banked games.

The wagering games supported by the gaming system 400 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 400 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 400 may include a gaming platform to establish a portal for an end user to access a wagering game hosted by one or more gaming servers 410 over a network 430. In some embodiments, games are accessed through a user interaction service 412. The gaming system 400 enables players to interact with a user device 420 through a user input device 424 and a display 422 and to communicate with one or more gaming servers 410 using a network 430 (e.g., the Internet). Typically, the user device 420 is remote from the gaming server 410 and the network 430 is the word-wide web (i.e., the Internet).

In some embodiments, the gaming servers 410 may be configured as a single server to administer wagering games in combination with the user device 420. In other embodiments, the gaming servers 410 may be configured as separate servers for performing separate, dedicated functions associated with administering wagering games. Accordingly, the following description also discusses "services" with the understanding that the various services may be performed by different servers or combinations of servers in different embodiments. As shown in FIG. 4, the gaming servers 410 may include a user interaction service 412, a game service 416, and an asset service 414. In some embodiments, one or more of the gaming servers 410 may communicate with an account server 432 performing an account service 432. As explained more fully below, for some wagering type games, the account service 432 may be separate and operated by a different entity than the gaming servers 410; however, in some embodiments the account service 432 may also be operated by one or more of the gaming servers 410.

The user device 420 may communicate with the user interaction service 412 through the network 430. The user interaction service 412 may communicate with the game service 416 and provide game information to the user device 420. In some embodiments, the game service 416 may also include a game engine. The game engine may, for example, access, interpret, and apply game rules. In some embodiments, a single user device 420 communicates with a game provided by the game service 416, while other embodiments may include a plurality of user devices 420 configured to communicate and provide end users with access to the same game provided by the game service 416. In addition, a plurality of end users may be permitted to access a single user interaction service 412, or a plurality of user interaction services 412, to access the game service 416. The user interaction service 412 may enable a user to create and access a user account and interact with game service 416. The user interaction service 412 may enable users to initiate new games, join existing games, and interface with games being played by the user.

The user interaction service 412 may also provide a client for execution on the user device 420 for accessing the gaming servers 410. The client provided by the gaming servers 410 for execution on the user device 420 may be any of a variety of implementations depending on the user device 420 and method of communication with the gaming servers 410. In one embodiment, the user device 420 may connect to the gaming servers 410 using a web browser, and the client may execute within a browser window or frame of the web browser. In another embodiment, the client may be a stand-alone executable on the user device 420.

For example, the client may comprise a relatively small amount of script (e.g., JAVASCRIPT®), also referred to as a "script driver," including scripting language that controls an interface of the client. The script driver may include simple function calls requesting information from the gaming servers 410. In other words, the script driver stored in the client may merely include calls to functions that are externally defined by, and executed by, the gaming servers 410. As a result, the client may be characterized as a "thin client." The client may simply send requests to the gaming servers 410 rather than performing logic itself. The client may receive player inputs, and the player inputs may be passed to the gaming servers 410 for processing and executing the wagering game. In some embodiments, this may involve providing specific graphical display information for the display 422 as well as game outcomes.

As another example, the client may comprise an executable file rather than a script. The client may do more local processing than does a script driver, such as calculating where to show what game symbols upon receiving a game outcome from the game service 416 through user interaction service 412. In some embodiments, portions of an asset service 414 may be loaded onto the client and may be used by the client in processing and updating graphical displays. Some form of data protection, such as end-to-end encryption, may be used when data is transported over the network 430. The network 430 may be any network, such as, for example, the Internet or a local area network.

The gaming servers 410 may include an asset service 414, which may host various media assets (e.g., text, audio, video, and image files) to send to the user device 420 for presenting the various wagering games to the end user. In other words, the assets presented to the end user may be stored separately from the user device 420. For example, the user device 420 requests the assets appropriate for the game played by the user; as another example, especially relating to thin clients, just those assets that are needed for a particular display event will be sent by the gaming servers 410, including as few as one asset. The user device 420 may call a function defined at the user interaction service 412 or asset service 414, which may determine which assets are to be delivered to the user device 420 as well as how the assets are to be presented by the user device 420 to the end user. Different assets may correspond to the various user devices 420 and their clients that may have access to the game service 416 and to different variations of wagering games.

The gaming servers 410 may include the game service 416, which may be programmed to administer wagering games and determine game play outcomes to provide to the user interaction service 412 for transmission to the user device 420. For example, the game service 416 may include game rules for one or more wagering games, such that the game service 416 controls some or all of the game flow for a selected wagering game as well as the determined game outcomes. The game service 416 may include paytables and other game logic. The game service 416 may perform random number generation for determining random game elements of the wagering game. In one embodiment, the game service 416 may be separated from the user interaction service 412 by a firewall or other method of preventing unauthorized access to the game service 412 by the general members of the network 430.

The user device 420 may present a gaming interface to the player and communicate the user interaction from the user input device 424 to the gaming servers 410. The user device 420 may be any electronic system capable of displaying gaming information, receiving user input, and communicating the user input to the gaming servers 410. For example, the user device 420 may be a desktop computer, a laptop, a tablet computer, a set-top box, a mobile device (e.g., a smartphone), a kiosk, a terminal, or another computing device. As a specific, nonlimiting example, the user device 420 operating the client may be an interactive electronic gaming system. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 410. The client may be illustrated within a casino webpage (or other interface) indicating that the client is embedded into a webpage, which is supported by a web browser executing on the user device 420.

In some embodiments, components of the gaming system 400 may be operated by different entities. For example, the user device 420 may be operated by a third party, such as a casino or an individual, that links to the gaming servers 410, which may be operated, for example, by a wagering game service provider. Therefore, in some embodiments, the user device 420 and client may be operated by a different administrator than the operator of the game service 416. In other words, the user device 420 may be part of a third-party system that does not administer or otherwise control the gaming servers 410. In other embodiments, the user interaction service 412 and asset service 414 may be operated by a third-party system. For example, a gaming entity (e.g., a casino) may operate the user interaction service 412, user device 420, or combination thereof to provide its customers access to game content managed by a different entity that may control the game service 416, amongst other functionality. In still other embodiments, all functions may be operated by the same administrator. For example, a gaming entity (e.g., a casino) may elect to perform each of these functions in-house, such as providing access to the user device 420, delivering the actual game content, and administering the gaming system 400.

The gaming servers 410 may communicate with one or more external account servers 432 (also referred to herein as an account service 432), optionally through another firewall. For example, the gaming servers 410 may not directly accept wagers or issue payouts. That is, the gaming servers 410 may facilitate online casino gaming but may not be part of a self-contained online casino itself. Another entity (e.g., a casino or any account holder or financial system of record) may operate and maintain its external account service 432 to accept bets and make payout distributions. The gaming servers 410 may communicate with the account service 432 to verify the existence of funds for wagering and to instruct the account service 432 to execute debits and credits. As another example, the gaming servers 410 may directly accept bets and make payout distributions, such as in the case where an administrator of the gaming servers 410 operates as a casino.

Additional features may be supported by the gaming servers 410, such as hacking and cheating detection, data storage and archival, metrics generation, messages generation, output formatting for different end user devices, as well as other features and operations. For example, the gaming servers 410 may include additional features and configurations as described in U.S. patent application Ser. No. 13/353,194, filed Jan. 18, 2012, now U.S. Pat. No. 9,120,007 issued Sep. 1, 2015, and U.S. patent application Ser. No. 13/609,031, filed Sep. 10, 2012, now U.S. Pat. No. 8,974,305, issued Mar. 10, 2015, both titled "NETWORK GAMING ARCHITECTURE, GAMING SYSTEMS, AND RELATED METHODS," the disclosure of each of which is incorporated herein in its entirety by this reference.

Figure 5:
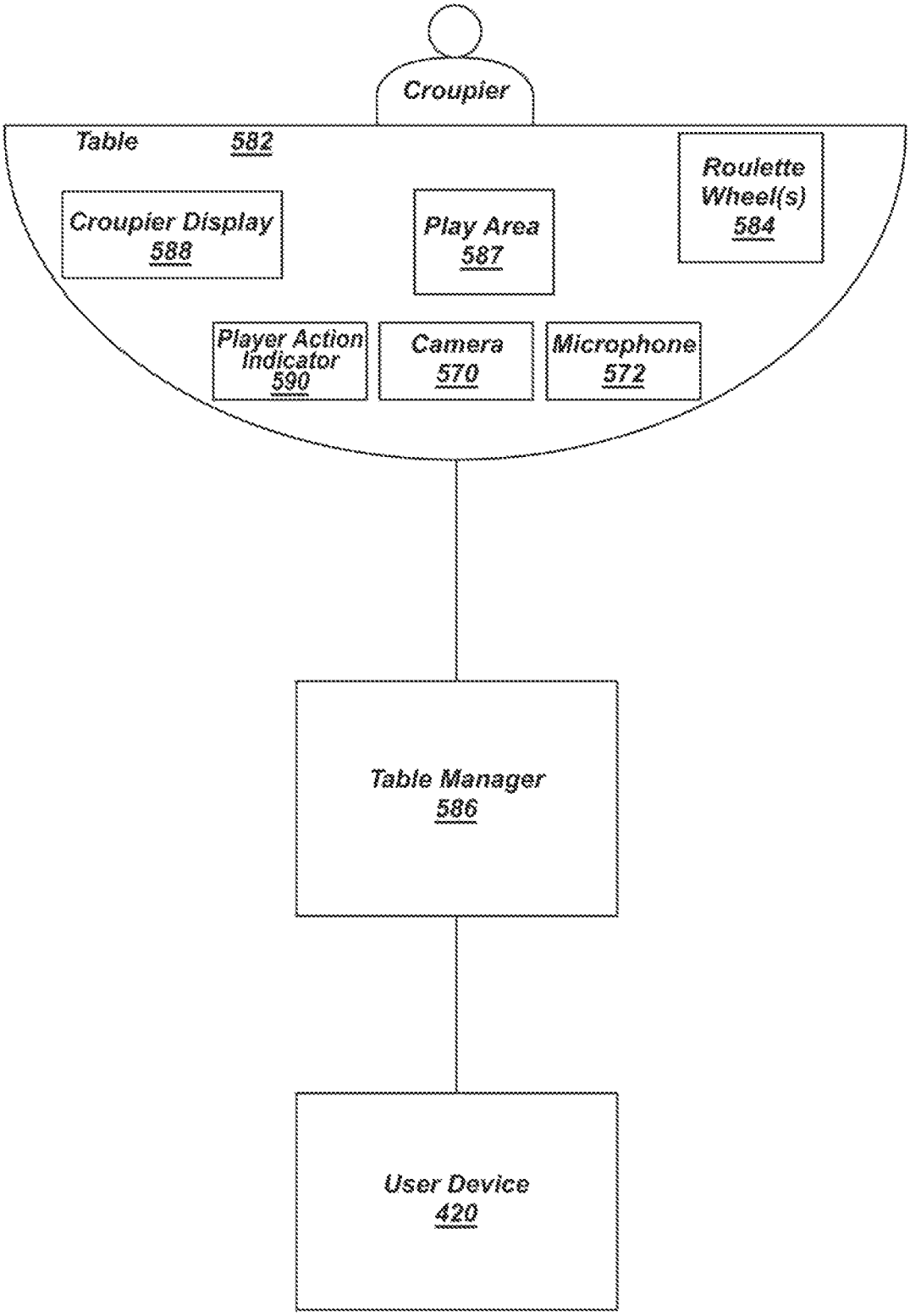
FIG. 5 is a schematic block diagram of a gaming system for implementing embodiments of wagering games in accordance with the present disclosure, wherein the implementation includes a live croupier feed.

FIG. 5 is a schematic block diagram of an exemplary system for implementing wagering games including a live croupier feed. Features of the gaming system 400 described above in connection with FIG. 4 may be utilized in connection with this embodiment, except as further described. Rather than roulette outcomes being generated by a computerized random processes, a physical outcome identifier or identifiers (e.g., balls or marbles) may be introduced into one or more corresponding physical roulette wheels 584 by a live croupier at a table 582. The physical roulette wheels 584 may be utilized as random outcome generation apparatus in administering embodiments of the methods of the present disclosure. A table manager 586 may assist the croupier in facilitating play of the game by transmitting a video feed of the croupier's actions to the user device 420 and transmitting player elections to the croupier. As described above, the table manager 586 may act as or communicate with a gaming system 400 (see FIG. 4) (e.g., acting as the gaming system 400 (see FIG. 4)) itself or as an intermediate client interposed between and operationally connected to the user device 420 and the gaming system 400 (see FIG. 4)) to provide gaming at the table 582 to users of the gaming system 400 (see FIG. 4). Thus, the table manager 586 may communicate with the user device 420 through a network 430 (see FIG. 4) and may be a part of a larger online casino, or the table manager 586 may be operated as a separate system facilitating game play. In various embodiments, each table 582 may be managed by an individual table manager 586 constituting a gaming device, which may receive and process information relating to that table. For simplicity of description, these functions are described as being performed by the table manager 586, though certain functions may be performed by an intermediary gaming system 400 (see FIG. 4), such as the one shown and described in connection with FIG. 4. In some embodiments, the gaming system 400 (see FIG. 4) may match remotely located players to tables 582 and facilitate transfer of information between user devices 420 and tables 582, such as wagering amounts and player option elections, without managing gameplay at individual tables. In other embodiments, functions of the table manager 586 may be incorporated into a gaming system 400 (see FIG. 4).

The table 582 includes a camera 570 and optionally a microphone 572 to capture video and audio feeds relating to the table 582. The camera 570 may be trained on the croupier, play area 587 and roulette wheel or wheels 584. As the game is administered by the croupier, the video feed captured by the camera 570 may be shown to the player using the user device 420, and any audio captured by the microphone 572 may be played to the player using the user device 420. In some embodiments, the user device 420 may also include a camera, microphone, or both, which may also capture feeds to be shared with the croupier and other players. In some embodiments, the camera 570 may be trained to capture images of the roulette outcomes, chips, and chip stacks on the surface of the gaming table 582. Known image extraction techniques may be used to obtain roulette outcome from the images of the roulette wheel or wheels 584. An example of suitable image extraction software is disclosed in U.S. Pat. No. 7,901,285, issued Mar. 8, 2011, to Tran et al., the disclosure of which is incorporated in this disclosure in its entirety by this reference.

Roulette outcome data in some embodiments may be used by the table manager 586 to determine game outcome. The data extracted from the camera 570 may be used to confirm roulette outcome data obtained from the roulette wheel or wheels 584 (e.g., using sensors) and for general security monitoring purposes, such as detecting player or croupier outcome or wager manipulation, for example. Examples of roulette outcome data include, for example, number and color information of a roulette outcome and number and color information of each roulette outcome in a set of roulette outcomes (e.g., three roulette outcomes from the same round of play).

The live video feed permits the croupier to use one or more physical roulette wheels 584, to physically generate one or more randomized roulette outcomes, and to play the game as though the player were at a live casino. In addition, the croupier can prompt a user by announcing a player's election is to be performed. In embodiments in which a microphone 572 is included, the croupier can verbally announce action or request an election by a player. In some embodiments, the user device 420 also includes a camera or microphone, which also captures feeds to be shared with the croupier and other players.

Player elections may be transmitted to the table manager 586, which may display player elections to the croupier using a croupier display 588 and player action indicator 590 on the table 582. For example, the croupier display 588 may display information regarding when to close betting, when to introduce an outcome identifier into a physical, spinning roulette wheel 584, or which player position is responsible for the next action.

In some embodiments, the table manager 586 may receive roulette outcome information from each roulette wheel 584. For example, the roulette wheel or wheels 584 may include sensors to detect specific spaces on the roulette wheel and which space an outcome identifier is positioned on. In some embodiments, the table manager 586 may generate roulette outcome information (e.g., alone or in addition to the information received from one or more roulette wheels 584).

The table manager 586 may apply game rules to the roulette outcome information, along with the accepted player decisions, to determine gameplay events and wager results. Alternatively, the wager results may be determined by the croupier and input to the table manager 586, which may be used to confirm automatically determined results by the gaming system.

Roulette outcome data in some embodiments may be used by the table manager 586 to determine game outcome. The data extracted from the camera 570 may be used to confirm the data obtained from the roulette wheel or wheels 584 and for general security monitoring purposes, such as detecting player or croupier outcome or wager manipulation, for example.

Figure 6:
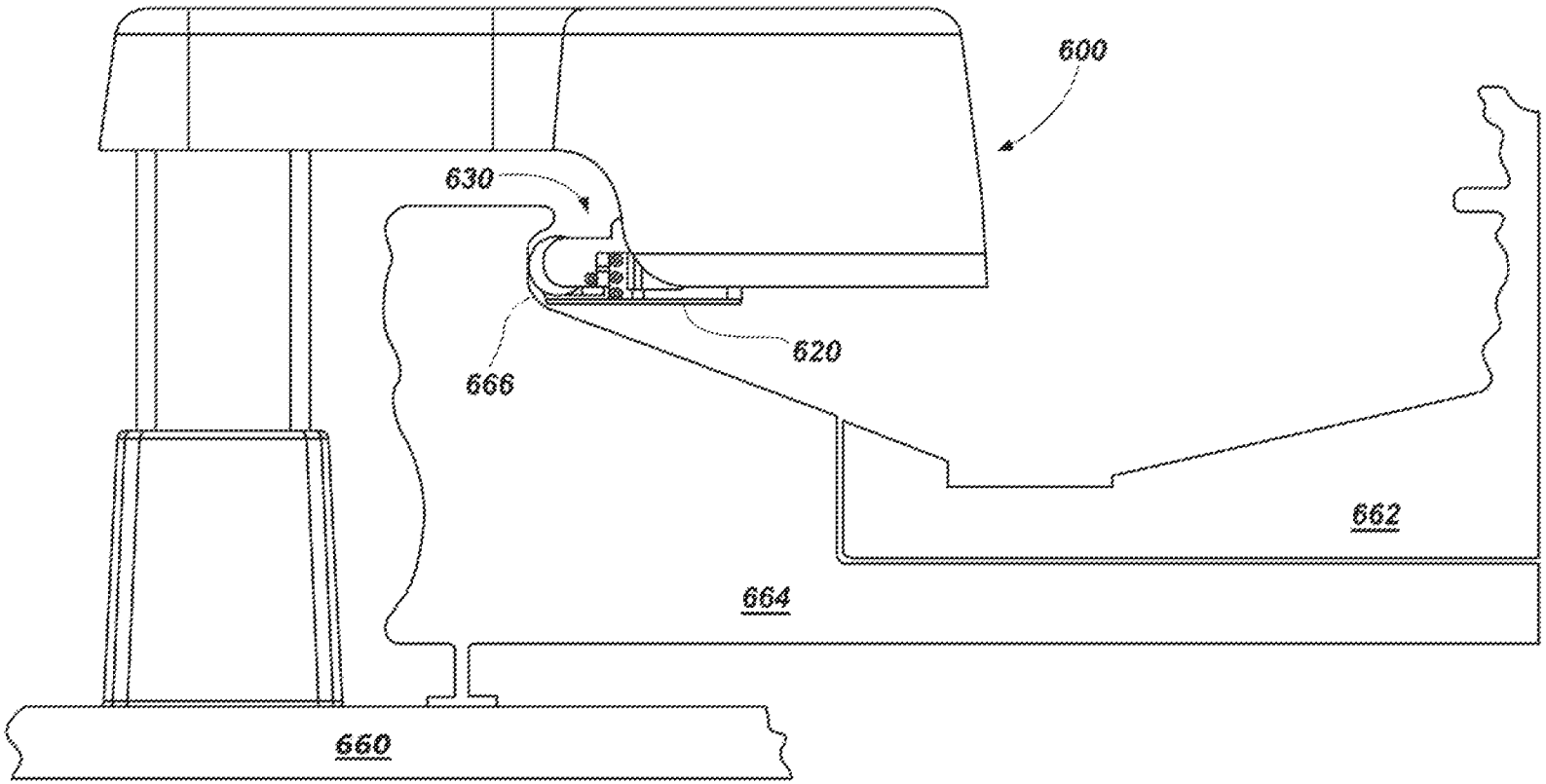
FIG. 6 is a view of a roulette wheel with an embodiment of a ball launching system mounted thereon, which ball launching system may be utilized to administer a roulette game in accordance with the present disclosure.

FIG. 6 shows an embodiment of a ball launching system 600 positioned on a roulette table 660 (possibly similar to the table 100 or the multi-player table 300 in FIG. 1 or 3, respectively). As shown, the ball launching system 600 is mounted to the table surface proximal to a roulette wheel bowl 664. The ball launching system 600 is adjusted so that a ball cup assembly 630 can rotate to a position proximal to a ball track 666. The ball cup assembly 630 may have a retain mode, during which a roulette ball is captured between a first cup wall and a second cup wall, and a release mode, during which at least one of the first cup wall and the second cup wall moves to release the roulette ball from the ball cup assembly 630 into the ball track 666. In some instances, the first and second cup walls may be considered leading and trailing cup walls, with the leading and trailing designations being defined with respect to a direction of rotation of the rotor 620.

In one embodiment, the ball cup assembly 630 may be configured to receive a roulette ball when the rotor 620 is at a loading (or HOME) position. The rotor 620 may rotate from the loading position to a launch position with the ball cup assembly 630 in the retain mode. When the rotor 620 reaches the launch position, a launch actuator may cause the ball cup assembly 630 to switch from the retain mode to the release mode and release the roulette ball into the ball track 666. In an embodiment, the ball cup assembly 630 may include a rest mode in which the first and second cup walls are spaced apart further than the diameter of the roulette ball. In such an embodiment, the ball cup assembly 630 may switch from the rest mode to the retain mode after the rotor 620 begins to rotate.

An embodiment of the ball launching system 600 includes a driver that is configured to produce and impart rotary motion. Common examples of drivers are electric motors of different types and fluid-driven or electrically powered rotary actuators, some of which may convert linear motion into the needed rotary motion. Electric motors may include stepper motors, servo motors, synchronous, asynchronous, direct current and alternating current motors.

The ball launching system 600 may further include a rotor, such as the rotor 620, which is driven in rotation by the driver. The rotor 620 may be connected to a rotor shaft that is, in turn, driven by the driver. Alternatively, the rotor 620 and rotor shaft may be a single integral component.

A ball launching system may have a ball cup assembly, such as the ball cup assembly 630, which is mounted to the rotor 620 such that the roulette ball to be launched is rotated with the rotor 620 at a position offset from the rotor axis and launched tangentially from the ball cup assembly 630 into the ball track 666.

Figure 7:
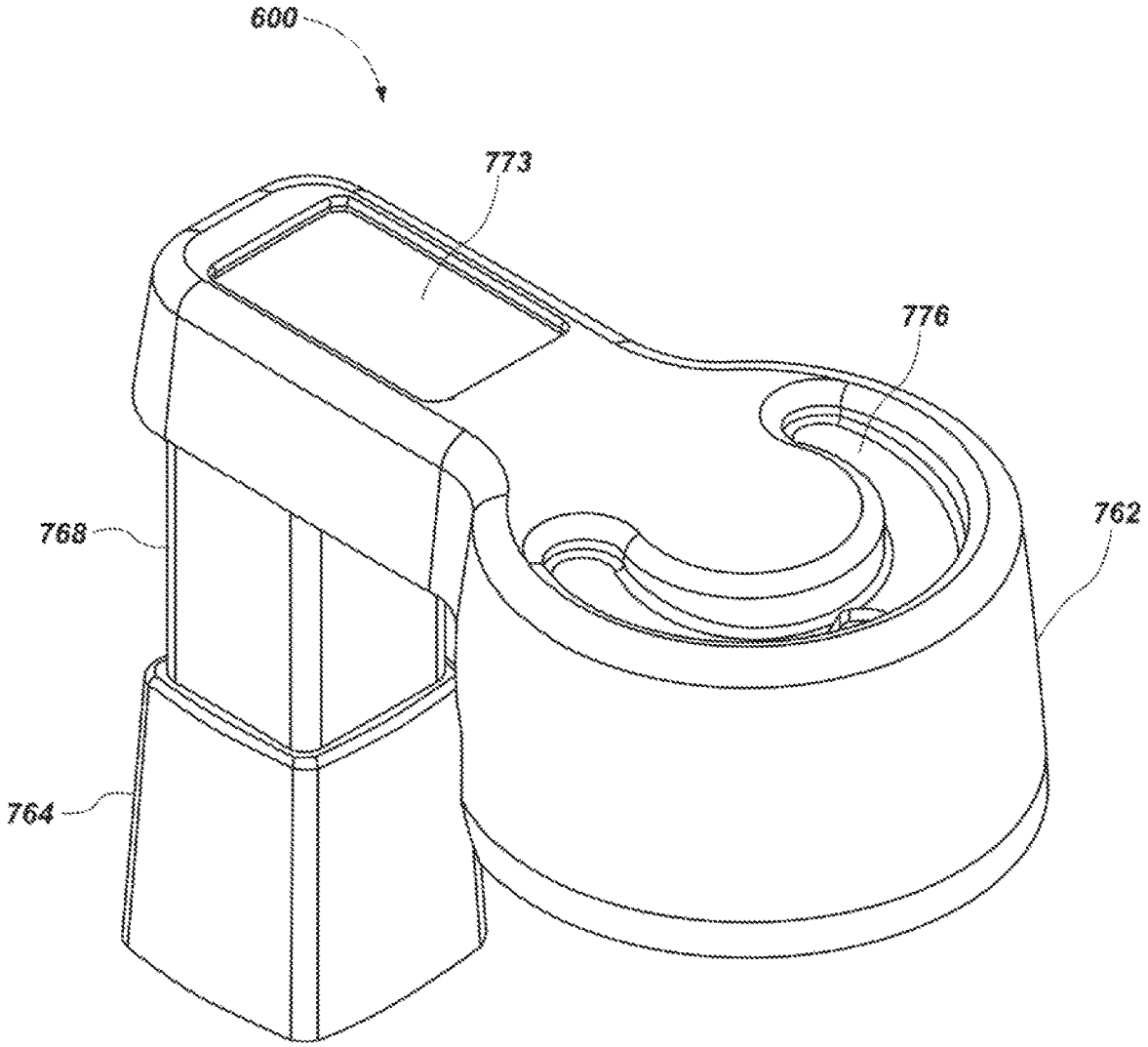
FIG. 7 is a perspective view of an embodiment of the ball launching system.

Such an exemplary ball launching system, which may be the ball launching system 600, is shown in FIG. 7. When installed, the launching system 600 may comprise a top cover 762, a support post 768, and a base cover 764. The top cover 762 may include a ball feeder 776 for holding additional roulette balls preparatory for loading into the launching system 600. Some embodiments may include an electronic display 773 for displaying launch system settings, game statistics, and game play information or non-game information.

Figure 8:
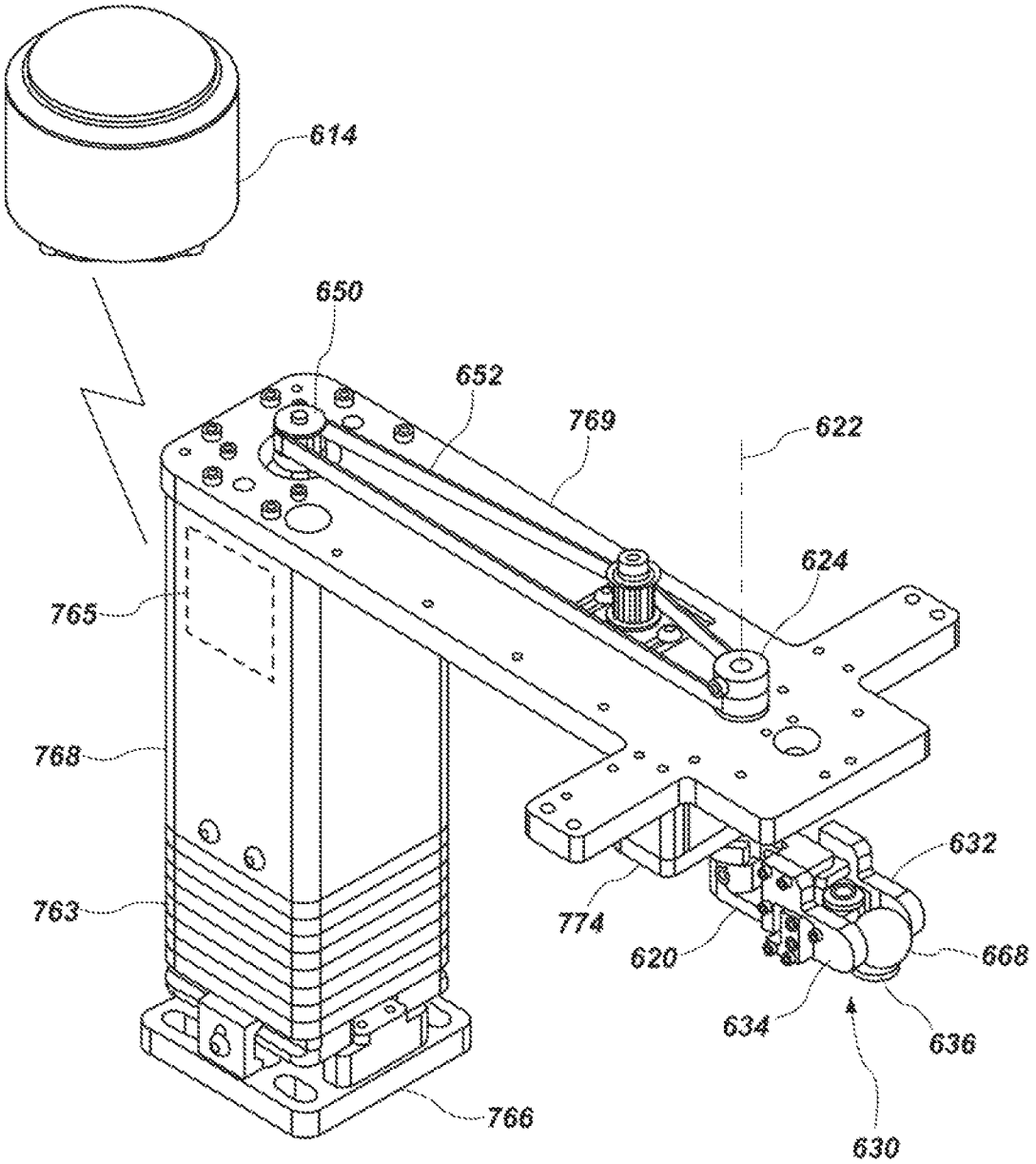
FIG. 8 is a perspective view of an embodiment of the ball launching system with protective covers removed.

FIG. 8 shows a ball launching system similar to the system 600 with exterior covers removed. As shown in FIG. 8, the ball cup assembly 630 is mounted to the rotor 620. The ball cup assembly 630 includes a first cup wall 632 and a second cup wall 634 spaced apart from each other above a cup floor 636. The cup floor 636 may support and position the roulette ball 668 prior to launch. The cup floor 636 is fixed to and moves with the rotor 620, however, in another embodiment, the cup floor 636 may be separate from the rotor 620 and may be fixed in place with respect to the rotating elements of the ball cup assembly 630, or may be eliminated altogether.

With the roulette ball 668 loaded into the ball cup assembly 630, one, the other, or both of the first and second cup walls 632, 634 may move to capture and grip the roulette ball 668 between the cup walls 632, 634, and hold the ball 668 in place prior to launch. In one embodiment, the first cup wall 632 may pivot towards the second cup wall 634 to capture the roulette ball 668 between the cup walls 632, 634. In another embodiment, either of the cup walls 632, 634 may move linearly towards and/or away from the other to facilitate gripping/releasing the roulette ball 668. Alternatively, various other movements of the cup walls 632, 634 and combinations thereof may be employed to grip and/or release the roulette ball 668. When captured between the cup walls 632, 634, the roulette ball 668 may lift off the cup floor 636 and be fully supported by the cup walls 632, 634. The cup walls 632, 634 may be contoured to facilitate capturing or releasing the roulette ball 668. The ball 668 may be loaded individually by a croupier in preparation for launching into the roulette bowl 664 (FIG. 6). Alternatively, the ball launching system 630 may include an automatic loader with multi-ball capacity that sequentially positions single balls into the ball cup.

Once loaded with the roulette ball 668, the ball launching system 600 (FIGS. 6 and 7) launches the ball 668 into the roulette bowl 664 (FIG. 6) by rotating the rotor 620 with the ball 668 captured in the ball cup assembly 630 and releasing the ball 668 at a point during the rotor's rotation. This point may be called the "launch angle." Optimally, the rotor 620 rotates in a plane defined by a perimeter of the ball track 666, although some deviation from the optimal rotation may be accommodated. In some embodiments, this limitation will result in a rotor axis being positioned substantially perpendicular to the plane defined by the perimeter of the ball track 666. Here and throughout, the modifying term "substantially" and other similar terms can be interpreted to mean "within readily recognized tolerances dependent on manufacturing methods, material consistency, assembly accuracy, and other minor deviations." After launching, the rotor 620 may rotate further to a home position in which the cup walls 632, 634, cup floor 636, and other outermost components of the ball cup assembly 630 are clear of the ball track 666. The ball launching system 600 may be anchored to a support surface (e.g., the gaming surface 102 (FIGS. 1 and 2), 302 (FIG. 3), roulette table 660 (FIG. 6)) with a fixed base 766. In an embodiment, the support post 768 is connected to the fixed base 766 and may be adjusted to a preferred height by stacking spacers 763 on the fixed base 766. Various other height adjustment means, methods and combinations thereof are envisioned by the invention and are considered within the spirit and scope of the invention. In an embodiment, a beam 769 extends outward from the post 768 so that the ball cup assembly 630 can be positioned inside the roulette wheel bowl 664 (FIG. 6). A static shelf 774, fixed below the beam 769, is provided for convenient mounting of some components of the ball launching system 600. Alternatively, the ball cup assembly 630 may be supported by a unitary support stand comprising a base, post, and beam.

A driver 650 may be embedded within the post 768 and connected to a rotor shaft 624 via a drive belt 652. The drive belt 652 is configured to transmit rotary motion from the driver 650 to the rotor shaft 624 and cause the rotor 620 to rotate the ball cup assembly 630. In another embodiment, a driver may be mounted on top of the beam 769 so that the axis of rotation of the driver is coaxially aligned with a rotor axis 622 of the rotor shaft 624. Various other configurations of a driver and the rotating components of the ball launching system 600 are readily envisioned and remain within the spirit and scope of the invention. For example, the driver may be connected to the rotor by a chain or gear train and still be within the scope of the invention.

The ball launching system 600 may incorporate a communication interface(s) to facilitate transmitting and/or receiving signals related to system operations. For example, the system 600 may include electronic circuitry 765, such as a wireless communications interface that receives signals from a remote signal button 614 to initiate a roulette ball launch. Wireless communication protocols, such as BLUETOOTH® and others, may be utilized for wireless communication. Various other wireless and wired remote signal initiators may be employed to initiate a ball launch. Additionally, a manual launch initiator, such as a physical switch or a touchscreen button may be provided proximal to the ball launching system 600.

Figure 9:
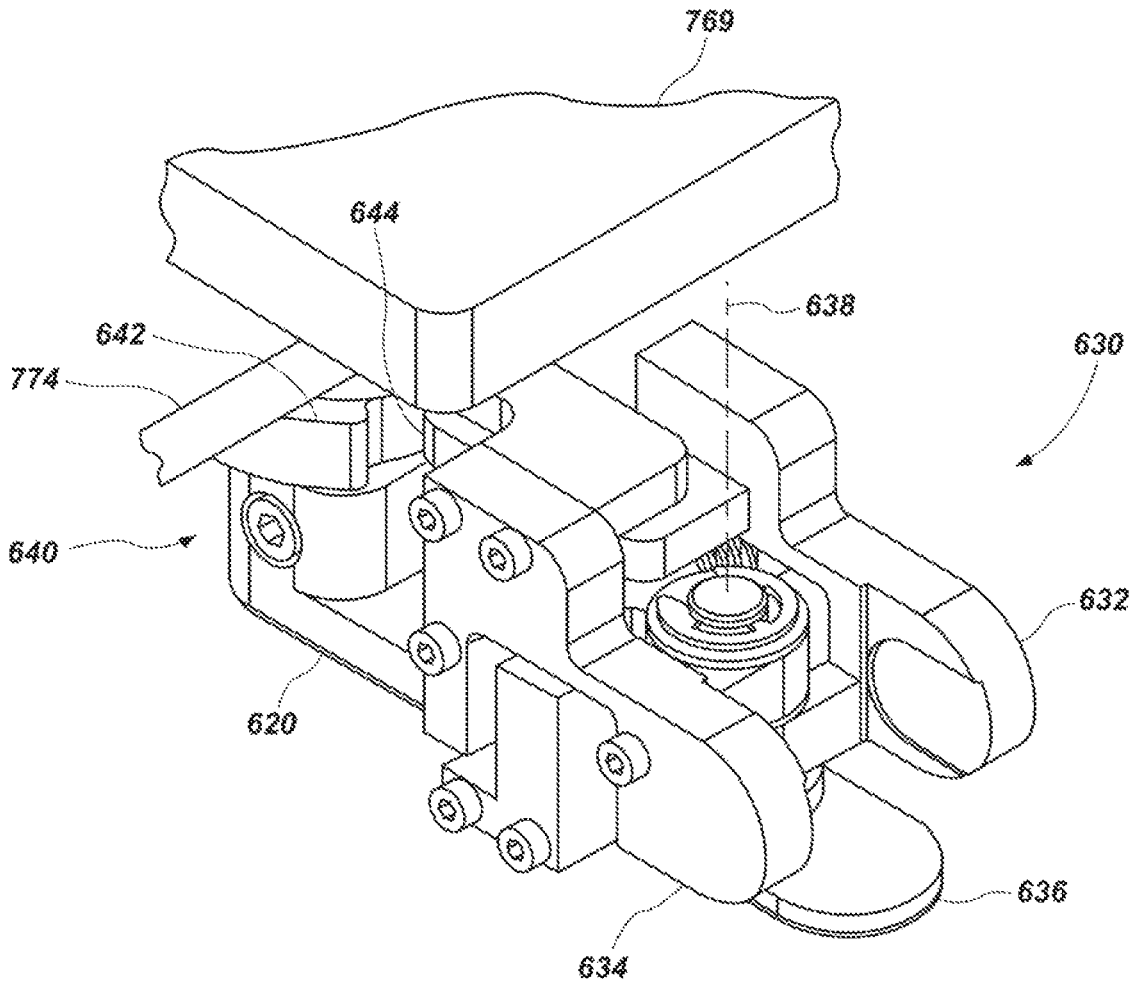
FIG. 9 is a perspective detail view of a ball cup assembly and rotor of an embodiment of the ball launching system.

FIG. 9 is a detail view of an embodiment of the ball cup assembly 630 mounted to the rotor 620 and illustrates various components of the ball cup assembly 630. In this embodiment, the first cup wall 632 and the second cup wall 634 are configured to pivot around a common pivot axis 638 when moving to grip the roulette ball 668 (FIG. 8) or to release the roulette ball 668. For example, the first and second cup walls 632, 634 may counter-rotate about the pivot axis 638 to grip and/or release the roulette ball 668. The cup floor 636 is fixed to the rotor 620 below the cup walls 632, 634. In an embodiment, the cup walls 632, 634 may be adapted or replaced to accommodate roulette balls with different diameters.

The first cup wall 632 and the second cup wall 634 pivot independently in response to a launch actuator, such as a launch actuator 640. In this embodiment, the launch actuator 640 comprises both static and dynamic elements that mechanically interact to track the rotation of the rotor 620 and to cause the necessary cup wall motions facilitating, for example, gripping and releasing the roulette ball 668. For example, a cam follower 644*a* (see also FIG. 10A) is connected to the first cup wall 632 and rotates with the rotor 620 around a static cam lobe 642*a* (see also FIG. 10A) that is mounted to the shelf 774. Another cam follower 644*b* is above the cam follower 644*a* and is positioned to interact with cam lobe 642*b*. When the cam follower 644*a* contacts the cam lobe 642*a*, the first cup wall 632 pivots around the pivot axis 638 as the cam follower 644*a* rides up onto the cam lobe 642*a*. Depending on the direction that the rotor 620 is rotating, the cam lobe 642/cam follower 644 interaction may cause the first cup wall 632 to pivot away from or towards the second cup wall 634, resulting in either gripping the roulette ball 668 between the first and second cup walls 632, 634 or releasing the roulette ball 668 from the ball cup assembly 630.

In an alternative embodiment, the launch actuator 640 may comprise different components, such as a positional sensor, a rotation sensor, and one or more rotary actuators to track rotational position and initiate the grip and release motions of the cup walls 632, 634. Alternatively, the launch actuator 640 components may move the cup walls 632, 634 linearly towards and away from each other, or utilize a combination of linear and rotary movements of the cup walls 632, 634. Also, the launch actuator 640 may comprise a combination of mechanical, electronic, and various other components to facilitate grip and release at appropriate points during rotation. These and other variants are considered to be within the scope of this disclosure.

Figure 10A:
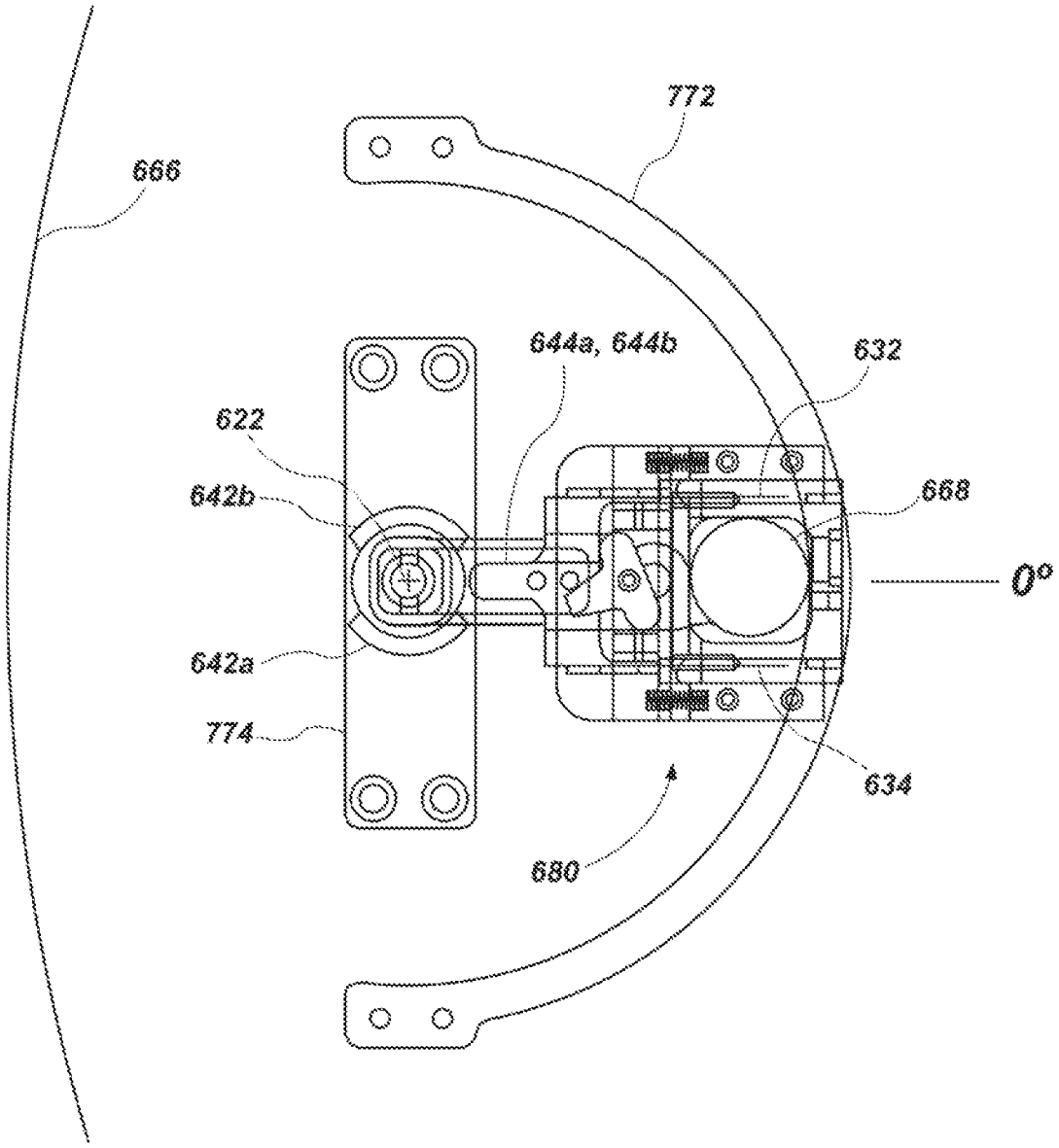
FIGS. 10A through 10F are top views of an embodiment of the ball launching system with the rotor at different rotation angles.

The actions of the ball launching system 600 are illustrated in FIGS. 10A through 10F. In FIG. 10A, the top view shows the rotor 620 (FIG. 9) positioned at a "HOME" position, which is designated 0° in this series of figures. All angular measurements depicted in the figures are approximate and are provided for example only. They do not define specific angular positions for other embodiments of the invention.

At 0°, the first and second cup walls 632, 634 are substantially parallel to each other with the roulette ball 668 resting on the cup floor 636 (see FIG. 9) between the cup walls 632, 634. Aspects of the ball cup assembly 630 at the HOME position are obscured by the automatic ball loader 680 that is mounted above the rotor 620 (FIG. 9). The ball loader 680 will be discussed in detail later in this disclosure.

Also visible in FIG. 10A is a shield 772 that, in some embodiments, is present to prevent the roulette ball 668 from falling out of the ball cup assembly 630 (FIG. 9) while the cup walls 632, 634 are parallel to each other. A portion of the ball track 666 is shown for positional reference. Also shown in FIG. 10A are the cam lobes 642 mounted to the shelf 774, and the rotor axis 622.

Figure 10B:
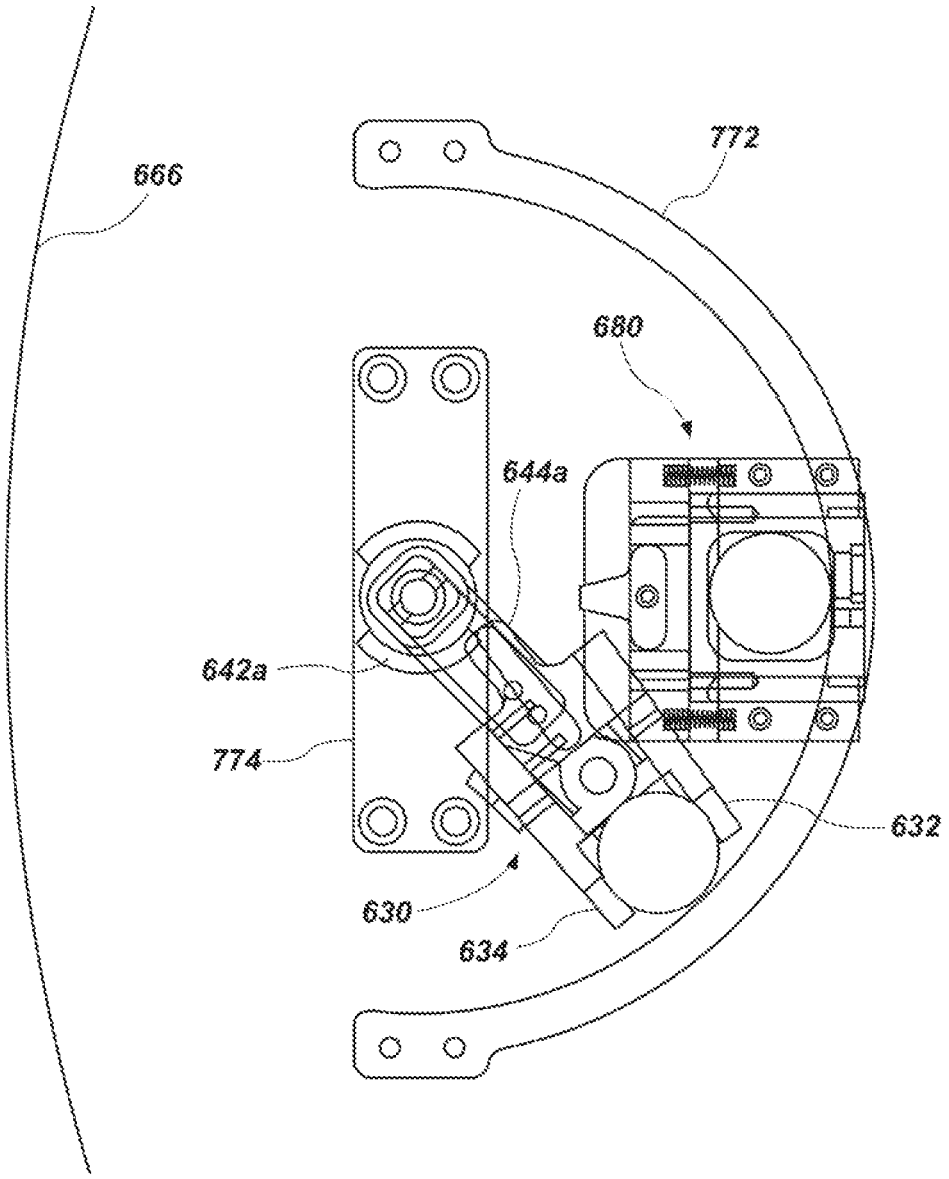

In FIG. 10B, the rotor 620 (FIG. 9) has rotated approximately 45° around the rotor axis 622 (FIG. 10A) from the HOME position. The cam follower 644*a* has contacted the cam lobe 642*a*, causing the cam follower 644*a* and the first cup wall 632 to rotate around the pivot axis 638 (FIG. 9). The roulette ball 668 is gripped between the first cup wall 632 and the second cup wall 634. The other cam follower 644*b* (FIG. 10A), positioned above cam follower 644*a*, passes above cam lobe 642*a* without making contact.

Figure 10C:
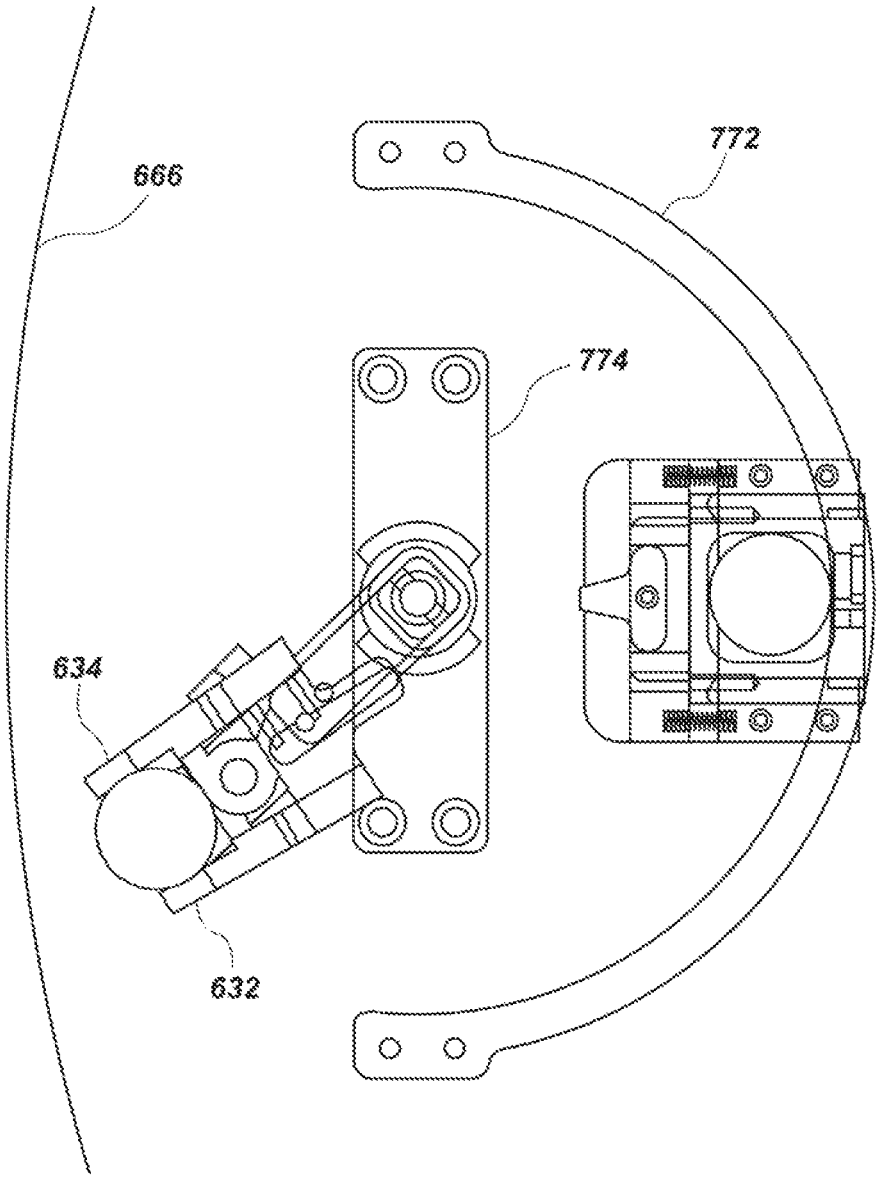

FIG. 10C shows the rotor 620 (FIG. 9) at approximately 135°. The ball cup assembly 630 (FIG. 9) is no longer in close proximity to the shield 772 and the roulette ball 668 is captured between the first and second cup walls 632, 634. In some embodiments, the driver 650 (FIG. 8) may stop the rotor 620 at or near this position until the ball launching system 600 receives a signal from a launch button or other launch initiator indicative of a command to release the roulette ball 668 into the ball track 666.

Figure 10D:
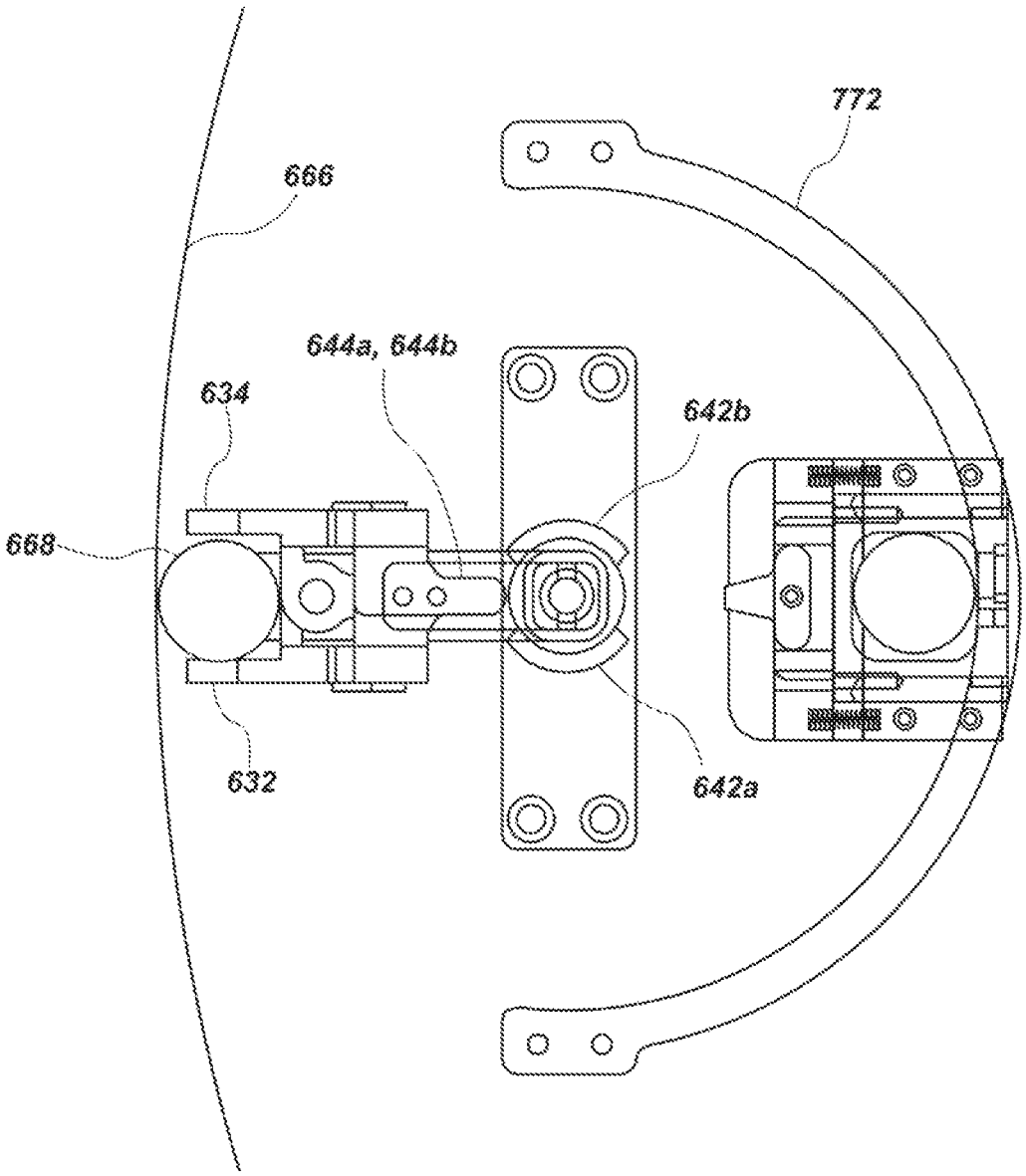

FIG. 10D shows the rotor 620 (FIG. 9) at approximately 180°. In this embodiment, the cam follower 644*a* has passed the cam lobe 642*a* and both the first and second cup walls 632, 634 are parallel to each other with the roulette ball 668 between them. The roulette ball 668 may actually contact the ball track 666 at this point but is still contained within the ball cup assembly 630 (FIG. 9).

Figure 10E:
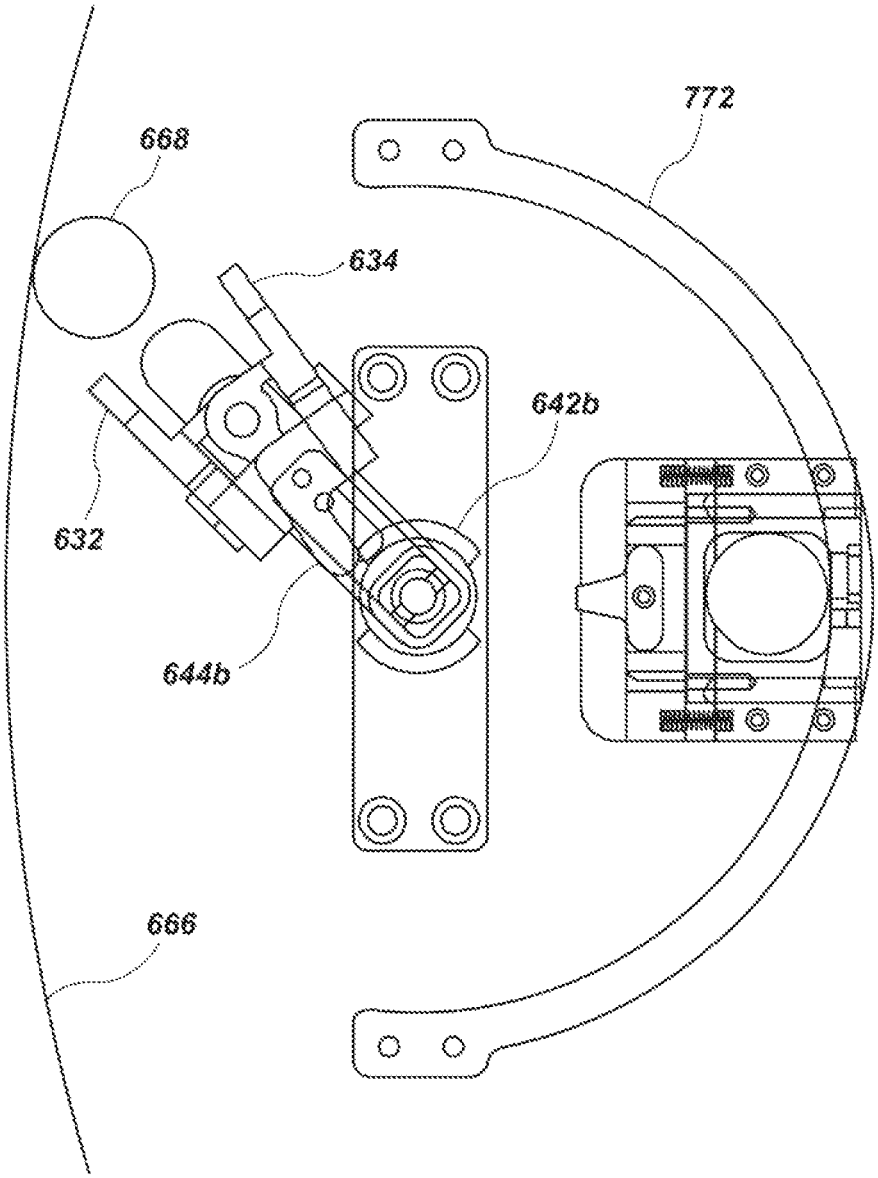

In FIG. 10E, the rotor 620 (FIG. 9) has rotated to approximately 225°. The roulette ball 668 is moving into the ball track 666, and the cam follower 644*b* has contacted the cam lobe 642*b*, causing the second cup wall 634 to pivot away from the first cup wall 632. As the rotor 620 continues to rotate past 225°, the cam follower 644*b* may ride up the cam lobe 642*b* and pivot the second cup wall 634 further from the first cup wall 632.

The ball launching system 600 may be capable of launching the roulette ball 668 onto the ball track 666 in either angular direction (e.g., clockwise and counterclockwise). The launch direction may be selected by a player, selected by a croupier prior to launch, and may be selected randomly, alternately, or in a programmed pattern. The ball launching system 600 may employ internal memory and/or external memory to store instructions that determine launch direction, launch speed, launch delays for multiple balls, and other launch characteristics. To prevent predictive behavior, launch characteristics (e.g., launch speed) may be varied randomly or intermittently with each successive ball. For example, the electronic circuitry 765 (shown in FIG. 8) may include controllers and/or memory devices configured to control various operations and functions of the ball launching system 600. Information regarding launch characteristic may be hidden from a player or may be selectively displayed to a player and/or a croupier via, for example, the electronic display 773 (FIG. 7), the display 130 (FIG. 1), and the display 310 (FIG. 3).

Figure 10F:
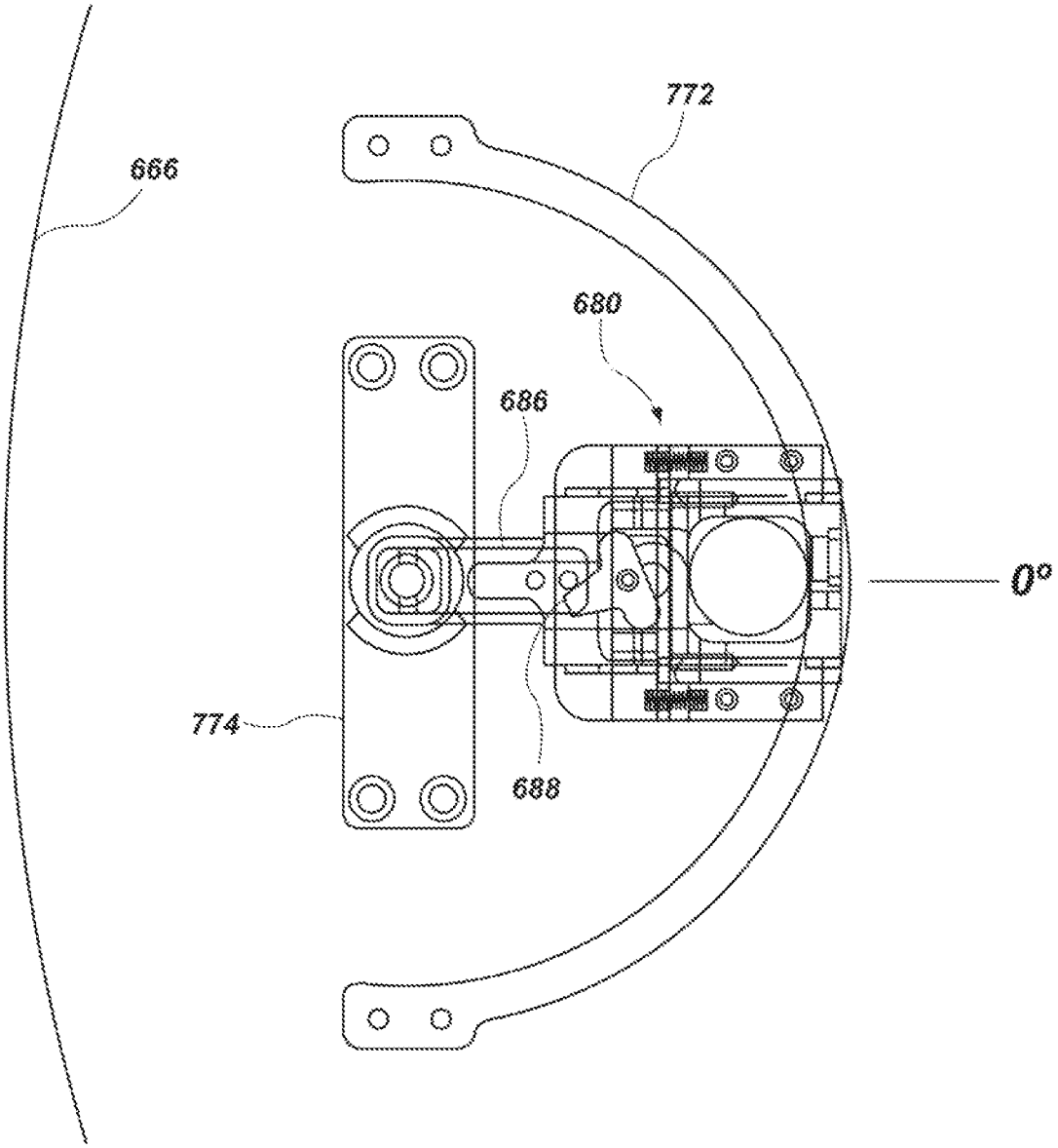

In FIG. 10F, the rotor 620 (FIG. 9) has returned to the HOME position at 0°. The ball cup assembly 630 is again positioned to accept another roulette ball from the ball loader 680.

The ball launching system 600 may include provisions for storing and automatically loading a plurality of roulette balls. Automatic loading enables the launching system 680 to launch multiple balls 668 in succession into the ball track 666. For example, a player may elect to play two or three balls on each spin. The player may wager accordingly and the awards for a successful prediction may be augmented for a multi-ball spin.

Figure 11:
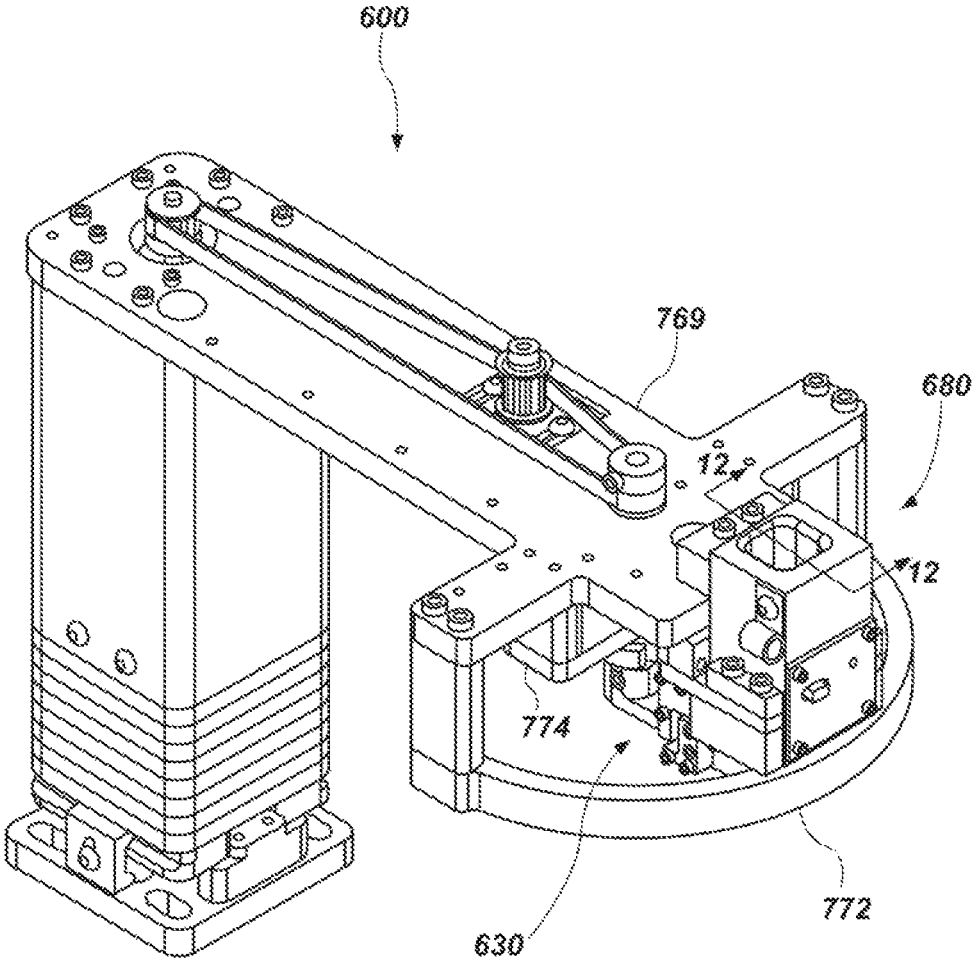
FIG. 11 is a perspective detail view of an embodiment of the ball launching system including a roulette ball loader mounted thereon.

As shown in FIG. 11, the ball launching system 600 may include the ball loader 680. The loader 680 is mounted to the beam 769 above the ball cup assembly 630. The loader 680 in FIG. 11 is positioned to correspond with the 0° rotor position depicted in FIG. 10A (i.e., the HOME or loading position). The loader 680 is further positioned to receive balls from the ball feeder 776 shown in FIG. 7.

Figure 12:
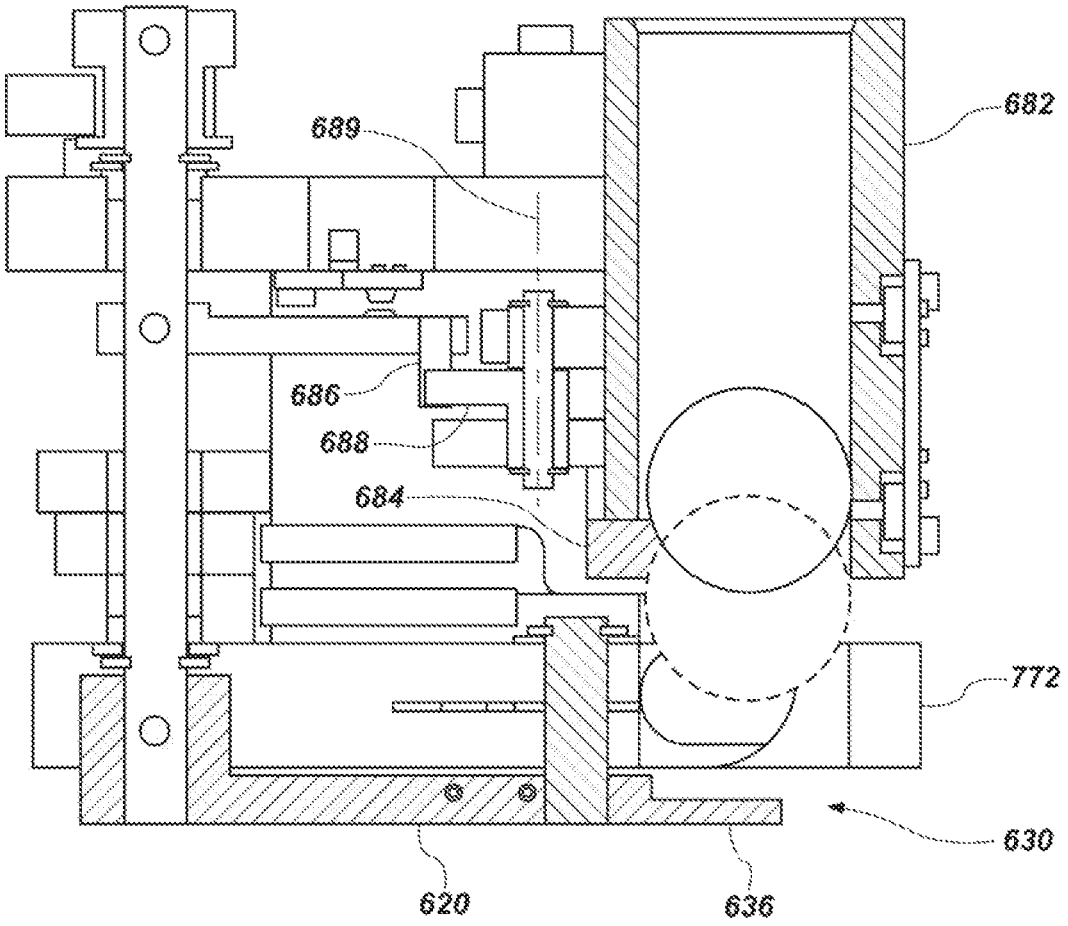
FIG. 12 is a cross-sectional view across line 12-12 (of FIG. 11) of a roulette ball loader.

FIG. 12 is a section view across line 12-12 (of FIG. 11) of the ball loader 680 in position above the rotor 620 and the ball cup assembly 630. The loader 680 includes a magazine 682 for holding a plurality of roulette balls 668 (FIG. 10E) prior to loading in the ball cup assembly 630. In the embodiment shown, the magazine 682 is a vertical storage region in which additional roulette balls may stack on top of each other. At the bottom of the magazine 682 is a latch 684 that has an open and closed position. In the closed position (shown in solid lines) the latch 684 protrudes into the magazine 682 to block the bottommost ball in the magazine from dropping into the ball cup assembly 630. When the ball cup assembly 630 is ready to receive the roulette ball 668, the latch 684 moves to the open position (shown in dashed lines) to permit the bottommost ball to drop into the ball cup assembly 630.

The loader latch 684 may be controlled by various actuating components. The latch 684 is moved from the closed to the open position in response to interactions between a loader arm 686 (also shown in FIG. 10F) that rotates with the rotor shaft 624 (FIG. 8). In this embodiment, as the rotor 620 moves to the HOME position, the loader arm 686 contacts a loader lever 688 (also shown in FIG. 10F), causing the loader lever 688 to pivot about a lever axis 689 and move the latch 684 between the open and closed positions. Alternatively, the latch 684 may be biased to the closed position by a resilient component such as a spring, and the lever 688 may deflect the resilient component to move the latch 684 to the open position. Various other means and methods may be employed to automatically load roulettes balls into the ball cup assembly 630 and would still be considered to be within the bounds of the invention disclosed herein.

Embodiments of methods for administering a game of roulette may utilize any of the above-described roulette wheels 104, 304, 584 (FIGS. 1, 3, and 5) as a random outcome generation apparatus, and may further utilize the ball launching system 600 and devices described above. In other embodiments, the roulette wheel may be an animation or virtual representation of a roulette wheel. For example, an animation of a virtual roulette wheel may be displayed on a community electronic display. In still other embodiments, a conventional roulette wheel may be used. The wheel may be automatically activated to start spinning, stop spinning or both. The wheel may be manually activated. The ball may be automatically activated, manually activated; fore example, the ball may be activated using the above-described ball launching system 600. The entire physical wheel may be automatically activated, or manually activated. The wheel may be a "card wheel" that carries cards bearing the conventional number and color combinations found on a roulette wheel. Selection of a card may result in the wheel dispensing or displaying the selected card as the game outcome. An exemplary wheel is disclosed in U.S. Pat. No. 7,669,853, issued on Mar. 2, 2010, and titled "CARD SHUFFLING MACHINE," the disclosure of which is incorporated herein in its entirety by this reference.

In addition, the random generation of event outcomes may refer to revealing a representation of a payout multiplier or a roulette outcome on a scratch-off card (also referred to as "scratchers").

Devising effective new bets for roulette presents a particularly difficult challenge for game designers. More specifically, the sheer number of possible outcomes (i.e., 38 possible numbers, including 00 and 0 through 36, according to United States rules, or 37 possible numbers, including 0 through 36, according to European rules) and associated payout values make crafting a statistically-profitable wager mathematically difficult. When payout values are randomized, their randomization further increases the complexity and difficulty of crafting a profitable wager. Moreover, strategic concerns regarding player perceptions render crafting a wager difficult. When players do not perceive a wager as offering the potential for rewards commensurate with the risk that the wagered amount will be lost, they may avoid the wager. Such wagers are frequently labeled "sucker bets." Accordingly, crafting a wager for roulette that is both profitable for the house and popular with players presents an extraordinary challenge.

Figure 13:
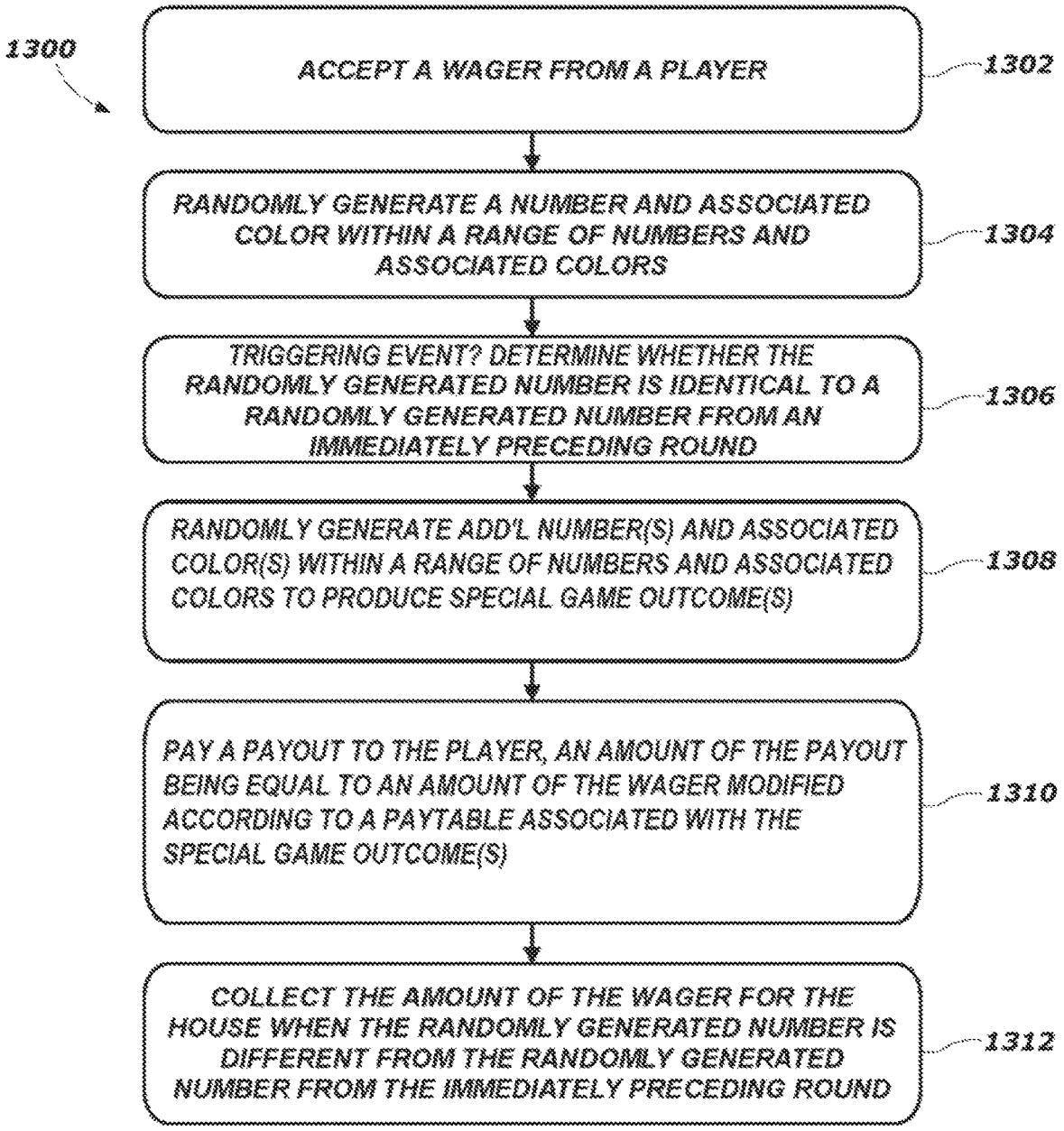
FIG. 13 is a flowchart diagram of a method of administering a wagering game, according to an embodiment of this disclosure.

Referring to FIG. 13, a flowchart diagram of a method 1300 of administering a wagering game is shown. The method 1300 may involve accepting a wager from a player, as indicated at 1302. The wager may be, for example, an unconventional roulette wager (e.g., a bonus wager). The wager may be optional or mandatory. Making a wager on the basic roulette game may also be a requirement to participate in the side bet in embodiments where the wager accepted from the player is a side bet. A result of the wager may depend on at least two outcomes: the outcome of the round of roulette initiated with acceptance of the wager and the outcome of the immediately preceding round of roulette. The wager may be accepted, for example, by physically receiving money or a representation of money (e.g., a chip or token) on a designated betting area, by a processor receiving a signal from a user interface indicating a wager has been received, or by receiving electronic authorization to charge a player account (e.g., a credit account or a bank account). More specifically, the wager may be accepted, for example, by physically receiving chips within a wager area 114, 116, 1430 (FIGS. 2 and 14) on a playing surface 102, 1420 (FIGS. 2 and 14) of a playing table 100, 300, 582, 1700, or 1800 (see FIGS. 1, 3, 5, 17, and 18) or by receiving electronic authorization at a processor 180, 1650, 1714, 1728, 1897, or 2042 (see FIGS. 1, 16 through 18, and 20) to charge a player account via a player interface 1632, 1716, 1832, 1920, 2050, or 2054 (see FIGS. 16 and 20) or dealer interface 118, 1718 (see FIGS. 1 and 17), where the player interface may be remotely located from the dealer or game server.

In some embodiments, one or more additional wagers may be accepted from the player. For example, another wager selected from the group consisting of an odds, evens, red, black, split, box, high, low, first twelve, second twelve, third twelve, and specific number and associated color wager may be accepted from the player. Accepting another wager may be accomplished by performing any of the actions described previously in connection with accepting the wager 1302.

A number and associated color within a range of numbers and associated colors may be randomly generated, as indicated at 1304. For example, an outcome generation apparatus, such as any of roulette wheels 104, 304, 584 (FIGS. 1, 3, and 5) in conjunction with the ball launching system 600 (FIGS. 6 through 12) may be used to randomly generate a number from the group consisting of 00 and integers between 0 and 36, for American-style roulette, or from the group consisting of integers between 0 and 36, for European-style roulette. A preselected color may be associated with each number, such that randomly generating the number may also generate the color associated with the randomly generated number. For example, red or black may be associated with integers from 1 to 36, with equal quantities of numbers being red and black, and green may be associated with 0 and 00. According to an embodiment, each number is associated with only one number such that there is only one occurrence of a number in the entire set of numbers. For example, the number four (4) may occur only as a black number in the set. Randomly generating the number and associated color may involve, for example, introducing a ball (e.g., roulette ball 668 (FIGS. 6 and 10E) onto a spinning roulette wheel (e.g., a spinning rotor 662 (FIG. 6) within the roulette wheel bowl 664 (FIG. 6), wheels 104, 304, 584, 1706 (FIGS. 1, 3, 5, and 17)), wherein the number and associated color are generated by permitting the ball 668 to come to rest at a segregated location in which the number and associated color are displayed, or activating a random number generator and using a result of the random number generator to select the number and associated color. More specifically, the number and associated color may be randomly generated, for example, by physically introducing a ball (e.g., roulette ball 668 (FIG. 6)) onto a physical spinning roulette wheel (e.g., spinning rotor 662 (FIG. 6) within the roulette wheel bowl 664 (FIG. 6), wheels 104, 304, 584, 1706 (FIGS. 1, 3, 5, and 17) on a playing surface 102, 1420 (FIGS. 1 and 14) of a playing table 100, 300, 582, 1700, or 1800 (see FIGS. 1, 3, 5, 17, and 18), by receiving electronic authorization at a processor 180, 1650, 1714, 1728, 1897, or 2042 (see FIGS. 1, 16 through 18, and 20) via a dealer interface 1718 (see FIG. 17) to activate a random number generator (e.g., programmed into or otherwise operatively connected to the processor 180, 1650, 1714, 1728, 1897, or 2042 (see FIGS. 1, 16 through 18, and 20) and automatically apply a formula, or by automatically, electronically activating a random number generator using a processor 180, 1650, 1714, 1728, 1897, or 2042 (see FIGS. 1, 16 through 18, and 20) and automatically applying a formula to generate a random number and associated color from within the range of numbers and associated colors.

A triggering event may be identified by determining whether the randomly generated number is identical to a randomly generated number from an immediately preceding round, as indicated at step 1306. For example, the outcome of the immediately preceding round may be recorded and stored for comparison to the subsequent round. More specifically, the outcome of the immediately preceding round may be physically written down by a dealer, entered for electronic storage in memory 190, 1640, 1740, 1895, 2046, or 2048 (see FIGS. 1, 16 through 18, and 20) via a dealer interface 118, 1718 (see FIGS. 1 and 17), or automatically, electronically stored in memory 190, 1640, 1740, 1895, 2046, or 2048 (see FIGS. 1, 16 through 18, and 20) when the outcome of the immediately preceding round has been generated. In some embodiments, the outcome of the immediately preceding round and additional historical information about the game of roulette may be displayed to the player using, for example, the techniques disclosed in U.S. patent application Ser. No. 13/631,598, filed Sep. 28, 2012, for "SYSTEMS, METHODS, AND DEVICES FOR DISPLAYING HISTORICAL ROULETTE INFORMATION," the disclosure of which is incorporated herein in its entirety by this reference. The randomly generated number from the current round may be compared to the randomly generated number from the immediately preceding round, for example, by visually comparing the outcome of the current round to the outcome written down by the dealer, visually comparing the outcome of the current round to an electronically stored and displayed outcome of the immediately preceding round, or automatically, electronically accessing the stored outcome from the immediately preceding round using a processor 180, 1650, 1714, 1728, 1897, or 2042 (see FIGS. 1, 16 through 18, and 20) and comparing it to the outcome of the current round.

As indicated at step 1308, upon identifying the triggering event, one or more additional numbers and associated colors within a range of numbers and associated colors may be generated, as described with respect to step 1308, to determine an outcome of one or more special roulette games.

A payout may be paid to the player, an amount of the payout being equal to an amount determined by the wager and modified according to a paytable associated with possible outcomes of one or more special roulette games, as indicated at operation 1310. For example, the amount of the payout may be calculated by multiplying a paytable value corresponding to the special game outcome by the amount originally accepted for the wager. More specifically, the amount of the payout may be calculated by multiplying the paytable value by the amount of the wager using a processor 180, 1650, 1714, 1728, 1897, or 2042 (see FIGS. 1, 16 through 18, and 20).

Paying the payout may involve, for example, physically giving money or chips, crediting a win meter, or granting electronic authorization to transfer funds to a player account. More specifically, the payout may be paid, for example, by physically giving chips to a player on a playing surface 102, 1420 (see FIGS. 1 and 14) of a playing table 100, 300, 582, 1700, 1800 (see FIGS. 1, 3, 5, 17, and 18), by receiving electronic authorization at a processor 180, 1650, 1714, 1728, 1897, or 2042 (see FIGS. 1, 16 through 18, and 20) via a dealer interface 118, 1718 (see FIGS. 1 and 17) to transfer funds from an account server 432, 1910 (see FIGS. 4 and 19) to a player account, or automatically generating electronic authorization at the processor 180, 1650, 1714, 1728, 1897, or 2042 (see FIGS. 1, 16 through 18, and 20) to transfer funds from an account server 432, 1910 to a player account (see FIGS. 4 and 19).

The amount of the wager may be collected for the house when the randomly generated number is different from the randomly generated number from the immediately preceding round, as indicated at 1312. Collecting the amount of the wager may be accomplished, for example, by physically retrieving money or chips, decrementing credits from a player credit meter, or granting electronic authorization to transfer funds to a house account. More specifically, collecting the amount of the second wager may be accomplished, for example, by physically retrieving chips from the playing surface 102, 302, 1420 (see FIGS. 1, 3, and 14) of a playing table, receiving electronic authorization at a processor 180, 1650, 1714, 1728, 1897, or 2042 (see FIGS. 1, 16 through 18, and 20) via a dealer interface 118, 1718 (see FIGS. 1 and 17) to transfer funds from a player account to an account server 432, 1910 (see FIGS. 4 and 19), or automatically generating electronic authorization at the processor 180, 1650, 1714, 1728, 1897, or 2042 (see FIGS. 1, 16 through 18, and 20) to transfer funds from the player account to a house account server 432, 1910 (see FIGS. 4 and 19).

Payouts may be paid on any additional wagers when a characteristic of the randomly generated number and associated color is the same as the characteristics associated with the additional wagers. The amounts of any additional wagers may be collected for the house when the characteristic of the randomly generated number and associated color is different from the characteristics associated with the additional wagers. Paying the payouts and collecting the additional wagers may be accomplished by performing any of the actions described previously in connection with paying the payout on the wager 1310 and collecting the amount of the wager 1312.

Various platforms are contemplated that are suitable for implementation of embodiments of wagering games according to the present disclosure. For example, embodiments of wagering games may be implemented such that wagers may be received from one or more players, and game play may be administered with the one or more players according to the rules of the wagering games. For example, wagering games may be implemented on gaming tables, which may include physical gaming features, such as physical cards and physical chips, and may include a live dealer and a physical roulette wheel. More specifically, a live dealer may spin the wheel, launch the ball (e.g., using the ball launching system 600 (FIGS. 6 through 12) (or electronically activate the wheel, ball or both), handle physical cards when a "card wheel" is used, evaluate hands, accept wagers, accept player elections, issue payouts, and perform other administrative functions of game play. Some embodiments may be implemented on electronic devices enabling electronic gaming features, such as providing electronic displays for display of virtual cards, virtual chips, game instructions, paytables, etc. Some embodiments may include features that are a combination of physical and electronic features.

As an example, embodiments of wagering games may be implemented on an individual gaming device, such as a video poker machine, configured to accept wagers and having a display screen and input devices for enabling game play of the wagering games. Such an individual gaming device may be linked with other gaming devices that may be operated, for example, by other players. Some individual electronic gaming devices may be referred to as an individual player "electronic gaming machine" (hereinafter "EGM") and may be stationary, such as being located on a casino floor. Other individual electronic gaming devices may be portable devices that may be carried to different locations by the player. Portable devices may include both display of the ongoing game play and input reception for game play by a player. Portable devices may, alternatively or additionally, be configured for receiving input from a player while the game play is displayed on a public monitor or other display device. Game play and game outcomes may also be displayed on a portable device.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, or on a legally-authorized site on the Internet.

For example, in one embodiment, the players may be remotely located from a live dealer, and a live dealer and a game table may be displayed to players on their monitors via a video feed (see FIG. 5). The players may or may not have video feeds that may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference, and in connection with FIGS. 19 and 20.

Discussed above, with regard to FIG. 2, was a playing surface (i.e., playing surface 102) for implementing wagering games within the scope of this disclosure. Referring to FIG. 14, shown is a diagram of another playing surface 1420 for implementation of wagering games such as roulette and roulette variants within the scope of the present disclosure. Such an implementation may be a felt layout on a physical gaming table (not shown) or an electronic representation on a video display 130, 422, 1674, 1716, 1730, 1832, 1864, 1860, 1920, or 2058 (see FIGS. 1, 4, 16 through 20). The playing surface 1420 may include wager areas 1430 at multiple player positions in which acceptance of the wager 1302 (see FIG. 13) may be reflected. For example, physical money or chips may be received in the wager area 1430, or images of money or chips or numbers and text may be electronically displayed in the wager area 1430, to show acceptance of the wager.

In some embodiments, an electronic bet sensor (not shown) is provided to electronically recognize the placement of a chip of a fixed denomination. In other embodiments, the chip sensor can determine the denomination of the chip. In some embodiments, the wager can be any size within house limits.

The playing surface 1420 may further include another wager area 1432, in which other wagers such as traditional roulette wagers may be accepted. The other wager area 1432 may be the same as or similar to wagering areas described in U.S. patent application Ser. No. 13/631,598, filed Sep. 28, 2012, for "SYSTEMS, METHODS, AND DEVICES FOR DISPLAYING HISTORICAL ROULETTE INFORMATION." Briefly, the other wagering area 1432 may be configured for acceptance of odds, evens, red, black, split, box, specific number and color, and other roulette bets. In some embodiments, the playing surface 1420 may include a display for electronically showing the outcome of randomly generating the number and associated color 1306 (see FIG. 13) or a roulette wheel 104, 304, 584, 1706 (see FIGS. 1, 3, 5, and 17) into which a ball may be introduced to randomly generate the number and associated color.

Figure 15:
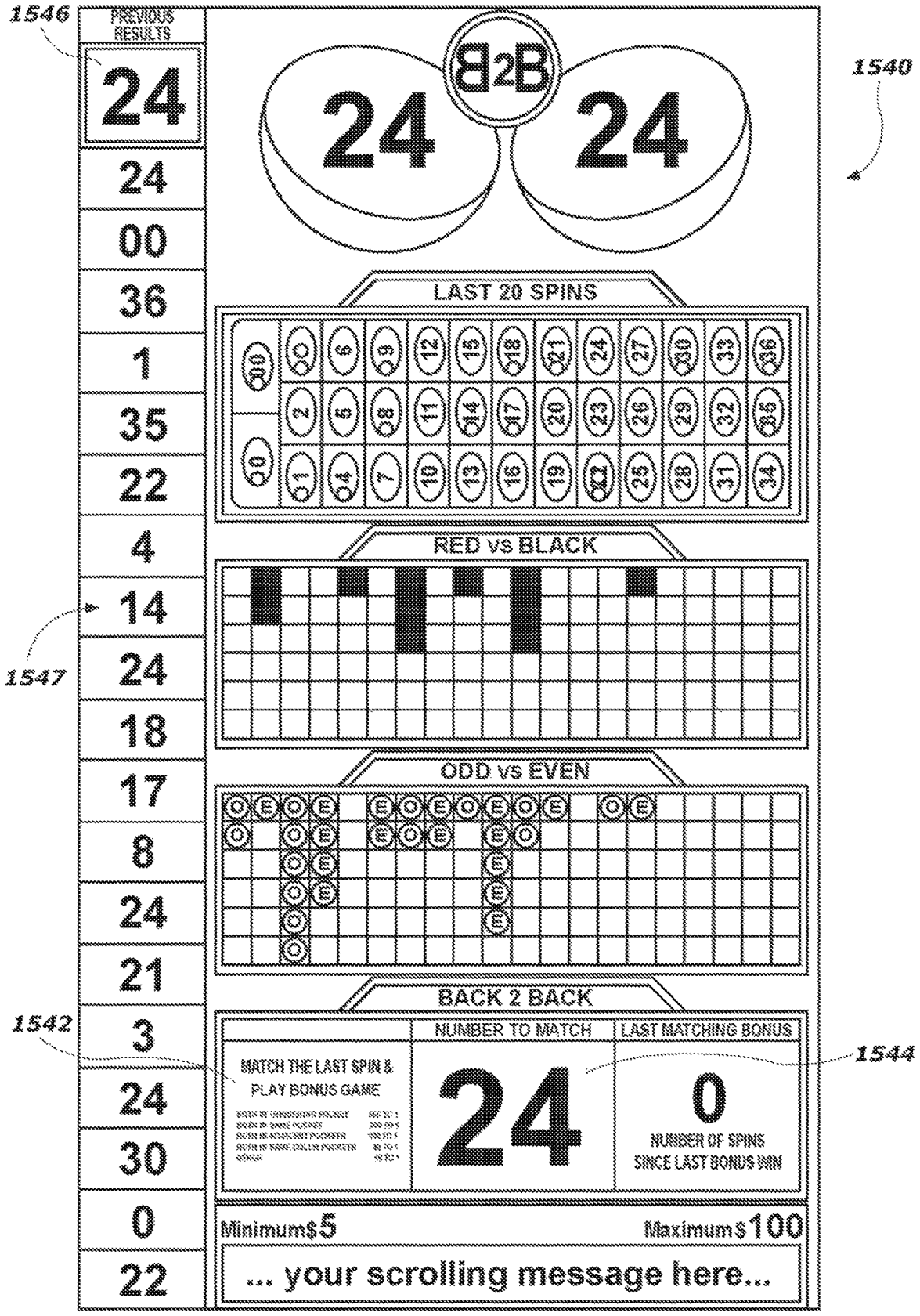
FIG. 15 is a diagram of another playing surface for implementation of a method of administering a wagering game, according to another embodiment of the present disclosure.

Referring to FIG. 15, illustrated is a diagram of an upright video display that may be used in connection with the playing surface 1420 (FIG. 14) for implementation of a method of administering a wagering game, according to another embodiment of the present disclosure. Such an implementation may be a traditional roulette game utilizing a felt surface 1420 as shown in FIG. 14, an electronic representation on a video display 130, 1674, 1716, 1730, 1832, 1864, 1860, 1920, or 2058 (see FIGS. 1, 16 through 20).

The video display may include a display surface 1540. The display surface 1540 may display historical information on the outcomes of the game of roulette in multiple formats, as described in U.S. patent application Ser. No. 13/631,598, filed Sep. 28, 2012, for "SYSTEMS, METHODS, AND DEVICES FOR DISPLAYING HISTORICAL ROULETTE INFORMATION." Briefly, the display surface 1540 may display the numbers and colors for the current and preceding outcomes and may visually represent streaks in specific outcomes (e.g., 24 black, 36 red, etc.) and characteristics of outcomes (e.g., odds, evens, red, black, green). The display 1540 may have a vertical column 1547 of historical game outcomes, in the order in which the outcomes occurred, the newest being at the top of the column 1547. The display surface 1540 may include an immediately preceding outcome area 1544, which may display the outcome to be repeated for a player to win the wager 1310 (see FIG. 13). The display surface 1540 may further include an outcome area 1546 within column 1547, which may display the outcome of the current round of the game of roulette. The display surface 1540 may include a paytable 1542 describing payouts associated with the special roulette game(s) described above.

In some embodiments, the wagering games described herein may be played against the game administrator, i.e., "the house" (i.e., be "house-banked"), which may involve the game administrator (e.g., a casino or other gaming establishment) receiving (via a dealer who may be employed by the administrator) wagers having real-world monetary value, comparing a player hand against a dealer hand, distributing payouts having real-world monetary value to winning players, and retaining lost wagers. For example, and referring collectively to FIGS. 14 and 15, a wager may be accepted from a player, which may be reflected by the presence of a chip or an image of a chip in the wager area 1430 (or one of the wager areas 114, 116 of FIG. 2). A number and associated color may be randomly generated (e.g., using a roulette wheel (e.g., wheel 104, 304, 584, 1706 (FIGS. 1, 3, 5, and 17)) and the ball launching system 600 (FIG. 6)) from within a range of numbers and associated colors, which may be reflected, for example, by a ball coming to rest in a section of a physical roulette wheel 104, 304, 584, 1706 (see FIGS. 1, 3, 5, and 17) or by electronically displaying the randomly generated number and associated color in text, images, or text and images in an outcome area 1546 of an electronic display.

A triggering event may be identified by determining whether the randomly generated number is identical to a randomly generated number from an immediately preceding round. Upon identifying the triggering event, one or more additional numbers and associated colors within a range of numbers and associated colors may be generated, which, again, may be reflected, for example, by a ball coming to rest in a section of a physical roulette wheel 104, 304, 584, 1706 (see FIGS. 1, 3, 5, and 17) or by electronically displaying the randomly generated number and associated color in text, images, or text and images in an outcome area 1546 of an electronic display, to determine an outcome of one or more special roulette games. A payout may be paid to the player, an amount of the payout being equal to an amount determined by the wager and modified according to a paytable associated with possible outcomes of one or more special roulette games. For example, the amount of the payout may be calculated by multiplying a paytable value corresponding to the special game outcome by the amount originally accepted for the wager.

Payment of the payout may be reflected by the transfer of chips to a player, credits added to a meter on a gaming device, or funds credited to a player account. The amount of the wager may be collected for the house when the randomly generated number is different from the randomly generated number from the immediately preceding round, which may be reflected by the transfer of chips to a dealer or of funds to a house account. Such embodiments may be implemented in the form of a live table game, a hybrid game utilizing a conventional roulette wheel on a table having electronic wagering interfaces, such as the system shown in U.S. Design Pat. D663,785 issued Jul. 17, 2012 (the content which is hereby incorporated by reference in its entirety), in a virtual table game, in an electronic game, or in an online game configuration.

As another specific, nonlimiting example, a method of administering a game of roulette may involve accepting a first wager from a player. Another wager 1302 (FIG. 13) may also be accepted from the player. The other wager 1302 may be a mandatory wager or an optional side wager. A dealer may use a dealer input to generate a signal to a processor indicating a player has placed another wager 1302.

A number and associated color may be randomly generated within a range of numbers and associated colors. In an embodiment, the total number and color combinations in the set of outcomes from which the game outcome may be randomly generated corresponds to the pockets in a conventional roulette wheel.

A triggering event may be identified by determining whether the randomly generated number and associated color is identical to a randomly generated number and associated color from an immediately preceding round. Upon identifying the triggering event, one or more additional numbers and associated colors within a range of numbers and associated colors may be generated to determine an outcome of one or more special roulette games. A payout may be paid to the player upon conclusion of the special roulette games, an amount of the payout being equal to an amount determined by the other wager and modified according to a paytable associated with possible outcomes of one or more special roulette games. For example, the amount of the payout may be calculated by multiplying a paytable value corresponding to the special game outcome by the amount originally accepted for the other wager.

The amount of the other wager may be collected by the house when the randomly generated number is different from the randomly generated number from the immediately preceding round. The first wager may be resolved by comparing a characteristic of the randomly generated number and associated color with a characteristic associated with the first wager. For example, a player may place a chip on an area 117, 1432 (FIGS. 2 and 14) of a layout 102, 1420 (FIGS. 2 and 14) indicating a wager, such as betting $5.00 on a black 10.

In some embodiments, wagering games may be administered without players risking money in connection with the wagers (i.e., "play-for-fun" games). Such games may be offered as online games, or as PC games such as those offered for downloading, or offered on a CD-ROM disc, for example. When a play-for-fun game is administered online, access to play-for-fun wagering games may be granted on a time period basis in some embodiments. An exemplary online gaming platform suitable for administering play of a play-for-fun game is described more fully below with reference to FIGS. 19 and 20. For example, upon initially joining the online wagering game, each player may automatically be assigned a plurality of wagering elements, such as, for example, chips, points, or simulated currency, that is of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time another quantity of the wagering elements may be distributed to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher level players, or players who have invested more time playing the game may be allotted more wagering elements per unit of time than a player assigned to a lower level group.

Therefore, in some embodiments, the wagering game may be administered by receiving wagers (e.g., the wager described in connection with acts 1302, 1308, and 1310 of FIG. 13 and the other wagers described in connection with area 117 of FIG. 2 or area 1432 of FIG. 14) of no real-world monetary value, and payouts (e.g., the payout described in connection with act 1310 of FIG. 13 and any payouts on the other wagers) may be paid without transferring real-world monetary value to the players. Such embodiments, referred to herein as "play-for-fun" embodiments are nonetheless contemplated as modes of carrying out the methods described herein.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

As a specific, nonlimiting example, a free play-for-fun wagering game may comprise issuing a quantity of valueless wagering elements usable within a predetermined time period to a player. A player decision to allocate at least one valueless wagering element to a wager may be accepted. A number and associated color may be randomly generated from within a range of numbers and associated colors, e.g., using the ball launching system 600 of FIGS. 6 through 12 in association with a roulette wheel 104, 304, 584, 1706 (FIGS. 1, 3, 5, and 17). A triggering event may be identified by determining whether the randomly generated number and associated color is identical to a randomly generated number and associated color from an immediately preceding round. Upon identifying the triggering event, one or more additional numbers and associated colors within a range of numbers and associated colors may be generated to determine an outcome of one or more special roulette games.

The wager may be resolved by determining at the game server whether the randomly generated number is identical to a randomly generated number from an immediately preceding round. Additional valueless wagering elements may be issued to the player according to the outcome of the special roulette games, an quantity of valueless wagering elements being equal to an amount determined by the quantity of valueless wagering elements allocated to the wager and modified according to a paytable associated with possible outcomes of the one or more special roulette games, for example, by multiplying a paytable value corresponding to the special game outcome by the amount originally accepted for the wager.

The quantity of valueless wagering elements allocated to the wager may be deducted when the randomly generated number is different from the randomly generated number from the immediately preceding round. A new quantity of valueless wagering elements usable within a new predetermined time period may be issued to the player, without the player exchanging anything, when the predetermined time period has lapsed.

As another specific, nonlimiting example, a social play-for-fun wagering game may comprise issuing a quantity of valueless wagering elements usable within a predetermined time period to a player. A player decision to allocate at least one valueless wagering element to a wager may be accepted. A triggering event may be identified by determining whether the randomly generated number and associated color is identical to a randomly generated number and associated color from an immediately preceding round. Upon identifying the triggering event, one or more additional numbers and associated colors within a range of numbers and associated colors may be generated, e.g., using the ball launching system 600 of FIGS. 6 through 12 in association with a roulette wheel 104, 304, 584, 1706 (FIGS. 1, 3, 5, and 17) to determine an outcome of one or more special roulette games.

Additional valueless wagering elements may be issued to the player according to the outcome of the special roulette games, an quantity of valueless wagering elements being equal to an amount determined by the quantity of valueless wagering elements allocated to the wager and modified according to a paytable associated with possible outcomes of the one or more special roulette games, for example, by multiplying a paytable value corresponding to the special game outcome by the amount originally accepted for the wager. The quantity of valueless wagering elements allocated to the wager may be deducted when the randomly generated number is different from the randomly generated number from the immediately preceding round. A new quantity of valueless wagering elements usable within a new predetermined time period may be issued to the player, by accepting the player's redemption of an access token of no redeemable face value before the predetermined time period has lapsed.

Figure 16:
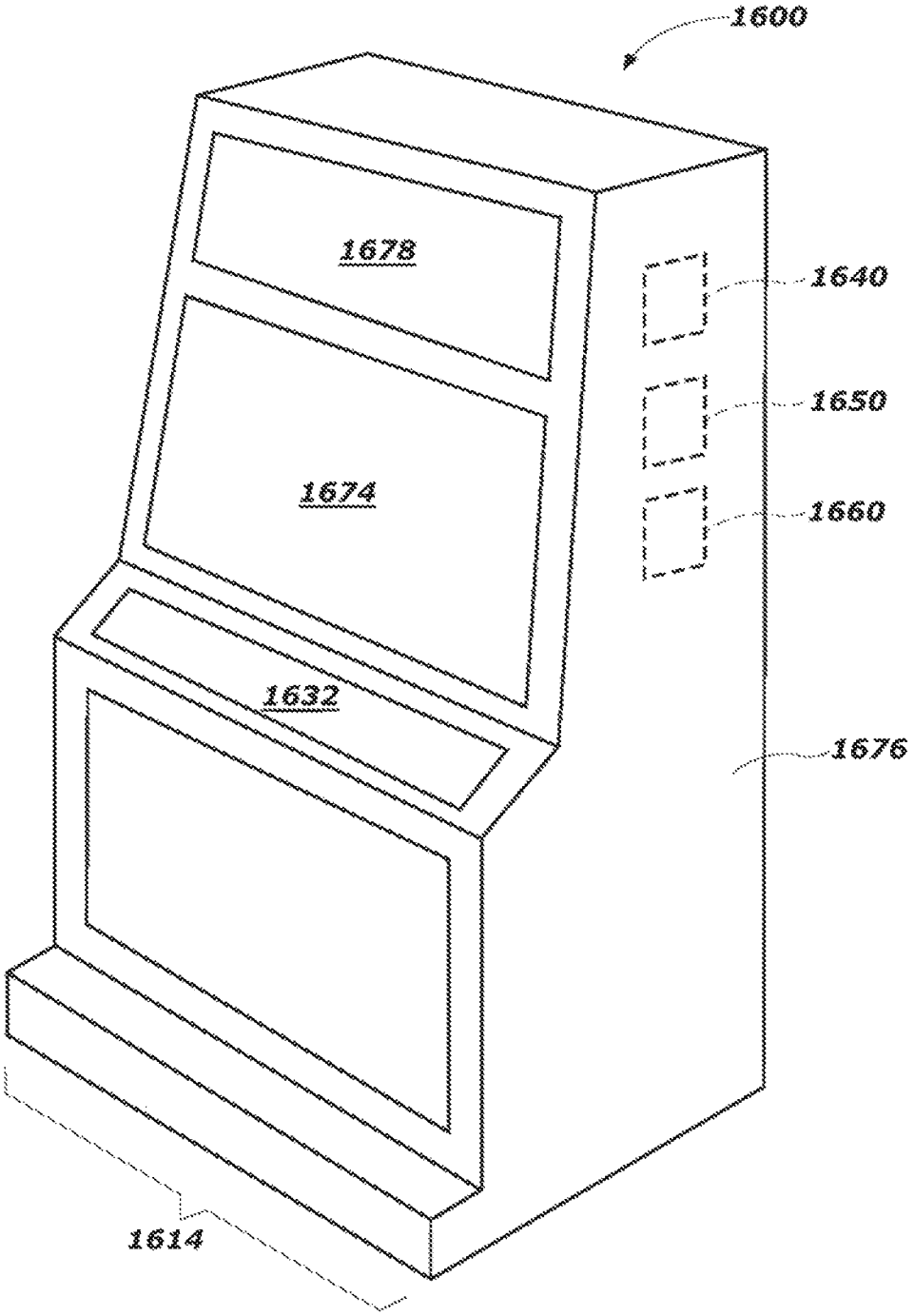
FIG. 16 is a perspective view of an individual electronic gaming device configured for implementation of embodiments of wagering games in accordance with the present disclosure.

Referring to FIG. 16, illustrated is an example of an individual electronic gaming device 1600 (e.g., an electronic gaming machine (hereinafter, an "EGM") configured for implementation of embodiments of wagering games according to the present disclosure. The individual electronic gaming device 1600 may include an individual player position 1614 that includes a player input area 1632 configured to enable a player to interact with the individual electronic gaming device 1600 through various input devices. The individual electronic gaming device 1600 may include a gaming screen 1674 configured to display indicia for interacting with the individual electronic gaming device 1600, such as through processing one or more programs stored in memory 1640 to implement the rules of game play at the individual electronic gaming device 1600. Accordingly, game play may be accommodated without involving a physical wheel, a physical ball or live personnel. The action may instead be simulated by a control processor 1650 operably coupled to the memory 1640 and interacting with and controlling the individual electronic gaming device 1600. The EGM 1600 may also function as a player terminal to participate in a multi-player game administered by a dealer, the system having a community game outcome determining device, such as a roulette wheel. The system may have a community display for displaying game outcomes (not shown). An example of a suitable multi-player system is disclosed in U.S. Pat. No. 6,659,866.

Although the figure has an outline of a traditional gaming cabinet, the individual electronic gaming device 1600 may be implemented in any number of ways, including, but not limited to, client software downloaded to a portable device, such as a smartphone, tablet, or laptop personal computer. The individual electronic gaming device 1600 may also be a non-portable personal computer (e.g., a desktop or all-in-one computer) or other computing device. In some embodiments, client software is not downloaded but is native to the device or is otherwise delivered with the device when distributed to a player.

A communication device 1660 may be included and operably coupled to the processor 1650 such that information related to operation of the individual gaming device 1600, information related to the game play, or combinations thereof may be communicated between the individual gaming device 1600 and other devices (not shown) through a suitable communication media, such, as, for example, wired networks, Wi-Fi networks, and cellular communication networks.

The gaming screen 1674 may be carried by a generally vertically extending cabinet 1676 of the individual electronic gaming device 1600. The individual electronic gaming device 1600 may further include banners (not shown) configured to communicate rules of game play and/or the like, such as along a top portion 1678 of the cabinet 1676 of the individual electronic gaming device 1600. The individual electronic gaming device 1600 may further include additional decorative lights (not shown), and speakers (not shown) for transmitting and/or receiving sounds during game play. Further detail of an example of an individual electronic gaming device 1600 (as well as other embodiments of tables and devices) is disclosed in U.S. patent application Ser. No. 13/215,156, filed Aug. 22, 2011, published as U.S. Patent Publication No. 2013/0053117 on Feb. 28, 2013, and titled "METHODS OF MANAGING PLAY OF WAGERING GAMES AND SYSTEMS FOR MANAGING PLAY OF WAGERING GAMES," the disclosure of which is incorporated herein in its entirety by this reference.

Some embodiments may be implemented at locations that include a plurality of player stations. Such player stations may include an electronic display screen for display of game information, such as displaying a virtual roulette wheel, virtual chips, credit meters, win amounts, wagers made and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual roulette wheel, virtual chips, etc.), some features may remain in the physical domain. As such, the game play may be administered by a live dealer, a virtual dealer, or a combination of both.

Figure 17:
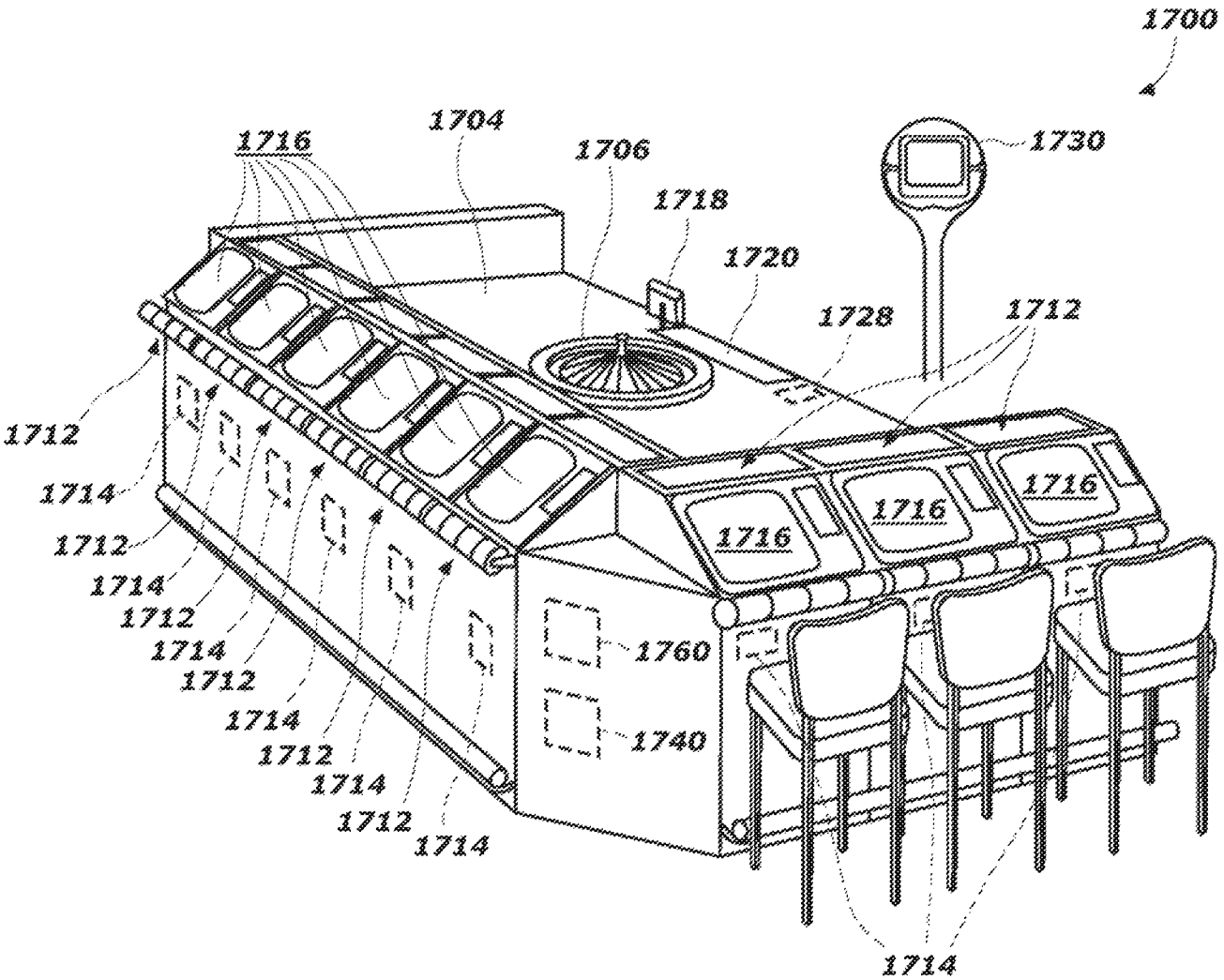
FIG. 17 is a top view of a table configured for implementation of embodiments of wagering games in accordance with the present disclosure.

Referring to FIG. 17, an example of a suitable table 1700 configured for implementation of embodiments of wagering games according to the present disclosure is shown. The table 1700 may include a playing surface 1704, which may be, for example, a felt surface with a roulette wheel 1706 mounted into the surface 1704. The felt surface may include printed graphics or other information useful to the players or dealer. Embodiments (not shown) may enable players to make wagers with chips or other currency on the playing surface 1704. In the displayed embodiment, only credit wagering is enabled. In embodiments that permit wagering on a community playing surface (not shown), credit wagering may also be enabled on individual player interfaces or a community display.

When a community display is provided, a touchscreen surface may be used for display of, and in some embodiments, interaction with, information regarding the wagering game (e.g., wagers accepted, historical information, current round information, etc., as described previously in connection with FIGS. 14 and 15).

The table 1700 as shown in FIG. 17 may include a plurality of player stations 1712. Each player station 1712 may include a separate player interface 1716, which may be used for accepting wagers, displaying game information (e.g., game instructions, input options, wager information including virtual chips, game outcomes, etc.). The player interface 1716 may include a display screen in the form of a touchscreen, which may be at least substantially flush with, or raised up from, the playing surface 1704 in some embodiments. Each player interface 1716 may be coupled respectively with its own local game processor 1714 (shown in dashed lines), although, in some embodiments, a central game processor 1728 (shown in dashed lines) may be employed and may communicate directly to player interfaces 1716. In some embodiments, a combination of individual local game processors 1714 and the central game processor 1728 may be employed.

A communication device 1760 and a non-transitory memory 1740 may be included and may be operably coupled to one or more of the local game processors 1714, the central game processor 1728, or combinations thereof, such that information related to operation of the table 1700, information related to the game play, or combinations thereof may be communicated between the table 1700 and other devices (not shown) through a suitable communication media, such as, for example, wired networks, Wi-Fi networks, and cellular communication networks.

The table 1700 may further include additional features, such as a dealer chip tray 1720, which may be used by the dealer to cash players in and out of the wagering game, whereas wagers and balance adjustments during game play may be performed using virtual chips. For embodiments using physical roulette wheels 1706, the table 1700 may further include a spinning, physical roulette wheel 1706 that may be configured to receive a ball, e.g., launched into the roulette wheel 1706 using the ball launching system 600 of FIGS. 6 through 12, or other indicator which may come to rest in individual, separate sections with numbers and colors therein to generate a random outcome for a round of roulette. For embodiments using virtual roulette outcome generation, the outcome may be displayed at the individual player interfaces 1716 or on a common display 1730.

The table 1700 may further include a dealer interface 1718, which, like the player interfaces 1714, may include touchscreen controls for assisting the dealer in administering the wagering game. The table 1700 may further include an upright common display 1730 configured to display images that depict game information, such as, for example, the information described previously in connection with FIGS. 14 and 15 and a wide variety of other information considered useful to the players, including a video display of each game outcome, in real-time. A camera (not shown) may be trained on the wheel 1706 and video recordings of each wheel spin may be captured and displayed on the display 1730. The upright display 1730 may be double sided to provide such information to players as well as to the casino pit.

Further detail of an example of a table and player displays is disclosed in U.S. Pat. No. 6,659,866, issued Dec. 9, 2003, for "AUTOMATIC TABLE GAME," the disclosure of which is incorporated herein in its entirety by this reference. Although an embodiment is described showing individual discrete player stations, in some embodiments, the entire playing surface 1704 may be an electronic display that is logically partitioned to permit game play from a plurality of players for receiving inputs from, and displaying game information to, the players, the dealer, or both.

In some embodiments, the methods of the present disclosure may be administered using the table 100 of FIG. 1, described above. The playing surface 102 may similar to that illustrated in FIG. 2 or the playing surface 1420 described previously in connection with FIG. 14. As discussed above, the video display 130 may be configured to display game information, which information may be, for example, the information described previously in connection with FIGS. 14 and 15.

Figure 18:
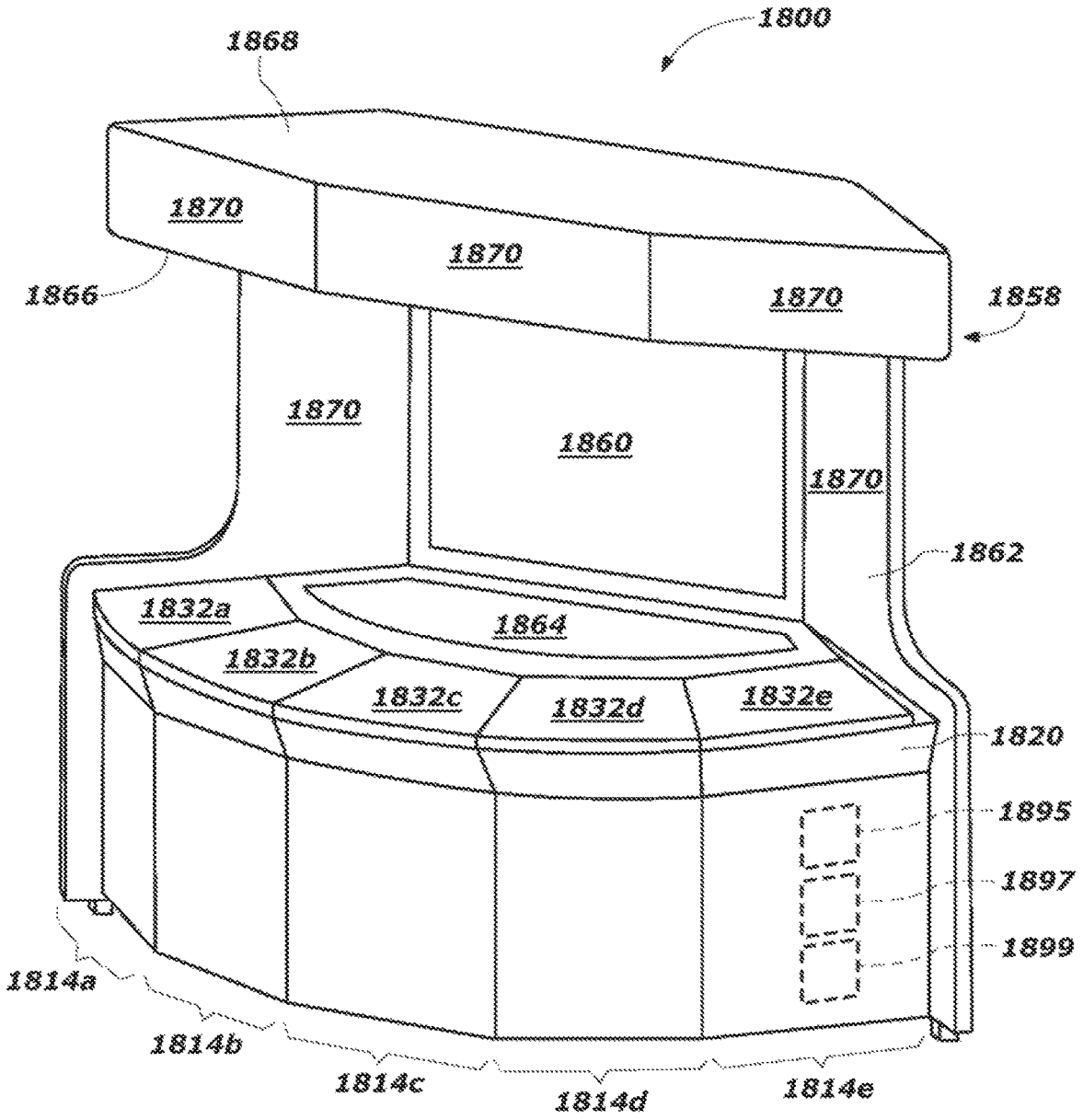
FIG. 18 is a perspective view of another embodiment of a table configured for implementation of embodiments of wagering games in accordance with the present disclosure, wherein the implementation includes a virtual dealer or croupier.

Referring to FIG. 18, another example of a suitable multiple-player, electronic table 1800 configured for implementation of embodiments of wagering games having a virtual dealer according to the present disclosure is shown. The table 1800 may include player positions 1814*a* through 1814*e* that are arranged in a bank about an arcuate edge 1820 of a video device 1858 that may comprise a roulette wheel screen 1864 and a dealer screen 1860. The dealer screen 1860 may display a video simulation of the dealer (i.e., a virtual dealer) for interacting with the video device 1858, such as through processing one or more stored programs stored in memory 1895 to implement the rules of game play at the video device 1858. The dealer screen 1860 may be carried by a generally vertically extending cabinet 1862 of the video device 1858. The roulette wheel screen 1864 may be configured to display at least a virtual roulette wheel operated by the virtual dealer on the dealer screen 1860.

Each of the player positions 1814*a* through 1814*e* may include a player interface area 1832*a* through 1832*e* that is configured for wagering and game play interactions with the video device 1858 and/or virtual dealer. Accordingly, game play may be accommodated without involving a physical roulette wheel, physical chips, and/or live personnel. The action may instead be simulated by a control processor 1897 interacting with and controlling the video device 1858. The control processor 1897 may be located internally within, or otherwise proximate to, the video device 1858. The control processor 1897 may be programmed, by known techniques, to implement the rules of game play at the video device 1858. As such, the control processor 1897 may interact and communicate with display/input interfaces and data entry inputs for each player interface area 1832*a* through 1832*e* of the video device 1858. Other embodiments of tables and gaming devices may include a control processor that may be similarly adapted to the specific configuration of its associated device.

A communication device 1899 may be included and operably coupled to the control processor 1897 such that information related to operation of the table 1800, information related to the game play, or combinations thereof may be communicated between the table 1800 and other devices (not shown) through a suitable communication media, such, as, for example, wired networks, Wi-Fi networks, and cellular communication networks.

The video device 1858 may further include banners (not shown) configured to communicate rules of play and/or the like, which may be located along one or more walls 1870 of the cabinet 1862. The video device 1858 may further include additional decorative lights (not shown) and speakers (not shown), which may be located on an underside surface 1866, for example, of a generally horizontally depending top 1868 of the cabinet 1862 of the video device 1858 generally extending toward the player positions 1814*a* through 1814*e*.

Further detail of an example of a table and player displays is disclosed in U.S. patent application Ser. No. 10/764,995, filed Jan. 26, 2004, published as U.S. Patent Application Publication No. 2005/0164762 on Jul. 28, 2005, now U.S. Pat. No. 8,272,958, issued Sep. 25, 2012, and titled "AUTOMATED MULTIPLAYER GAME TABLE WITH UNIQUE IMAGE FEED OF DEALER," the disclosure of each of which application and patent is incorporated herein in its entirety by this reference. Although an embodiment is described showing individual discrete player stations, in some embodiments, the entire playing surface (e.g., player interface areas 1832*a* through 1832*e*, roulette wheel screen 1864, etc.) may be an electronic display that is logically partitioned to permit game play from a plurality of players for receiving inputs from, and displaying game information to, the players, the dealer, or both.

As a specific, nonlimiting example, a gaming table for administering a game of roulette may include a playing surface including at least one player interface for at least one player position, an operator interface, and at least one processor. The at least one processor may be programmed to: accept a wager from a player; randomly select a multiplier from a group of fixed multipliers for a payout on the wager and randomly generate a number and associated color within a range of numbers and associated colors. The at least one processor may identify a triggering event when the randomly generated number and associated color is identical to the randomly generated number and associated from the immediately preceding round. Upon identifying a triggering event, the at least one processor may further randomly generate one or more numbers and associated colors within a range of numbers and associated colors to generate an outcome of one or more special roulette games. An amount of a payout equal to an amount of the wager modified according to a paytable associated with the outcome of the one or more special roulette games may be authorized for payment to the player, or the at least one processor may authorize collection of the amount of the wager for the house when the randomly generated number is different from the randomly generated number from the immediately preceding round.

Figure 19:
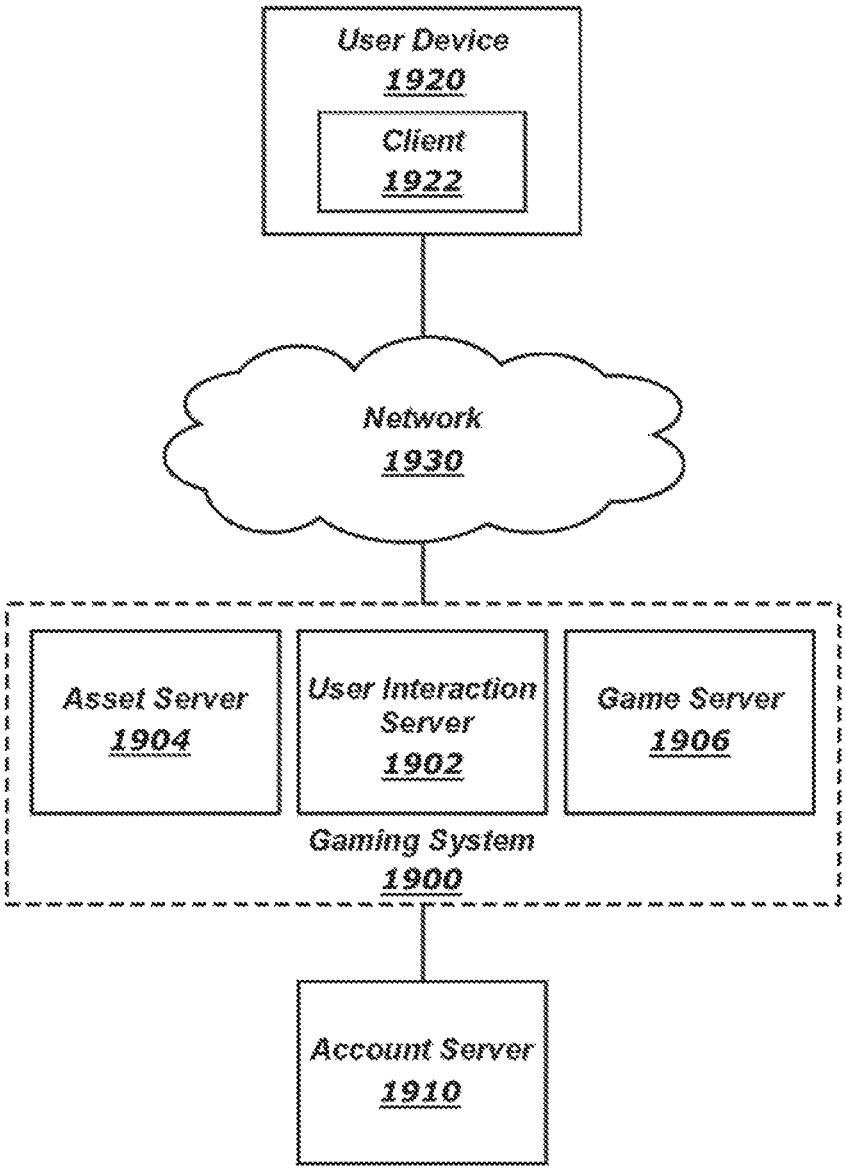
FIG. 19 is a schematic block diagram of another gaming system for implementing embodiments of wagering games in accordance with the present disclosure.

As discussed above with regard to FIG. 4, in some embodiments, wagering games in accordance with embodiments of the disclosure may be administered over the Internet, or otherwise online, in one embodiment using a gaming system employing a client server architecture. Referring to FIG. 19, illustrated is a schematic block diagram of another gaming system 1900 for implementing wagering games according to an embodiment of the present disclosure. The gaming system 1900 enables end users to access proprietary and/or non-proprietary game content through an online casino client 1922 ("the client 1922"). Such game content may include, without limitation, various types of wagering games such as card games, dice games, big wheel games, roulette, scratch off games ("scratchers"), and any other wagering game where the game outcome is determined, in whole or in part, by one or more random events.

The client 1922 may be an online casino that handles user funds, and enables play of a wide variety of casino-style games, such as roulette, card games, dice games, slot games, and EGM games. A player accesses the client 1922 with a user device 1920 such as a personal computer, tablet, cell phone or other mobile device over a network, such as the Internet or a closed casino network. Players are able to make real money wagers through the user device 1920 and the client 1922 delivers game results to the player over a network 1930. Losses are taken by the online casino, and wins are paid out to the player. The client 1922 handles client funds, and interacts with financial service providers to transfer funds in and out of the casino accounts. The server architecture of the client 1922 can take many forms. In one example, the client 1922 is operably connected to a separate remote gaming system 1900 that administers and delivers game results for one or more games, but in other embodiments, all of the online game play is administered in the client 1922. Exemplary gaming systems 1900 deliver game results, administer game rules, and confirm wagers are made and that funds are available, but such systems do not interact directly with users and do not handle player funds.

The wagering games supported by the gaming system 1900 may track player account balances and may use this information to confirm a game result can be delivered. The same system could be used to administer play-for-fun games in which account balances are tracked but do not represent real currency.

The virtual credits option may be used with wagering games in which credits (or other symbols) may be issued to a player to be used for the wagers. A player may be credited with credits in any way allowed, as discussed above with regarding to the gaming system 400 of FIG. 4.

The gaming system 1900 may include a gaming platform that establishes a portal for an end user to access via a user device 1920 to a wagering game hosted by a game server 1906 through a user interaction server 1902. The user device 1920 may communicate with a user interaction server 1902 of the gaming system 1900 using a network 1930 (e.g., the Internet). The user interaction server 1902 may communicate with the game server 1906 and provide game information, such as graphical displays and game interactions to the user. In some embodiments, the functionality of the gaming system may be incorporated into the online casino client 1922. In some embodiments, a single user device 1920 communicates with a game provided by the game server 1906, while other embodiments may include a plurality of user devices 1920 configured to communicate and provide end users with access to the same game provided by the game server 1906. In addition, a plurality of end users may be permitted to access a single user interaction server 1902, or a plurality of user interaction servers 1902, to access the game server 1906.

The user interaction server 1902 may communicate with the user device 1920 through the client 1922 to enable access to the gaming system 1900. The user may be unaware that the game is being administered by gaming system 1900 and not the client 1922. In embodiments, the user device 1920 includes a user display that includes game assets delivered from the asset server 1904 from gaming system 1900, as well as casino assets (such as the casino name, logo and other distinctive graphics) delivered by the client 1922. The user interaction server 1902 may enable a user to create and access a user account and interact with gaming server 1906. The user interaction server 1902 may enable users to initiate new games, join existing games, and interface with games being played by the user.

In some embodiments, the user interaction server 1902 may also provide the client 1922 for execution on the user device 1920 for accessing the gaming system 1900. The client 1922 provided by the gaming system 1900 for execution on the user device 1920 can comprise a variety of implementations according to the user device 1920 and method of communication with the gaming system 1900. In one embodiment, the user device 1920 connects to the gaming system 1900 using a web browser, and the client 1922 executes within a browser window or frame of the web browser. In another embodiment, the client 1922 is a standalone executable on the user device 1920.

In one embodiment, the client 1922 may comprise a relatively small amount of script (e.g., JAVASCRIPT®), also referred to as a "script driver," including scripting language that controls an interface of the client 1922. The script driver may include simple function calls requesting information from the gaming system 1900. In other words, the script driver stored in the client 1922 may merely include calls to functions that are externally defined by, and executed by, the gaming system 1900. As a result, the client 1922 may be characterized as a "thin client." As that term is used herein, the client 1922 may be little more than a script player. The client 1922 may simply send requests to the gaming system 1900 rather than performing logic itself for the games administered by gaming system 1900. The client 1922 may perform logic for other games that are not administered by gaming system 1900. For example, gaming system 1900 may administer an online casino's card games while all other games are administered by the client 1922. The client 1922 receives player inputs, and the player inputs are passed to the gaming system 1900 for processing and executing the wagering game. In one embodiment, this includes providing specific graphical display information to the client 1922 as well as game outcomes.

In other embodiments, the client 1922 comprises an executable file rather than a script. In that case, the client 1922 may do more local processing than does a script driver, such as calculating where to show what game symbols upon receiving a game outcome from game server 1906 through user interaction server 1902. In one embodiment, it may be that portions of an asset server 1904 are loaded onto the client 1922 and are used by the client 1922 in processing and updating graphical displays. Due to security and integrity concerns, most embodiments will have the bulk of the processing of the game play performed in the gaming system 1900. However, some embodiments may include significant game processing by the client 1922 when the client and user device 1920 are considered trustworthy or when there is reduced concern for security and integrity in the displayed game outcome. In most embodiments, it is expected that some form of data protection, such as end-to-end encryption, will be used when data is transported over network 1930. Network 1930 may be any network, including, but not limited to, the Internet.

In an embodiment where the client 1922 implements further logic and game control methodology beyond the thin client, the client 1922 may parse and define player interactions prior to passing the player interactions to the gaming system 1900. Likewise, when the client 1922 receives a gaming interaction from the gaming system 1900, the client 1922 may be configured to determine how to modify the display as a result of the gaming interaction. The client 1922 may also allow the player to change a perspective or otherwise interact with elements of the display that do not change aspects of the game.

The gaming system 1900 may include an asset server 1904, which may host various media assets (e.g., audio, video, and image files) that may be sent to the client 1922 for presenting the various wagering games to the end user. In other words, in this embodiment, the assets presented to the end user may be stored separately from the client 1922. In one embodiment, the client 1922 requests the assets appropriate for the game played by the user; in other embodiments, especially those using thin clients, just those assets that are needed for a particular display event will be sent by game server 1906 when the game server 1906 determines they are needed, including as few as one asset. In one example, the client 1922 may call a function defined at the user interaction server 1902 or asset server 1904, which may determine which assets are to be delivered to the client 1922 as well as how the assets are to be presented by the client 1922 to the end user. Different assets may correspond to the various clients that may have access to the game server 1906 or to different games to be played.

The game server 1906 is configured to perform game play methods and determine game play outcomes that are provided to the user interaction server 1902 to be transmitted to the user device 1920 for display on the end user's computer. For example, the game server 1906 may include game rules for one or more wagering games, such that the game server 1906 controls some or all of the game flow for a selected wagering game as well as the determined game outcomes. The game server 1906 may include paytables and other game logic. The game server 1906 also performs random number generation for determining random game elements of the wagering game. In one embodiment, the game server 1906 is separated from the user interaction server 1902 by a firewall or other method of preventing unauthorized access to the game server 1906 from the general members of the network 1930.

The user device 1920 may present a gaming interface to the player and communicate the user interaction to the gaming system 1900. The user device 1920 may be any electronic system capable of displaying gaming information, receiving user input, and communicating the user input to the gaming system 1900. As such, the user device 1920 can be a desktop computer, a laptop, a tablet computer, a set-top box, a mobile device (including, but not limited to, a smartphone), a kiosk, a terminal, or another computing device. The user device 1920 operating the client 1922 may comprise an interactive electronic gaming system 1600 (see FIG. 16), as described above. The client 1922 may be a specialized application or may be executed within a generalized application capable of interpreting instructions from an interactive gaming system, such as a web browser.

The client 1922 may interface with an end user through a web page or an application that runs on a device including, but not limited to, a smartphone, a tablet, or a general computer, or the client 1922 may be any other computer program configurable to access the gaming system 1900. The client 1922 may be illustrated within a casino webpage (or other interface) indicating that the client 1922 is embedded into a webpage, which is supported by a web browser executing on the user device 1920.

In one embodiment, the gaming system 1900 may be operated by a different entity than the operator of the client 1922. The hardware of gaming system 1900 may be located remotely from the client 1922. The user device 1920 may be operated by a third party, such as a casino or an individual, that links to the gaming system 1900, which may be operated, for example, by a wagering game service provider. Therefore, in some embodiments, the user device 1920 and the client 1922 may be operated by a different administrator than the operator of the game server 1906, and the user device 1920 and the client 1922 may also be operated by separate administrators. In other words, the user device 1920 may be part of a third-party system that does not administer or otherwise control the gaming system 1900 or game server 1906.

In another embodiment, the user interaction server 1902 and asset server 1904 are provided by a third-party system. For example, a gaming entity (e.g., a casino) may operate the user interaction server 1902 or user device 1920 to provide its customers access to game content managed by a different entity that may control game server 1906, amongst other functionality. In some embodiments, these functions are operated by the same administrator. For example, a gaming entity (e.g., a casino) may elect to perform each of these functions in-house, such as providing both the access to the user device 1920 and the actual game content and providing administration of the gaming system 1900.

The gaming system 1900 may communicate with one or more external account servers 1910, optionally through another firewall. For example, the gaming system 1900 itself may not directly accept wagers or issue payouts. That is, the gaming system 1900 may facilitate online casino gaming but may not be part of a self-contained online casino itself. Instead, the gaming system 1900 may facilitate the play of wagering games owned and controlled by a company offering games and gaming products and services, such as Bally Gaming, Inc. Another entity (e.g., a casino or any account holder or financial system of record) may operate and maintain its external account servers 1910 to accept bets and make payout distributions. The gaming system 1900 may communicate with the account servers 1910 to verify the existence of funds for wagering and to instruct the account server 1910 to execute debits and credits.

In some embodiments, the gaming system 1900 may directly accept bets and make payout distributions, such as in the case where an administrator of the gaming system 1900 operates as the client 1922. As discussed above, the gaming system 1900 may be integrated within the operations of a casino rather than separating out functionality (e.g., game content, game play, credits, debits, etc.) among different entities. In addition, for play-for-fun wagering games, the gaming system 1900 may issue credits, take bets, and manage the balance of the credits according to the game outcomes, but the gaming system 1900 may not permit payout distributions or be linked to an account server 1910 that permits payout distributions. Such credits may be issued for free, through purchase, or for other reasons, without the ability for the player to cash out. Such play-for-fun wagering games may be administered on platforms that do not permit traditional gambling, such as to comply with jurisdictions that do not permit online gambling. In embodiments where a user device 1920 accesses games administered by gaming system 1900 through the client 1922, the account server 1910 contains "mirror accounts" that track account balances to confirm wagers have been made and there are funds to support the wagers before delivering game results. In this embodiment, no actual player funds are handled by the account server 1910.

The gaming system 1900 may be configured in many ways, from a fully integrated single system to a distributed server architecture. The asset server 1904, the user interaction server 1902, the game server 1906, and the account server 1910 may be configured as a single, integrated system of code modules running on a single server or machine, where each of the servers is functionally implemented on a single machine. In such a case, the functionality described herein may not be implemented as separate code modules. The asset server 1904, the user interaction server 1902, the game server 1906, and the account server 1910 may also be implemented as a plurality of independent servers, each using its own code modules running on a separate physical machine, and may further include one or more firewalls between selected servers (depending on security needs). Each server could communicate over some kind of networked connection, potentially as varied as that described for network 1930. Further, each single server shown in FIG. 19 may be implemented as a plurality of servers with load balancing and scalability factors built into the embodiment. All such embodiments and variations are fully contemplated.

Additional features may be supported by the game server 1906, such as hacking and cheating detection, data storage and archival, metrics generation, messages generation, output formatting for different end user devices, as well as other features and operations. For example, the gaming system 1900 may include additional features and configurations as described in U.S. patent application Ser. No. 13/353,194, filed Jan. 18, 2012, now U.S. Pat. No. 9,120,007, issued Sep. 1, 2015, and U.S. patent application Ser. No. 13/609,031, filed Sep. 10, 2012, now U.S. Pat. No. 8,974,305, issued Mar. 10, 2015, both titled "NETWORK GAMING ARCHI- TECTURE, GAMING SYSTEMS, AND RELATED METHODS," the disclosures of which are incorporated herein in their entirety by this reference.

The network 1930 may enable communications between the user device 1920 and the gaming system 1900, and the user device 1920 and the online casino client 1922. A network may also connect the gaming system 1900 and account server 1910, and, further, one or more networks may interconnect one or more of the other servers shown collectively as the game system 1900. In one embodiment, the network 1930 uses standard communications technologies and/or protocols. Thus, the network 1930 can include links using technologies such as Ethernet, 802.11, worldwide interoperability for microwave access (WIMAX®), 3G, digital subscriber line (DSL), asynchronous transfer mode (ATM), INFINIBAND®, PCI Express Advanced Switching, etc. Similarly, the networking protocols used on the network 1930 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 1930 can be represented using technologies and/or formats including the hypertext markup language (HTML), the extensible markup language (XML), etc. In addition, all or some of the links can be encrypted using conventional encryption technologies such as secure sockets layer (SSL), transport layer security (TLS), virtual private networks (VPNs), Internet Protocol security (IPsec), etc. In another embodiment, the entities can use custom and/or dedicated data communications technologies instead of, or in addition to, the ones described above. Depending upon the embodiment, the network 1930 can include links comprising one or more networks such as the Internet.

Figure 20:
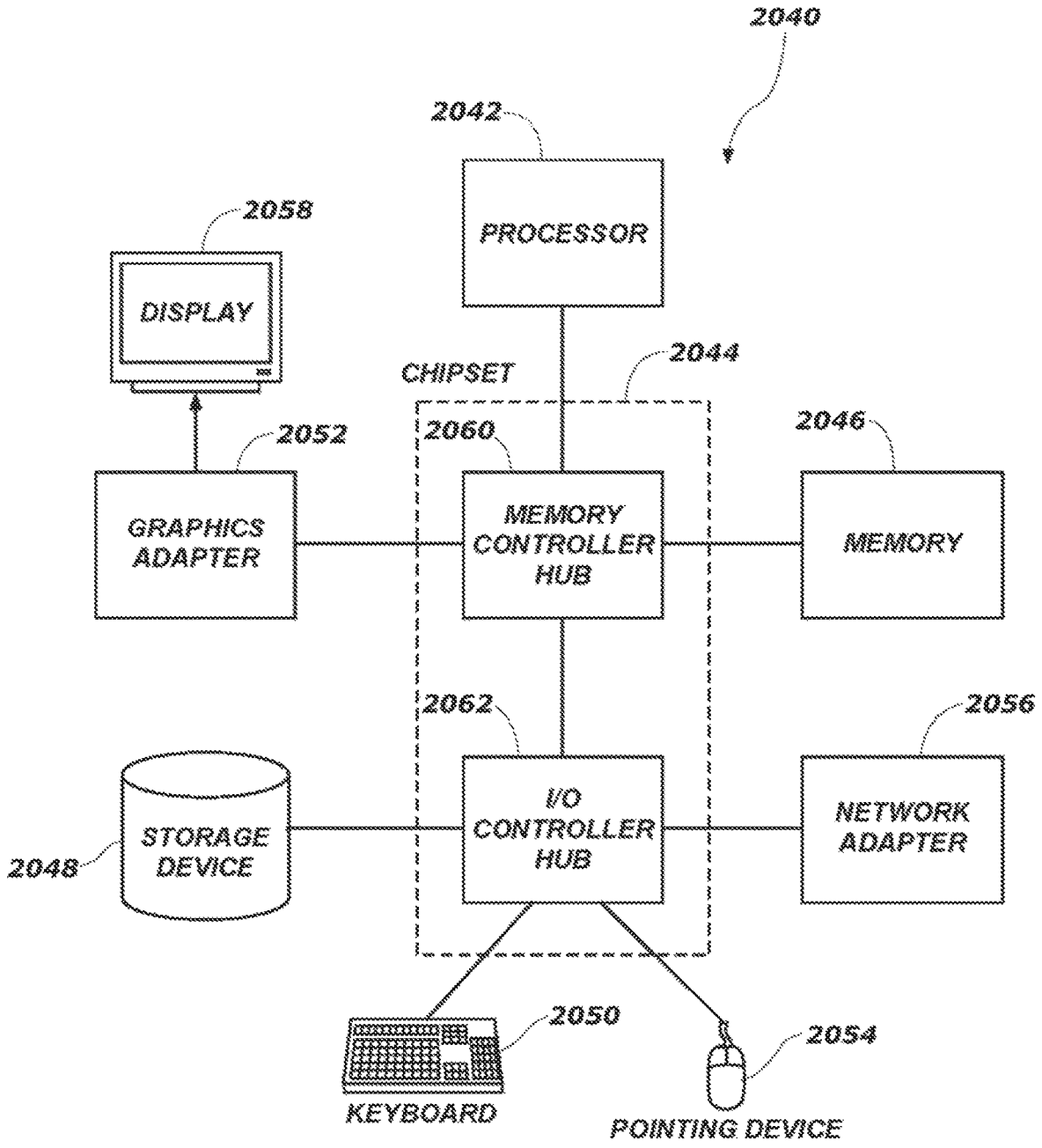
FIG. 20 is a block diagram of a computer for acting as a gaming system for implementing embodiments of wagering games in accordance with the present disclosure.

Referring to FIG. 20, a high-level block diagram of a computer system 2040 for acting as the gaming system 1900 (see FIG. 19) according to one embodiment is shown. Illustrated are at least one processor 2042 coupled to a chipset 2044, as indicated in dashed lines. Also coupled to the chipset 2044 are memory 2046, a storage device 2048, a keyboard 2050, a graphics adapter 2052, a pointing device 2054, and a network adapter 2056. A display 2058 is coupled to the graphics adapter 2052. In one embodiment, the functionality of the chipset 2044 is provided by a memory controller hub 2060 and an I/O controller hub 2062. In another embodiment, the memory 2046 is coupled directly to the processor 2042 instead of to the chipset 2044.

The storage device 2048 is any non-transitory computer-readable storage medium, such as a hard drive, a compact disc read-only memory (CD-ROM), a DVD, or a solid-state memory device (e.g., a flash drive). The memory 2046 holds instructions and data used by the processor 2042. The pointing device 2054 may be a mouse, a track pad, a track ball, or another type of pointing device, and it is used in combination with the keyboard 2050 to input data into the computer system 2040. The graphics adapter 2052 displays images and other information on the display 2058. The network adapter 2056 couples the computer system 2040 to a local or wide area network.

As is known in the art, the computer system 2040 can have different and/or other components than those shown in FIG. 20. In addition, the computer system 2040 can lack certain illustrated components. In one embodiment, the computer system 2040 acting as the gaming system 1900 (FIG. 19) lacks the keyboard 2050, pointing device 2054, graphics adapter 2052, and/or display 2058. Moreover, the storage device 2048 can be local and/or remote from the computer system 2040 (such as embodied within a storage area network (SAN)). Moreover, other input devices, such as, for example, touchscreens may be included.

The network adapter 2056 (may also be referred to herein as a communication device) may include one or more devices for communicating using one or more of the communication media and protocols discussed above with respect to FIG. 19.

In addition, some or all of the components of this general computer system 2040 of FIG. 20 may be used as part of the processor and memory discussed above with respect to the systems of FIGS. 16, 17, and 18.

The gaming system 1900 (FIG. 19) may comprise several such computer systems 2040. The gaming system 1900 may include load balancers, firewalls, and various other components for assisting the gaming system 1900 to provide services to a variety of user devices.

As is known in the art, the computer system 2040 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 2048, loaded into the memory 2046, and executed by the processor 2042.

Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic)

quantities within the computer system memories or registers or other such information storage, transmission, or display devices.

Certain aspects of the embodiments include process steps and instructions described herein in the form of an algorithm. It should be noted that the process steps and instructions of the embodiments can be embodied in software, firmware, or hardware, and, when embodied in software, could be downloaded to reside on and be operated from different platforms used by a variety of operating systems. The embodiments can also be in a computer program product that can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

In some embodiments, wagering games may be administered over a network. For example, a method of administering a game of roulette over a network may involve receiving at a user interaction server authorization from a player to allocate funds to a wager. The game server may randomly generate a number and associated color within a range of numbers and associated colors. A triggering event may be determined at the game server by determining at the game server whether the randomly generated number is identical to a randomly generated number from an immediately preceding round. Upon identifying the triggering event, the game server may randomly generate additional number(s) and associated color(s) within a range of numbers and associated colors to produce outcomes of one or more special roulette games and authorize payment of a payout to the player. An amount of the payout may be equal to an amount of the wager modified according to a paytable associated with possible outcomes of the one or more special roulette games. The game server may authorize collection of the amount of the wager for the house when the randomly generated number is different from the randomly generated number from the immediately preceding round.

As another specific, non-limiting example, a method of administering a play-for-free game of roulette over a network may include sending from a user interaction server or the client 1922 a quantity of valueless wagering elements usable within a predetermined time period to a player. Authorization from a player may be received at the user interaction server or the client 1922 to allocate at least one valueless wagering element to a wager. When a gaming system 1900 is utilized by the client 1922, the game server may randomly generate a number and associated color within a range of numbers and associated colors. The game server may randomly generate a number and associated color within a range of numbers and associated colors. A triggering event may be determined at the game server by determining at the game server whether the randomly generated number and associated color is identical to a randomly generated number and associated color from an immediately preceding round. Upon identifying the triggering event, the game server may randomly generate additional number(s) and associated color(s) within a range of numbers and associated colors to produce outcomes of one or more special roulette games, and authorize payment of a quantity of the additional valueless wagering elements equal to the quantity of valueless wagering elements allocated to the wager modified according to a paytable associated with possible outcomes of the one or more special roulette games. The game server may authorize deduction of the quantity of valueless wagering elements allocated to the wager when the randomly generated number is different from the randomly generated number from the immediately preceding round. Functions performed by the game server 1906 may be performed by other components of the online gaming system 1900 or the client 1922 in other embodiments.

In accordance with one or more embodiments described above, the special roulette game outcome may be the result of the selection of at least one randomly-selected additional number and associated color. In other embodiments, two randomly-selected additional numbers and associated colors are randomly selected to produce the special roulette game outcome. In still other embodiments, the two randomly-selected additional numbers and associated colors are randomly selected at the same time by introducing (e.g., by the ball launching system 600 of FIGS. 6 through 12), or simulating the introduction (e.g., by the ball launching system 600 of FIGS. 6 through 12) of, two roulette balls into a roulette wheel track in succession so that both additional numbers and associated colors cumulatively form the special game outcome.

For example, with returned reference to FIG. 3, in some embodiments, multiple separate roulette wheels 304 may be utilized. Each may have associated therewith one of the ball launching systems 600 of FIGS. 6 through 12. A first of the multiple (e.g., three) roulette wheels 304 may be operated, with one roulette ball launched using the associated ball launching system 600, to randomly generate an outcome of a first round of a roulette game. The second of the multiple (e.g., three) roulette wheels 304 may be operated, after or concurrently with the first of the roulette wheels 304, with one roulette ball launched using the ball launching system 600 associated with the second wheel to randomly generate an outcome of a second round of the roulette game. If the random outcome of the first round (using the first wheel) and the second round (using the second wheel) is the same, then the third wheel may be operated, using one or more roulette balls launched with the ball launching system 600 associated with the third wheel to randomly generate the special game outcome.

For example, Table 1 illustrates an example of a paytable (e.g., for paytable 1542 of FIG. 15) associated with such a cumulatively-formed special game outcome. In the table, the "triggering" pocket refers to the randomly generated number and associated color identical to a randomly generated number and associated color from an immediately preceding round that caused the identification or detection of the above-mentioned triggering event.

TABLE 1

| | |
|---|---|
| BOTH IN TRIGGERING POCKET | 500 TO 1 |
| BOTH IN SAME POCKET | 200 TO 1 |
| BOTH IN ADJACENT POCKETS | 100 TO 1 |
| BOTH IN SAME COLOR POCKETS | 40 TO 1 |
| OTHER | 10 TO 1 |

While the example of Table 1 illustrates a paytable for the possible outcomes of a special roulette game in which two balls are used, a single ball or more than two balls may be used in a single "spin" of the roulette wheel to determine the special game outcome. In some embodiments, multiple "spins" with one or more balls may employed to generate the special game outcome.

In accordance with one or more embodiments which may employ a physical roulette wheel as a component of the random selection of a number and corresponding color, a ball launching system, such as the ball launching system 600 of FIGS. 6 through 12, or, in other embodiments, of any type may, be configured to launch a roulette ball into a roulette wheel ball track, either as part of the initial random selection of a number and associated color, as part of the random selection of one or more numbers and associated colors of the above-described special game(s), or both. The ball launching system may be integrated into the roulette wheel itself, or may take the form of a "retrofit" ball launching system, which may include a support stand, a driver configured to impart rotary motion, a launch actuator, a ball loader, and a rotor mounted on the support stand for rotation by the driver about a rotor axis, as discussed above with regard to FIGS. 6 through 12. In one example, the support stand positions the rotor inside a perimeter of the ball track. In one example, a ball cup assembly is fixed to the rotor distal the rotor axis, and the ball cup assembly includes a first cup wall and second cup wall spaced oppositely apart from each other. As discussed above, the ball cup assembly has a retain mode during which the roulette ball is captured between at least the first and second cup walls. The ball cup assembly also has a release mode during which at least one of the first and second cup walls moves to release the roulette ball. The ball loader of the ball launching system delivers a roulette ball to the ball cup assembly when the rotor is positioned at a loading angle. With the ball cup assembly in the retain mode capturing the roulette ball, the driver rotates the rotor to a launch angle, and the launch actuator causes the ball cup assembly to switch to the launch mode to release the roulette ball into the ball track.

An example of a method of conducting a roulette game with a ball launching system includes mounting the ball launching system proximal to a roulette wheel. The ball launching system includes a rotor rotating substantially parallel to a plane of a roulette wheel ball track and a ball cup fixed to the rotor. The method includes spinning the roulette wheel and receiving a player input at a signal button to activate the ball launching system. In response to receiving a signal from the signal button, the method further includes rotating, via a driver configured to impart rotary motion, the rotor to a designated launch angle. In response to the rotor being at the launch angle, the method further includes triggering a launch of a roulette ball captured between a first and second cup wall of the ball cup by causing at least one of the first and second cup wall to move away from the other cup wall and release the ball into the roulette wheel ball track.

A ball launching system may include these and additional features and configurations as described about with regard to FIGS. 6 through 12 or as described in U.S. patent application Ser. No. 14/865,592, filed Sep. 25, 2015, titled "ROULETTE BALL LAUNCHING SYSTEM," the disclosure of which is incorporated herein in its entirety by this reference. However, it is within the scope of this disclosure to incorporate any type of manually or automatically operated ball-launching mechanism, examples of which may include a motor-driven ball launcher, a pneumatic ball launcher, a gravity-driven ball launcher or a spring-driven ball launcher, any of which may be operated by any game participant, player, game administrator, dealer, or any combination thereof.

The various embodiments and examples described herein are provided by way of illustration only and should not be construed to limit the claimed invention, nor the scope of the various embodiments and examples. Those skilled in the art will readily recognize various modifications and changes that may be made to the claimed invention without following the example embodiments and applications illustrated and described herein, and without departing from the true spirit and scope of the claimed invention, which is set forth in the following claims. In addition, various embodiments may be combined. Therefore, reference to an embodiment, one embodiment, in some embodiments, in other embodiments, and the like does not preclude one or more methods, functions, steps, features, results, hardware implementations, or software implementations of different embodiments from being combined. Further, reference to an embodiment, one embodiment, in some embodiments, in other embodiments, examples, and the like provides various aspects that may or may not be combined with those of one or more different embodiments and/or examples.

While the example roulette ball launching apparatus and system embodiments have been described with relation to a gaming environment, it will be appreciated that the above concepts can also be used in various nongaming environments. For example, such rewards can be used in conjunction with purchasing products, e.g., gasoline or groceries, associated with vending machines, used with mobile devices or any other form of electronic communications. Accordingly, the disclosure should not be limited strictly to gaming casinos, arcades, portal based game sites, cellular phone devices, personal digital assistant devices, laptops, personal computers, home game consoles, bar top gaming devices, table gaming devices, surface computing devices, table gaming biometric touchscreens, television gaming, or in-room gaming devices.

Moreover, while certain illustrative embodiments of methods, and related apparatus and systems, have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventors.

The foregoing description, for purposes of explanation, uses specific nomenclature and formula to provide a thorough understanding of the disclosed embodiments. It should be apparent to those of skill in the art that the specific details are not required in order to practice the disclosed embodiments. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. A gaming table for administering a game of roulette, comprising:

at least one roulette wheel;

at least one ball launching system mounted, by a mounting structure, to a table surface of the gaming table proximate the at least one roulette wheel, each of the at least one ball launching systems comprising:

a ball cup assembly supported from a distal end of the mounting structure, the ball cup assembly comprising a first cup wall opposite a second cup wall, at least one of the first cup wall and the second cup wall being movable relative to another of the first cup wall and the second cup wall; and a rotary motion driver configured to impart rotary motion to the ball cup assembly, causing the ball cup assembly to rotate in a plane parallel to a ball track of the at least one roulette wheel, the ball cup assembly rotating from a home position, toward a launch position in which the ball cup assembly directs a roulette ball toward the ball track, and to then continue the ball cup assembly rotation full circle causing the ball cup assembly to return to the home position;

a remote signal button configured to wirelessly initiate a launch actuator of the at least one ball launching system to cause the at least one of the first cup wall and the second cup wall to move away from the other of the first cup wall and the second cup wall to release the roulette ball from the ball cup assembly at the launch position;

a playing surface comprising:

a wagering area illustrated with indicia associated with a range of numbers and colors of the at least one of the roulette wheel; and at least one bonus wager area external to the wagering area; and a display separate from the playing surface and comprising:

an area designated for displaying historical game outcomes;

an immediately preceding outcome area; and a paytable defining a plurality of bonus payouts, the plurality of bonus payouts comprising multipliers applicable to a bonus wager, each of the multipliers corresponding to a respective one of a set of special roulette game outcomes.

2. The gaming table of claim 1, further comprising an operator interface, a nontransitory memory, and at least one processor, the at least one processor programmed to:

interpret a randomly generated number and associated color within the range of numbers and colors;

determine winning outcome conditions, including determining a triggering event when the randomly generated number is identical to a randomly generated number from an immediately preceding round;

cause the display to display the winning outcome conditions in the area designated for displaying the historical game outcomes; and upon the at least one processor determining the triggering event, and after random selection of at least one additional number and associated color producing a special roulette game outcome of the set of special roulette game outcomes, record in the nontransitory memory authorization of payment of a bonus payout, of the plurality of bonus payouts, to a player according to the paytable.

3. The gaming table of claim 1, wherein the gaming table comprises a plurality of the at least one roulette wheel, each associated with one of a plurality of the at least one ball launching system.

4. The gaming table of claim 3, wherein one of the plurality of the at least one roulette wheel is designated for resolving a wager received in the wagering area and another of the plurality of the at least one roulette wheel is designated for administering a special roulette game to resolve the bonus wager receivable in the at least one bonus wager area.

5. The gaming table of claim 1, wherein the gaming table comprises three of the at least one roulette wheel, each associated with a separate ball launching system of the at least one ball launching system.

6. The gaming table of claim 1, wherein the at least one ball launching system further comprises a cam lobe supported by the mounting structure and positioned to contact a cam follower connected to the at least one of the first cup wall and the second cup wall as the ball cup assembly approaches the launch position.

7. The gaming table of claim 1, wherein the first cup wall and the second cup wall are each independently pivotally movable relative to one another.

8. The gaming table of claim 1, wherein the first cup wall and the second cup wall are configured to counter-rotate about a common pivot access to release the roulette ball from the ball cup assembly at the launch position.

9. The gaming table of claim 1, wherein the rotary motion driver is configured to impart the rotary motion about a rotor axis that is substantially perpendicular to a plane defined by a perimeter of the ball track, the plane defined by the perimeter of the ball track being parallel to the plane in which the ball cup assembly is caused to rotate.

10. The gaming table of claim 1, wherein:

the ball cup assembly is supported from the distal end of the mounting structure by a rotor extending below the distal end of the mounting structure;

the rotary motion driver is offset from a rotor axis about which the rotor and the ball cup assembly are rotatable; and the rotary motion driver is connected to the rotor by at least one of a belt, a chain, or a gear train.

11. A method of administering a game of roulette using the gaming table of claim 1, the method comprising:

providing the gaming table of claim 1;

accepting, in the at least one bonus wager area, the bonus wager from a player;

using the at least one ball launching system to launch the roulette ball onto the at least one roulette wheel to randomly generate a randomly generated number and associated color within a range of numbers and associated colors defined in the at least one roulette wheel, comprising, upon receipt of a signal from the remote signal button:

the rotary motion driver rotating the ball cup assembly in the plane parallel to the ball track of the at least one roulette wheel from the home position to the launch position with the roulette ball captured between the first cup wall and the second cup wall of the ball cup assembly, and the rotary motion driver continuing to rotate the ball cup assembly full circle to return to the home position; and upon the ball cup assembly rotating to the launch position, the launch actuator of the ball launching system causing the at least one of the first cup wall and the second cup wall to move away from the other of the first cup wall and the second cup wall to release the roulette ball from the ball cup assembly into the ball track when the ball cup assembly is at the launch position, after release of the roulette ball from the ball cup assembly into the ball track, the roulette ball coming to rest in a space of the range of numbers and associated colors to randomly generate the randomly generated number and associated color;

identifying a triggering event by determining whether the randomly generated number and associated color is identical to the randomly generated number and associated color from an immediately preceding round; and upon identifying the triggering event:

using the at least one ball launching system to launch the roulette ball onto the at least one roulette wheel to randomly generate at least one additional number and associated color to produce a special roulette game outcome; and paying a payout to the player, an amount of the payout being equal to an amount of the bonus wager modified according to the paytable defining the plurality of bonus payouts.

12. The method of claim 11, wherein using the at least one ball launching system to launch the roulette ball onto the at least one roulette wheel comprises introducing a single roulette ball onto the at least one roulette wheel while the at least one roulette wheel is spinning.

13. The method of claim 11, wherein using the at least one ball launching system to launch the roulette ball onto the at least one roulette wheel to randomly generate the at least one additional number and associated color to produce the special roulette game outcome comprises introducing the roulette ball and at least one other roulette ball onto the at least one roulette wheel while the at least one roulette wheel is spinning.

14. The method of claim 11, further comprising accepting, in the wagering area, another wager from the player on a characteristic of the randomly generated number and associated color before randomly generating the randomly generated number and associated color.

15. The method of claim 11, wherein the bonus wager is a side wager.

16. The method of claim 11, wherein the launch actuator of the ball launching system causing the at least one of the first cup wall and the second cup wall to move away from the other of the first cup wall and the second cup wall comprises counter-rotating the first cup wall and the second cup wall about a common pivot axis.

17. A method of administering a game of roulette using the gaming table of claim 1, the method comprising:

providing the gaming table of claim 1;

accepting, in the wagering area of the playing surface, a first wager from a player;

accepting, in the at least one bonus wager area of the playing surface, the bonus wager from the player;

using the at least one ball launching system and the at least one roulette wheel to randomly generate a number and associated color within the range of numbers and colors, comprising:

a ball loader of the at least one ball launching system delivering the roulette ball to the ball cup assembly when the ball cup assembly is positioned at the home position;

in response to the ball cup assembly being positioned at the home position, the ball cup assembly, in a retain mode, capturing the roulette ball between at least the first and the second cup walls of the ball cup assembly; and in response to receipt of a signal from the remote signal button:

the rotary motion driver rotating the ball cup assembly from the home position to the launch position with the roulette ball captured in the ball cup assembly and the ball cup assembly in the retain mode, and then continuing to rotate the ball cup assembly full circle to return to the home position; and upon the ball cup assembly rotating to the launch position, the launch actuator causing the ball cup assembly to switch from the retain mode to a launch mode to release the roulette ball into the ball track when the ball cup assembly is at the launch position, wherein, after its release, the roulette ball comes to rest in a space of the range of numbers and colors to randomly generate the number and associated color;

resolving the first wager by comparing a characteristic of the number and associated color with a characteristic associated with the first wager;

identifying a triggering event by determining whether the number and associated color are identical to a randomly generated number and associated color from an immediately preceding round; and upon identifying the triggering event:

randomly generating at least one additional number and associated color to produce a special roulette game outcome;

applying the paytable defining the plurality of bonus payouts to determine a bonus payout based on the at least one additional number and associated color; and paying the bonus payout to the player, an amount of the bonus payout being equal to an amount of the bonus wager multiplied by a multiplier, of the multipliers, corresponding to the special roulette game outcome as defined by the paytable.

18. The method of claim 17, wherein randomly generating the at least one additional number and associated color to produce the special roulette game outcome comprises again using the at least one ball launching system to launch the roulette ball onto the at least one roulette wheel.

19. The method of claim 17, wherein randomly generating the at least one additional number and associated color to produce the special roulette game outcome comprises using a second ball launching system, of the at least one ball launching system, to launch at least one other roulette ball onto a second roulette wheel, of the at least one roulette wheel.

20. The method of claim 17, wherein randomly generating the at least one additional number and associated color to produce the special roulette game outcome comprises using one ball launching system, of the at least one ball launching system, to launch the roulette ball and to launch at least one other roulette ball onto one roulette wheel, of the at least one roulette wheel.

21. The method of claim 20, wherein using the one ball launching system, of the at least one ball launching system, to launch the roulette ball and to launch the at least one other roulette ball onto the one roulette wheel, of the at least one roulette wheel, comprises:

launching the roulette ball onto the one roulette wheel while the one roulette wheel is spinning; and before the one roulette wheel stops spinning, launching the at least one other roulette ball.

22. The method of claim 17, wherein using the at least one ball launching system and the at least one roulette wheel to randomly generate the number and associated color within the range of numbers and associated colors comprises randomly generating the number from a range of numbers consisting of 00 and 0 through 36, each of which is assigned an associated color from a range of colors consisting of red, black, and green.

* * * * *